US007469724B2

(12) United States Patent
Nakagawa et al.

(10) Patent No.: US 7,469,724 B2
(45) Date of Patent: Dec. 30, 2008

(54) REINFORCEMENT BINDING MACHINE, REEL, AND METHOD OF DETECTING ROTATION OF REEL

(75) Inventors: Yasushi Nakagawa, Tokyo (JP); Noboru Ishikawa, Tokyo (JP); Ichiro Kusakari, Tokyo (JP); Takahiro Nagaoka, Tokyo (JP); Shuichi Ishii, Tokyo (JP); Atsushi Matsuoka, Tokyo (JP)

(73) Assignee: Max Kabushiki Kaisha, Chuo-Ku, Tokyo (JP)

( * ) Notice: Subject to any disclaimer, the term of this patent is extended or adjusted under 35 U.S.C. 154(b) by 276 days.

(21) Appl. No.: 10/491,002

(22) PCT Filed: Sep. 30, 2002

(86) PCT No.: PCT/JP02/10188

§ 371 (c)(1),
(2), (4) Date: Sep. 20, 2004

(87) PCT Pub. No.: WO03/028917

PCT Pub. Date: Apr. 10, 2003

(65) Prior Publication Data

US 2005/0061389 A1 Mar. 24, 2005

(30) Foreign Application Priority Data

Sep. 28, 2001 (JP) ..... 2001-303445
Jun. 28, 2002 (JP) ..... 2002-189420
Jul. 25, 2002 (JP) ..... 2002-216907

(51) Int. Cl.
*B21F 15/02* (2006.01)
*B21F 9/02* (2006.01)
*B65H 26/00* (2006.01)

(52) U.S. Cl. ..... 140/119; 140/93.6; 242/563

(58) Field of Classification Search ..... 140/119, 140/93 A, 93.6, 57; 242/563, 563.2, 588.6, 242/601, 912, 913; 72/37
See application file for complete search history.

(56) References Cited

U.S. PATENT DOCUMENTS 5,515,887 A 5/1996 Hanagasaki et al.
5,874,816 A 2/1999 Ishii

FOREIGN PATENT DOCUMENTS

EP 0 751 270 A1 1/1997
EP 0 822 303 A1 2/1998
JP 06-190482 7/1994
JP 06-226386 8/1994
JP 2557192 8/1997

(Continued)

*Primary Examiner*—Derris H Banks
*Assistant Examiner*—Teresa Bonk
(74) *Attorney, Agent, or Firm*—Buchanan Ingersoll & Rooney PC

(57) ABSTRACT

A reinforcement binding machine capable of detecting, by the rotation of a reel, that wire on the reel is consumed and the reel, the reinforcement binding machine wherein an interrupter is installed in the cassette case of a binding machine body, a cover is rotatably held on a reel mounting shaft, an opening part is formed in the cover, a projection is formed on the reel and fitted into the opening part, and a color with a lightness different from that of the cover is applied to the projection to detect the rotation of the reel by the interrupter.

12 Claims, 40 Drawing Sheets

FOREIGN PATENT DOCUMENTS

| | | |
|---|---|---|
| JP | 10-45105 | 2/1998 |
| JP | 10-249469 | 9/1998 |
| JP | 11-104777 | 4/1999 |
| JP | 11-156748 | 6/1999 |
| JP | 2002-225813 | 8/2002 |
| SU | 1687673 A1 | 10/1991 |

PRIOR ART

PRIOR ART

REINFORCEMENT BINDING MACHINE, REEL, AND METHOD OF DETECTING ROTATION OF REEL

TECHNICAL FIELD

The present invention relates to a reinforcement binding machine for fixedly binding, for example, reinforcing bars crossing each other with a wire and to a reel used for the machine, and more specifically to a reinforcement binding machine in which the wire is prevented from being detached from the case when fed out, a reinforcement binding machine in which consumption of the wire is detected, and to a reel used for the machine.

BACKGROUND ART

Regarding a reinforcement binding machine, JP 11-104777A and Japanese Utility Model Registration No. 2557192, filed by the applicant of the present application, disclose "Brake Mechanism of Wire Reel for Reinforcing Bar Binding Machine" and "Wire Reel for Binding Machine for binding Reinforcing Bar etc", respectively.

FIGS. 38 and 39 show this reinforcement binding machine, in which a reel 2 around which a wire 3 is wound is retained at the rear of a reinforcement binding machine 1. The wire 3 drawn out of the reel 2 is fed to the front portion of the reinforcement binding machine 1 by a wire feeding means 5, and is curled as it is fed along a guide 6 having an arcuately extending groove to be formed into a loop around reinforcing bars 7 crossing each other in a cross-like form. The wire 3 wound around the reinforcing bars 7 in a loop-like form is grasped by a grasping portion 4, and then the wire feeding by the wire feeding means 5 stops; further, a twisting hook 8 having at its forward end a groove for holding the wire 3 in a loop-like form approaches the wire 3. After the wire is inserted into the groove, the twisting hook 8 rotates to thereby bind the reinforcing bars 7 with the wire 3. Then, the wire 3 is cut by a cutting means provided in the grasping portion 4, which then releases the wire 3.

In the rear portion of the reinforcement binding machine 1, there are provided a reel retaining portion (a cassette case (not shown)) for retaining the reel 2, an optical sensor arranged at a position on the reel retaining portion (cassette case) facing a side surface of the reel 2, and a mark arranged on the side surface of the reel 2 and detected by the optical sensor.

Further, in the rear portion of the reinforcement binding machine 1 shown in FIG. 39, there are provided an arm 9 for retaining the reel 2, an optical sensor arranged at a position on the arm 9 facing a side surface of the reel 2, and a mark arranged on the side surface of the reel 2 and detected by the optical sensor.

The optical sensor applies light to the side surface of the reel 2 and detects reflected light from the mark; when the reel 2 is rotating, reflected light is detected by the optical sensor substantially periodically.

When the wire 3 on the reel 2 has been consumed, the reel 2 does not rotate, so that no periodical reflected light from the mark is detected by the optical sensor, whereby it is determined that the wire 3 has been consumed. In FIG. 39, symbol A1 indicates a twisting mechanism, and symbol A2 indicates a trigger.

However, in the case of this reinforcement binding machine 1, when the optical sensor is exposed to the exterior, due to disturbance light intruding through the gap between the reel 2 and the reel retaining portion (cassette case) or between the reel 2 and the arm 9 shown in FIG. 39, the optical sensor may malfunction; further, when replacing the reel 2 whose wire 3 has been consumed or when detaching the reel 2, dust or dirt may adhere to the optical sensor to make it impossible to detect the mark on the reel 2, with the result that the optical sensor fails to detect the periodical reflected light, resulting in malfunctioning.

In Japanese Utility Model Registration No. 2557192 also, an optical sensor detection mark is similarly detected by an optical sensor. However, it has to be taken into account that the object to be detected (hereinafter, "detection object") cannot be detected when the dimensions of the reinforcement binding machine 1 and the reel 2 or the way they are attached involve some play or when the detection object is stained or out of the proper distance range.

OBJECTS AND SUMMARY

The present invention has been made in view of the above problems. It is an object of the present invention to provide a reinforcement binding machine of the type in which rotation stop of the reel is detected by an optical sensor to thereby detect termination of the wire, wherein there is no malfunction involved due to disturbance light detection or adhesion of dust or the like, making it possible to reliably detect wire consumption by the optical sensor, and further, to provide a reel for such a reinforcement binding machine.

To attain the above object, there is provided a reinforcement binding machine in which a reel mounting shaft is formed on a case mounted to a binding machine main body, in which a reel around which a wire for reinforcement binding is wound is attached to the reel mounting shaft, and in which, when the wire is fed out while rotating the reel, the wire is wound around reinforcing bars in a loop-like form and is then twisted to bind the reinforcing bars, characterized in that an optical sensor facing a side surface of the reel is provided at a bottom of the case, an opaque cover for covering the optical sensor is rotatably retained by the reel mounting shaft, an opening is formed in a region of the cover passing over the optical sensor, and that a detection object with a reflection light quantity different from a reflection light quantity of the cover is provided at a position on the reel on a case bottom side of the reel.

A reel as set forth above may be provided at a position on the reel on a case bottom side thereof a detection object with a reflection light quantity different from a reflection light quantity of the cover.

A reel as set forth above may be provided with a plurality of detection objects differing in a detection physical amount to be detected by a sensor for detecting the reel.

In a reel as set forth above, a difference in the detection physical amount among the detection objects is determined based on a difference in a distance between the sensor and each of the detection objects.

In a reel as set forth above, when the sensor is formed by an optical sensor, the detection physical amounts of the detection objects are determined by the reflection light (light quantity, angle, and pattern) of a light of the optical sensor.

A reinforcement binding machine includes a reel mounting shaft formed on a binding machine main body, in which a reel around which a wire for binding reinforcing bars is attached to the reel mounting shaft, and in which, when the reel is rotated to feed out the wire, the wire is wound around the reinforcing bars in a loop-like form and then twisted to bind the reinforcing bars, characterized in that, in a vicinity of the reel, there is installed a detecting means for detecting a rotating condition of the reel, and that the reel is equipped with a plurality of detection objects differing in a detection physical amount to be detected by the detecting means.

A reel as set forth above, wherein the reel is equipped with a plurality of detection objects differing in a detection physical amount to be detected by the detecting means.

A reinforcement binding machine includes a reel mounting shaft formed on a binding machine main body, in which a reel around which a wire for binding reinforcing bars is attached to the reel mounting shaft, and in which the wire is wound around the reinforcing bars in a loop-like form while feeding the wire by rotating the reel, and is then twisted to thereby bind the reinforcing bars, characterized in that a light receiving means facing a side surface of the reel is installed on a binding machine main body side so as to prevent intrusion of disturbance light, there is provided on the side surface of the reel a detection object adapted to reflect light emitted from a light emitting means and cause the light to be received by the light receiving means, and that a light reception quantity of reflection light from the detection object received by the light receiving means is different from the light reception quantity of reflection light reflected from a portion of the side surface of the reel around the detection object and received by the light receiving means.

A reel as set forth above, wherein there is provided on a side surface of the reel a detection object adapted to reflect light emitted from a light emitting means and cause the light to be received by the light receiving means, and that a light reception quantity of reflection light from the detection object received by the light receiving means is different from a light reception quantity of reflection light from the side surface of the reel received by the light receiving means.

A reel as set forth above, wherein there is provided on the side surface of the reel a cover member for covering the light receiving means, there is provided on the side surface of the reel a detection object adapted to reflect reflection light to the light receiving means, the cover member has an opening allowing the detection object to face the light receiving means, and that, regarding a light reception quantity received by the light receiving means after reflection of emission light from the light emitting means at a time of rotation of the reel, one of the detection object and the cover member is situated at a position making light detection by the light receiving means effective, and the other of the detection object and the cover member is situated at a position making the light detection by the light receiving means ineffective or making the light reception quantity small.

A reel as set forth above, wherein a distance from the detection object to the light receiving means is made different from a distance from the cover member to the light receiving means in order that, regarding the light reception quantity received by the light receiving means after reflection of emission light from the light emitting means at the time of rotation of the reel, one of the detection object and the cover member may be situated at a position making light detection by the light receiving means effective, and that the other of the detection object and the cover member may be situated at a position making the light detection by the light receiving means ineffective or making the light reception quantity small.

A reel rotation detecting method includes emitting light from a light emitting means to a rotation area of a detection object provided on a reel side surface so as to allow detection from an opening of a cover member for covering the reel side surface; causing the light to be reflected by the detection object and by the cover member to cause the reflection light to be received by a light receiving means; and detecting a rotation of the reel based on a difference between a reception light quantity of reflection light from the detection object received by the light receiving means and a reception light quantity of reflection light from the cover member received by the light receiving means.

BRIEF DESCRIPTION OF THE DRAWINGS

FIG. 29(*b*) is an enlarged view of a portion for retaining a wire winding completion end portion, FIG. 29(*c*) is an enlarged partial perspective view showing the construction of a wire winding start end portion, and FIG. 29(*d*) is an explanatory view showing the wire winding start end portion in a bent state.

BEST MODE FOR CARRYING OUT THE INVENTION

A reinforcement binding machine according to an embodiment of the present invention and a reel used therein will now be described with reference to the drawings.

Figure 7:
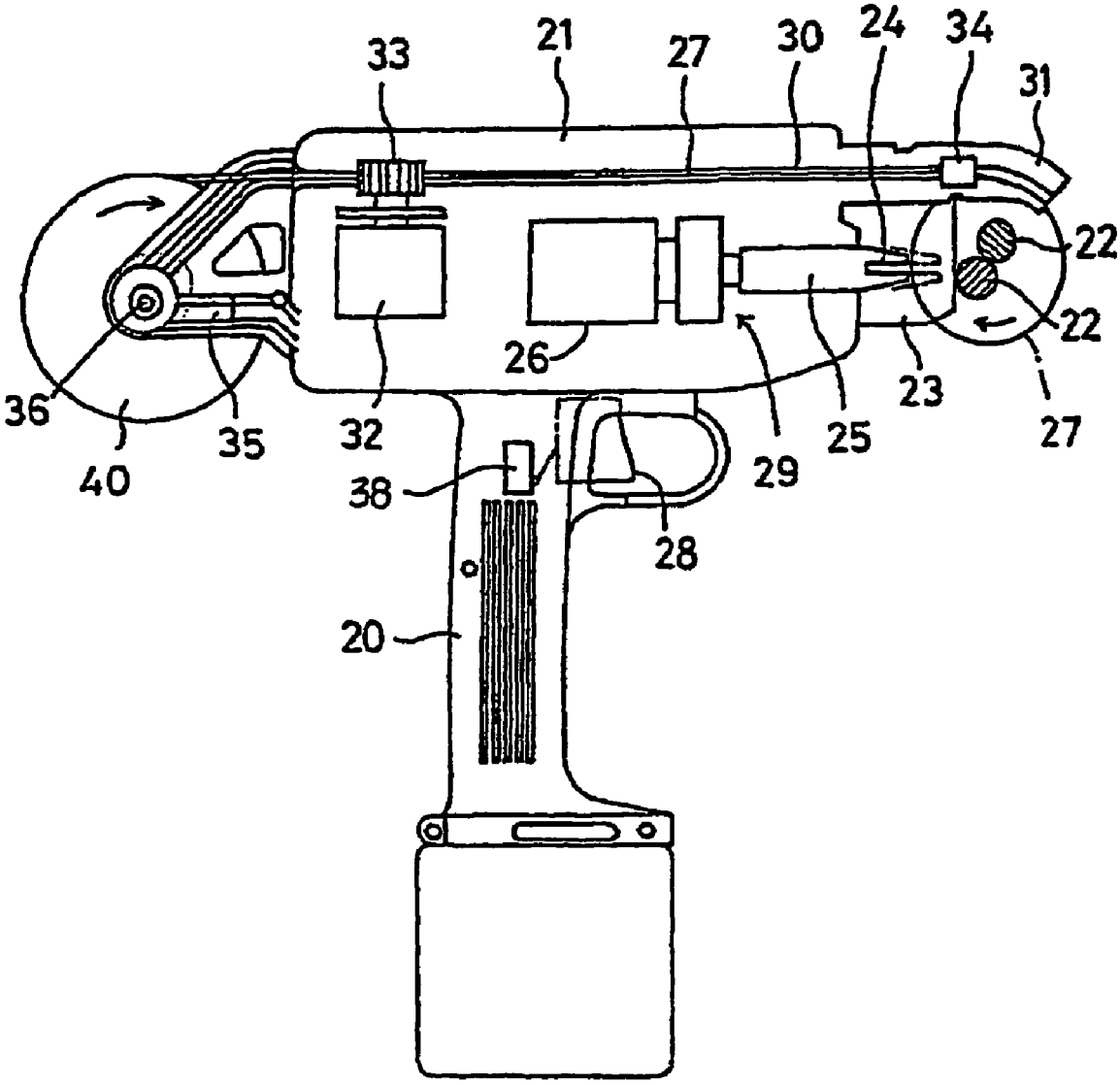
FIG. 7 is a side view of a reinforcement binding machine according to an embodiment of the present invention.
Figure 8:
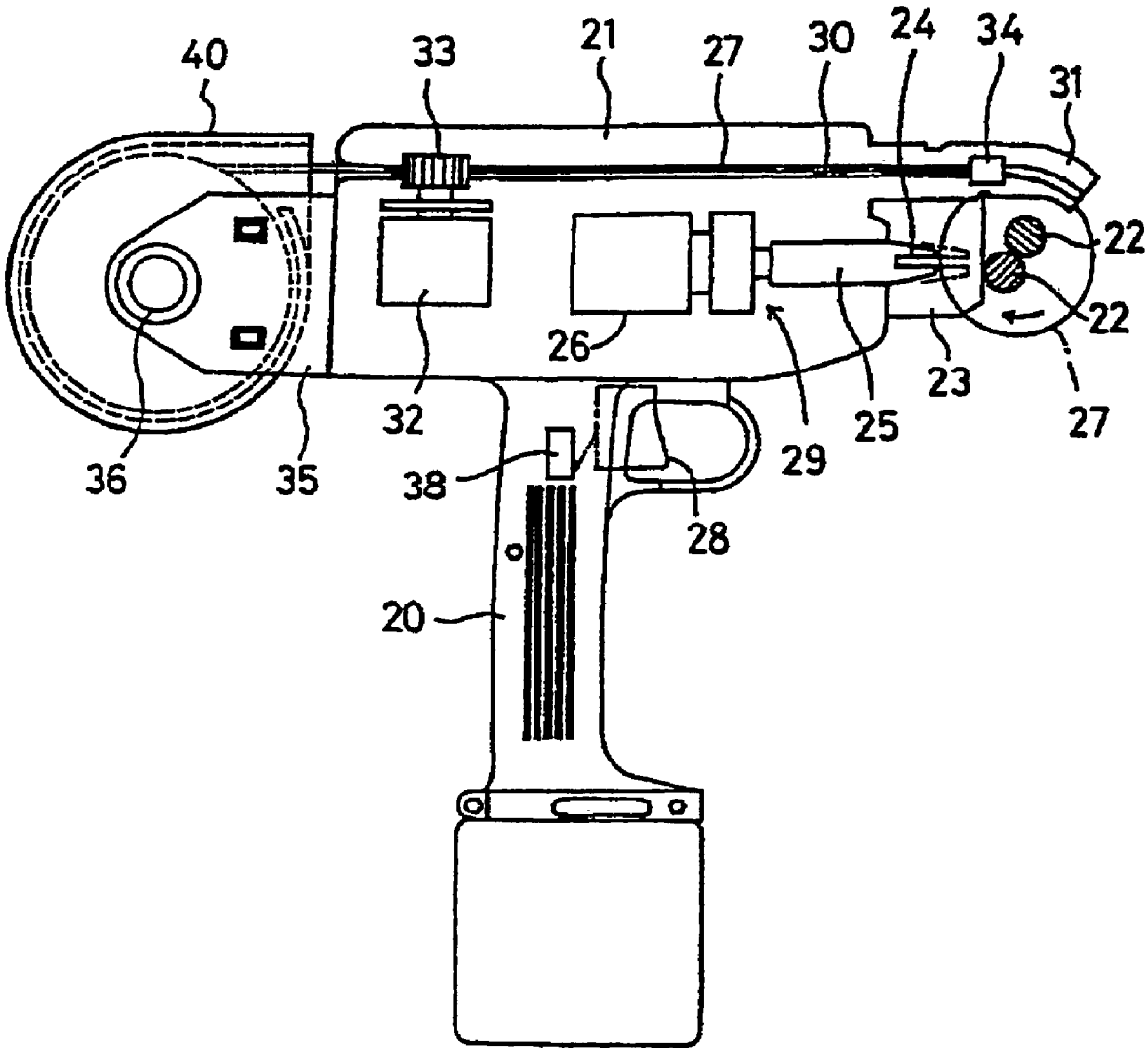
FIG. 8 is a side view of a reinforcement binding machine according to an embodiment of the present invention.

FIG. 7 schematically shows the construction of a reinforcement binding machine according to this embodiment.

[Construction of the Reinforcement Binding Machine]

A reinforcement binding machine 20 has, in the lower portion of the forward end portion of a binding machine main body 21 directed toward reinforcing bars 22, a pair of abutment plate portions 23 which are to abut the reinforcing bars 22, and, between the pair of abutment plate portions 23, there is arranged a twisting hook 25 having at its forward end a wire insertion groove 24.

The twisting hook 25 can be rotated by an electric motor 26. Prior to the start of the rotation of the electric motor 26, the twisting hook 25 is on standby at a position spaced apart from a wire 27, with the wire insertion groove 24 oriented so as to be parallel to the wire 27 which is in a loop-like form, in order that the wire 27 bent into the loop-like form may be easily inserted into the wire insertion groove 24.

The twisting hook 25 is retained by the electric motor 26 through the intermediation of an advancing/retreating mechanism 29. The advancing/retreating mechanism 29 is formed, for example, by a cam mechanism, and is adapted to insert the wire 27 into the wire insertion groove 24 of the twisting hook 25 when the electric motor 26 starts to rotate, causing the twisting hook 25 to retreat to the standby position when the rotation of the electric motor 26 is stopped.

That is, when a trigger is pulled to start the rotation of the electric motor 26, the twisting hook 25 extends toward the wire 27, and, after the wire 27 has been inserted into the wire insertion groove 24, the twisting hook rotates, and, by releasing the trigger 28, the hook stops its rotation and returns to the standby position.

The binding machine main body 21 is equipped with a wire passage 30 through which the wire 27 is passed. The wire passage 30 extends from the rear end portion of the binding machine main body 21 to the guide portion 31 for curling the wire. The guide portion 31 is arcuately curved, and, in the guide portion 31, the wire passage 30 is in the form of a groove open on the inner side of the arc. In the portion of the wire passage 30 in the rear portion of the binding machine main body 21, there is arranged a gear 33 mounted to an output shaft of a motor 32. The gear 33 faces an opening (not shown) provided in the wire passage 30, and presses the wire 27 against the bottom portion of the wire passage 30.

When the micro switch 38 is turned on by the trigger 28, the motor 32 rotates, making it possible to feed the wire 27 to the front or the rear of the binding machine main body 21. The normal/reverse rotation control of the motor 32 is effected by a control circuit (not shown) contained in the binding machine main body 21; for example, after the wire 27 is wound around the reinforcing bars 22 in a loop like form, the wire 27 is pulled toward the cassette case side to thereby reduce looseness of the wire 27.

At the position of the wire passage 30 where it reaches the guide portion 31, there is arranged a wire grasping/cutting means 34. The wire grasping/cutting means 34 consists, for example, of a pair of grasping portions and a pair of cutting edges, the wire 27 passing between the pair of grasping portions and between the pair of cutting edges. When the feed amount of wire 27, based on the rotation amount of the motor 32, reaches a predetermined amount, the wire grasping/cutting means 34 grasps the end portion of the wire 27 by the pair of grasping portions. With the forward end portion of the wire 27, which is wound around the reinforcing bars 22 in a loop form, and the rear end portion of the loop being grasped by the pair of grasping portions, twisting is effected by the twisting hook 25 to bind the reinforcing bars 22, and then the pair of cutting edges are pressed against each other to thereby cut the wire 27.

In the rear end of the binding machine main body 21, there is formed a bearing portion 35 for mounting a reel. In the bearing portion 35, a mounting shaft 36 is provided so as to protrude. A cassette case 40 is detachably mounted to the mounting shaft 36. Inside the cassette case 40, there is mounted a reel 41 (see FIGS. 1 and 2). In the cassette case 40, there is formed an opening (not shown) through which the wire 27 is to be drawn out. The opening of the cassette case 40 faces the wire passage 30.

FIGS. 1 through 5 show an embodiment of the cassette case 40 and the reel 41 of the reinforcement binding machine. The cassette case 40 constitutes a part of the reinforcement binding machine 20.

[Cassette Case]

The cassette case 40 is formed of a plastic material superior in resistance to wear and bending, such as polypropylene, and protruding from a bottom portion 42B of the cassette case 40 is a reel mounting shaft 43 through which the mounting shaft 36 of the bearing portion 35 is inserted for fixation.

The upper side of the cassette case 40 is open so as to allow insertion of the reel 41, and this opening is closed with a cover member 42A. The forward end portion of a reel mounting shaft 43 can be fitted into a cylindrical protrusion P at the center of the cover member 42A.

At the bottom 42B of the cassette case 40, a sensor arrangement hole 44 is open, and inside the sensor arrangement hole 44, there is installed a reflection type interrupter 45 as the optical sensor. Symbol 45A indicates a terminal plate to which the interrupter 45 is mounted; the terminal plate 45A has an annular opening larger than the reel mounting shaft 43 so that the mounting shaft 36 may be inserted into the reel mounting shaft 43. One end portion of the terminal plate 45A is fixed to the bottom portion 42B of the cassette case 40 by means of a screw 45B. Connected to the terminal plate 45A is a cable 45C to be connected to the control circuit described above, making it possible to effect power supply to the interrupter 45 and transmission of the output signal of the interrupter 45 to the control circuit.

The control circuit detects the rotation of the reel 41 from the output signal from the interrupter 45. More specifically, when, although power for rotation is being supplied to the motor 32, a change in the output voltage from the interrupter 45 is not detected within a predetermined period of time, the control circuit judges that the reel 41 is not rotating, informing the operator of the termination of the wire 27 on the reel 41 by, for example, light emission from an LED or the like provided on a side surface of the reinforcement binding machine 1.

[Cover]

Figure 6:
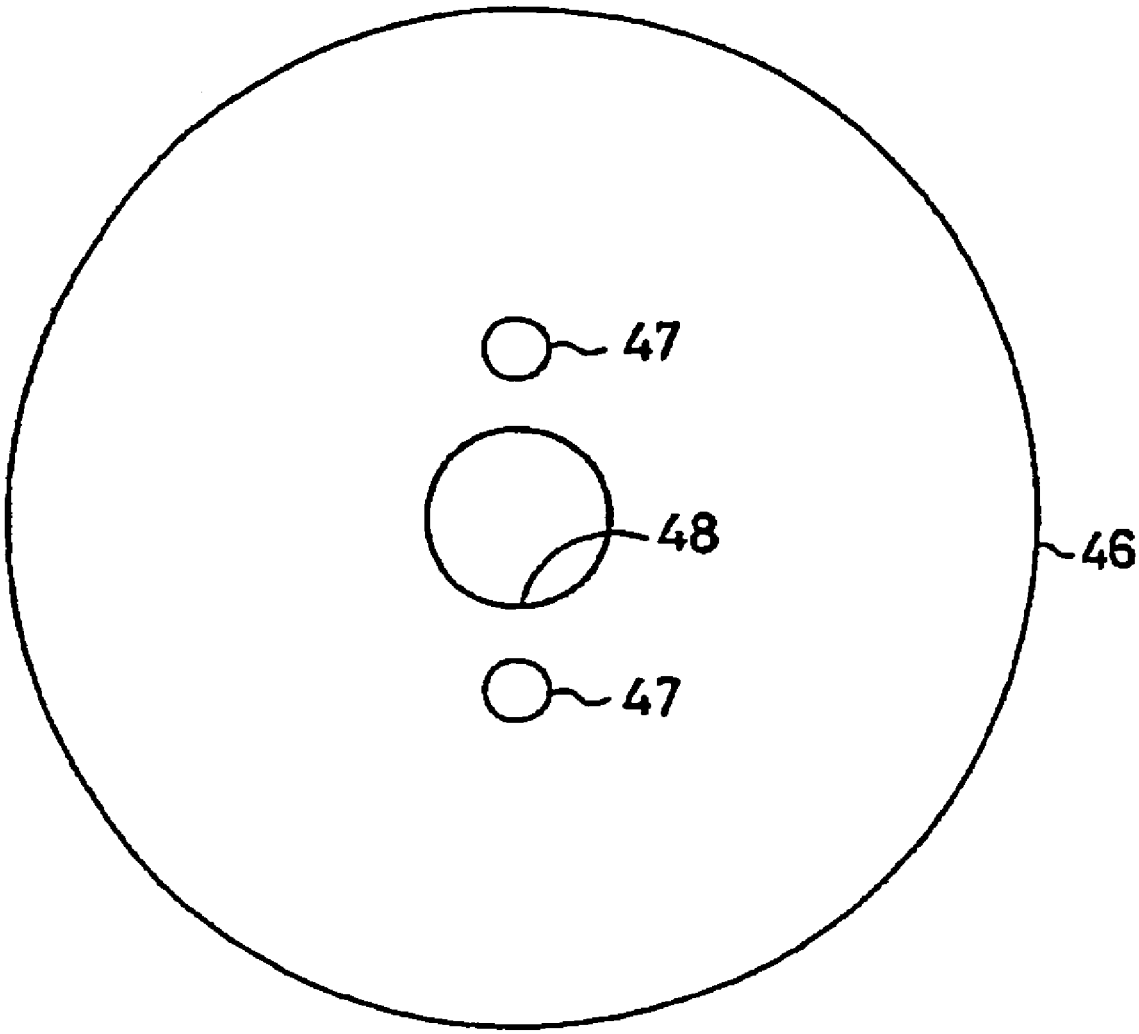
FIG. 6 is a plan view of a cover attached to the cassette case of FIG. 1.

Rotatably mounted to the base portion of the reel mounting shaft 43 is an opaque cover 46 covering the interrupter 45 from above. In order that it may greatly differ in luminosity from the reel 41, the cover 46 is formed of a colored plastic, for example, a black one. As shown in FIG. 6, in portions of the cover 46 passing over the interrupter 45, there are formed a pair of openings 47. The cover 46 has at its center an opening 48 through which the reel mounting shaft 43 is to be inserted. The cover 46 is restricted in vertical movement by a retaining ring 49 mounted to the reel mounting shaft 43 (see FIG. 1).

[Reel]

FIGS. 2 through 5 show the configuration of the reel 41. The reel 41 is formed of a plastic material superior in resistance to wear and bending, such as polypropylene, the plastic material being different in color from the cover member whose color is white or the like so as to increase the reflection light quantity. The wire 27 is wound around the reel 41 and can be moved to the front or to the rear of the binding machine main body 21 as the gear 33 rotates. The reel 41 is capable of rotation in the normal and reverse directions according as the wire 27 is fed out or rewound.

The reel 41 has a hub 41A around which the wire 27 is wound and into which the reel mounting shaft 43 is inserted, and a pair of flanges 50 for regulating horizontal positional deviation of the wire 27.

Figure 3:
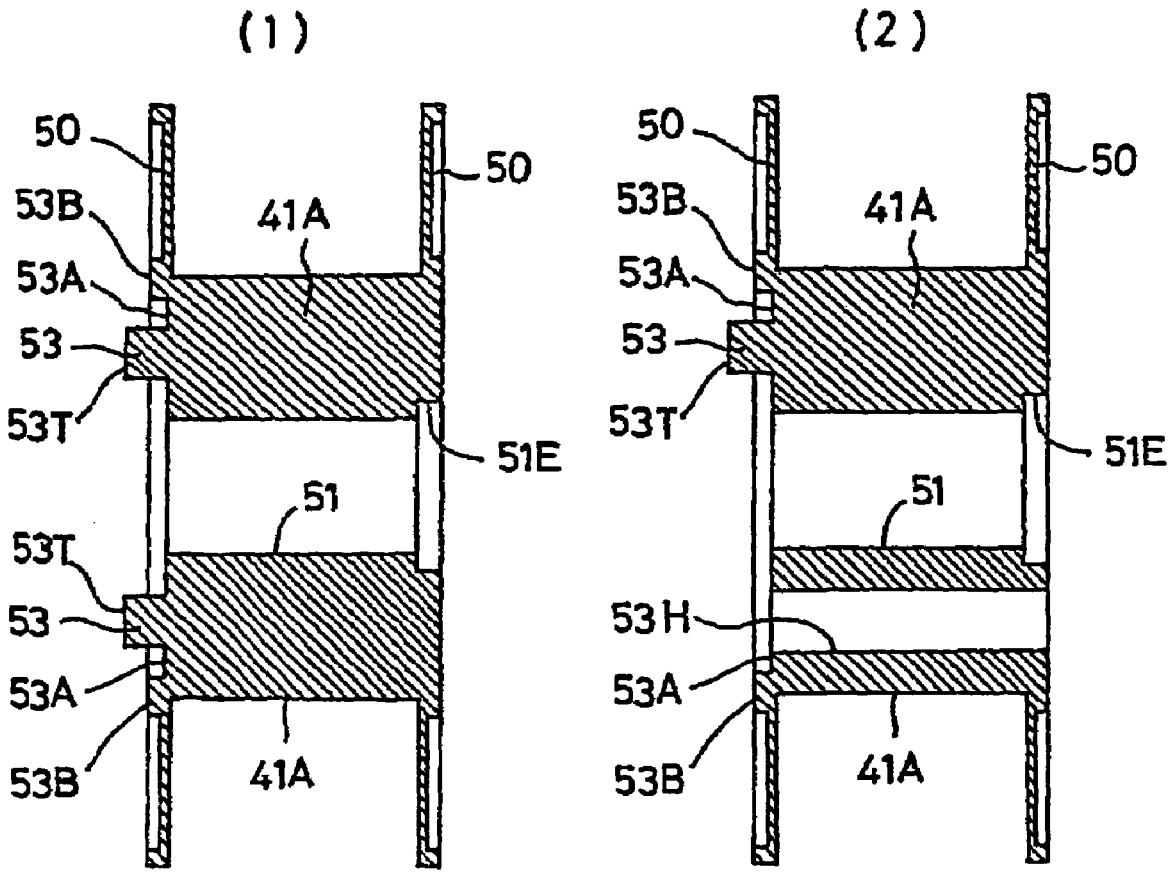
FIG. 3(1) is a sectional view of the reel of FIG. 2 taken along the line III-III, and FIG. 3(2) is a sectional view of a modification of FIG. 3(1)
Figure 4:
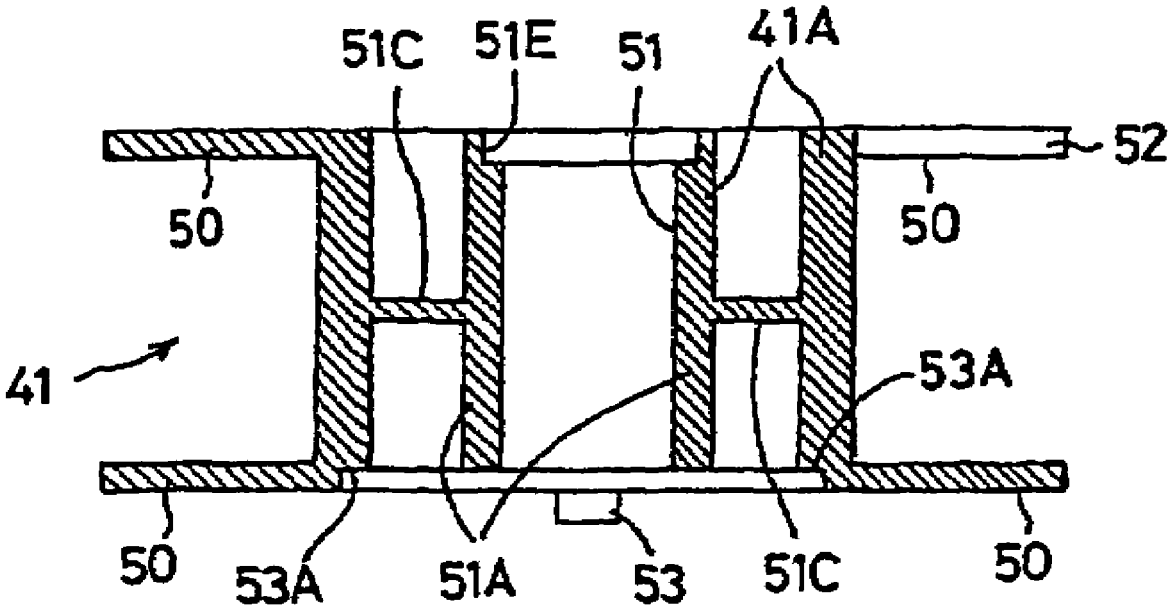
FIG. 4 is a sectional view taken along the line IV-IV of FIG. 2.

The hub 41A is equipped with an inner cylindrical portion 51A into which the reel mounting shaft 43 is inserted and an outer cylindrical portion 51B around which the wire 27 is wound. The inner cylindrical portion 51A and the outer cylindrical portion 51B are connected by intermediate plate portions 51C and ribs 51D, and protrusions 53 are formed on the ribs 51D as the detection objects. As shown in FIGS. 3 and 4, a fitting recess 51E is formed at that end portion of the inner cylindrical portion 51A facing the cover member 42A, and the circular protrusion P of the cover member 42A is fitted into the fitting recess 51E. The reel mounting shaft 43 is inserted into a hub hole 51 inside the inner cylindrical portion 51A.

Figure 5:
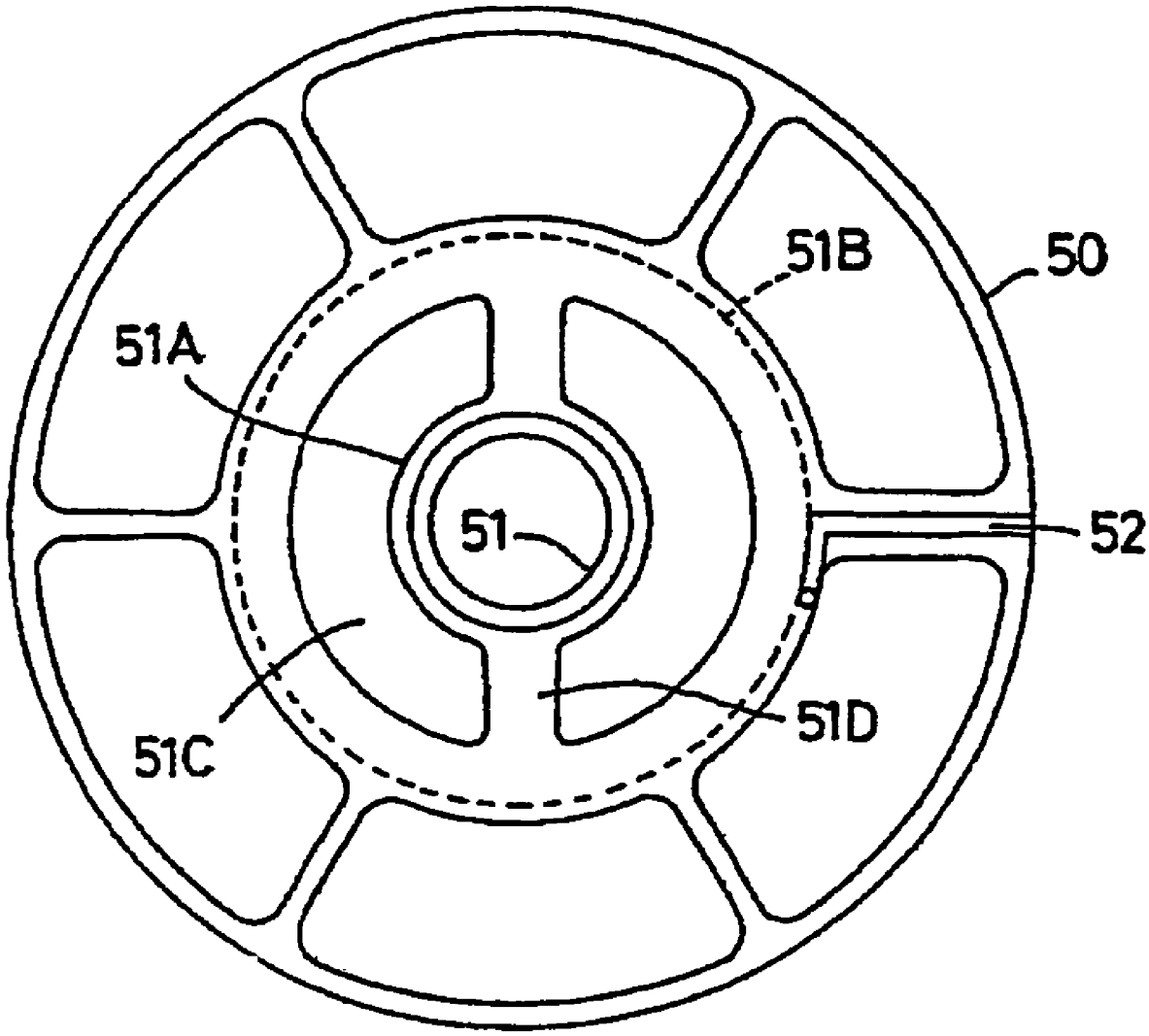
FIG. 5 is a backside view of the reel of FIG. 1.

Lightening is effected as much as possible on the flanges 50 in order to achieve a reduction in cost and weight. As shown in FIG. 5, formed in one of the flanges 50 is a mounting groove 52 for securing the winding start end portion of the wire 27.

Figure 1:
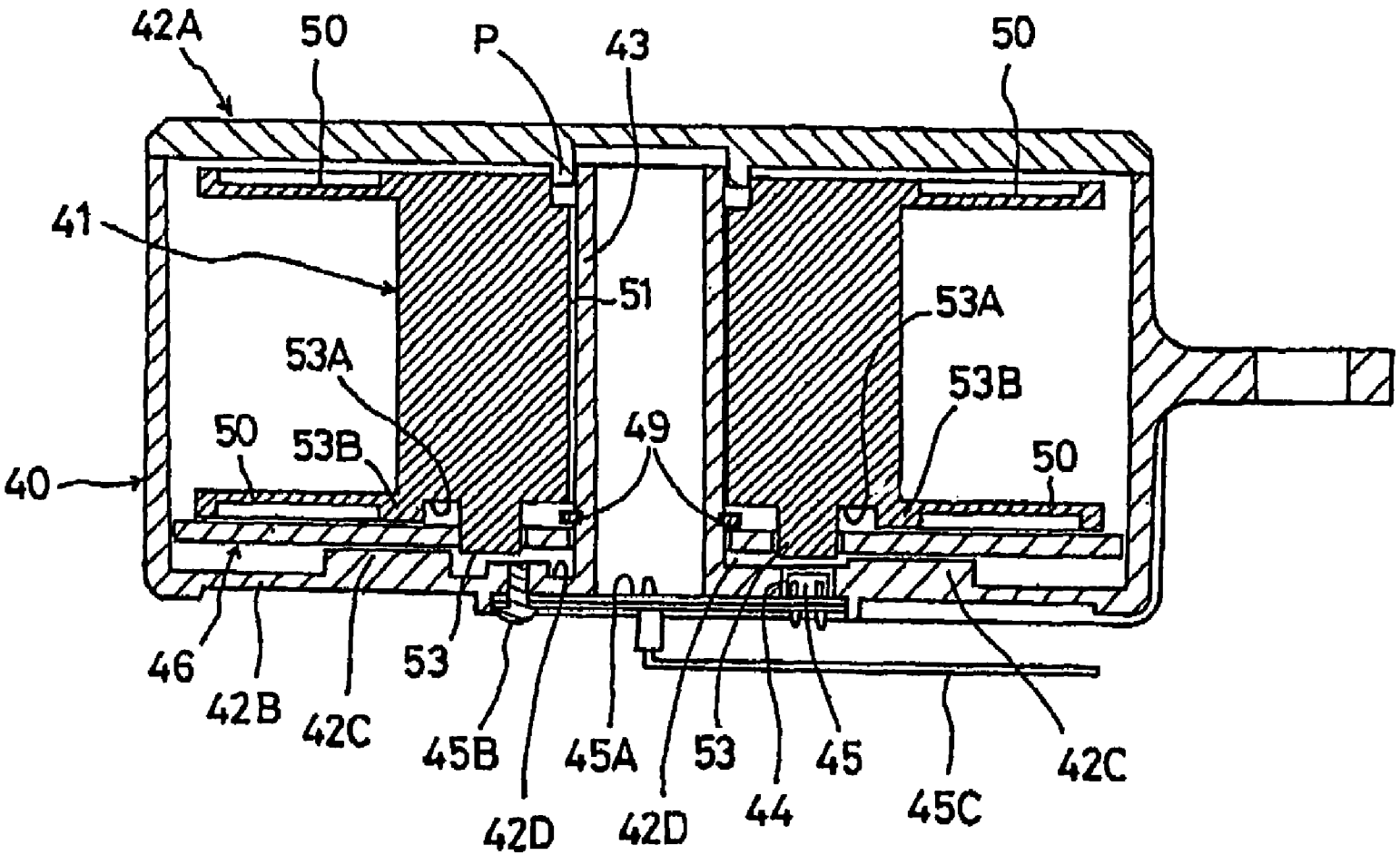
FIG. 1 is a sectional view of a cassette case of a reinforcement binding machine according to a first embodiment of the present invention with a reel attached thereto.
Figure 2:
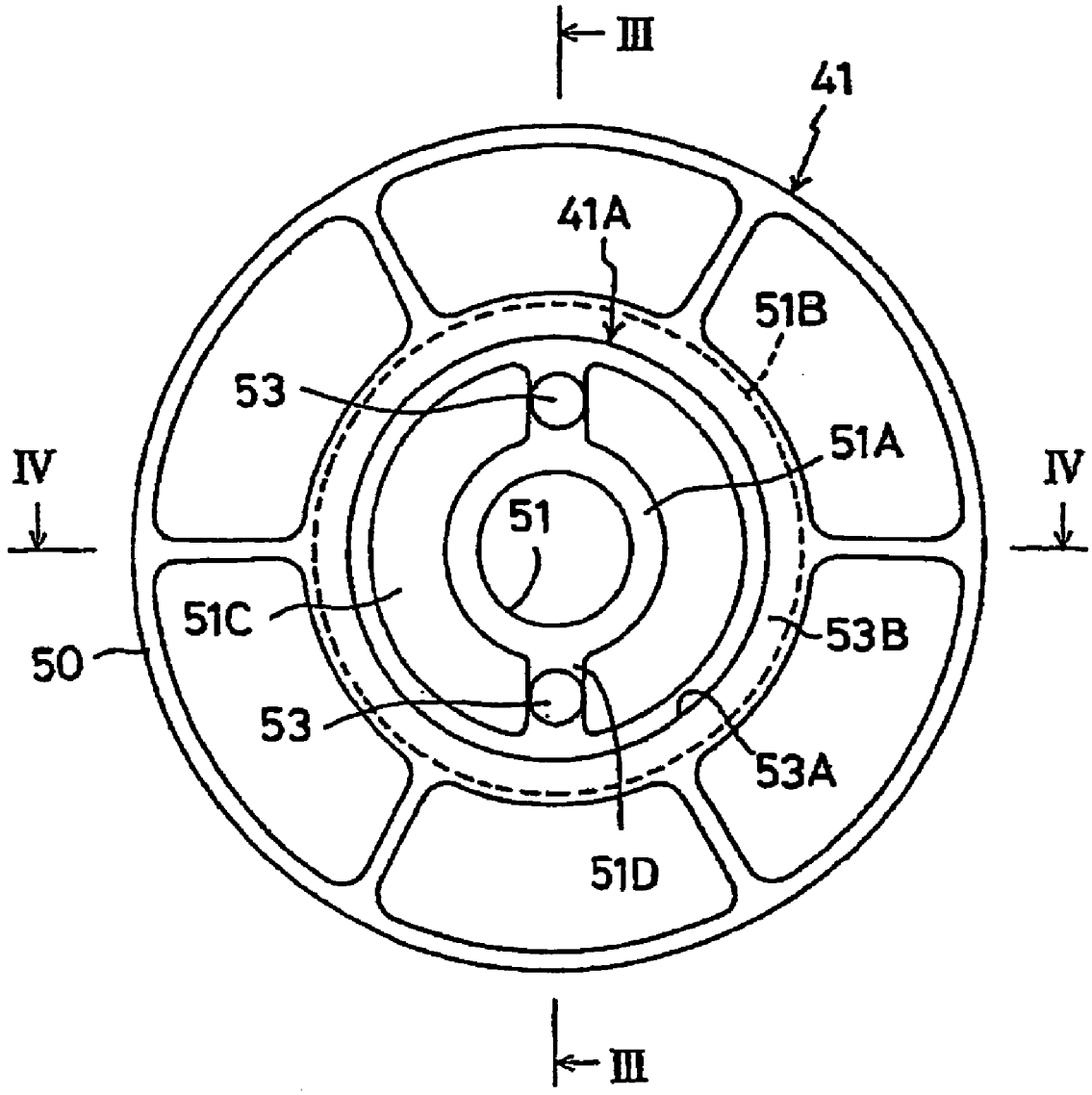
FIG. 2 is a bottom view of the reel of FIG. 1.

As shown in FIGS. 1 and 2, a recess 53A is formed in the surface of the reel 41 facing the bottom portion 42B of the cassette case 40, and the retaining ring 49 of the reel mounting shaft 43 is situated in the recess 53A. A pair of protrusions 53 are formed at the bottom of the recess 53A. The pair of protrusions 53 are formed in a cylindrical configuration so that they may be respectively fitted into the openings 47 of the cover 46 without involving any play. Between the recess 53A and the flange 50, there is formed a ring-like thick-walled portion 53B which is in contact with the cover 46 to prevent intrusion of light into the recess 53A.

Further, on the bottom portion 42B of the cassette case 40, there is formed a thick-walled portion 42C supporting the bottom side flange 50 of the reel 41, and a recess 42D is formed between the reel mounting shaft 43 and the thick-walled portion 42C. The recess 42D forms a gap between the interrupter 45 and the protrusions 53, and the thick-walled portion 42C and the cover 46 rotate while in slide contact with each other, whereby shielding is effected to prevent intrusion of disturbance light into the interrupter 45.

[Detection of Rotation of the Reel]

The pair of protrusions 53 pass over the interrupter 45 during rotation of the reel 41. Since the cover 46 is black and the pair of protrusions 53 are white, the reflection light quantity of the light emitted from the interrupter 45 is larger than the reflection light quantity from the cover 46. The interrupter 45 receives the reflection light and outputs it to the control circuit, which detects rotation of the reel 41 from a change in the output voltage of the interrupter 45.

In the state in which the wire 27 is being wound around the reel 41, when the motor 32 is rotated, the reel 41 rotates by drawing out the wire 27, so that the pair of protrusions 53 periodically pass over the interrupter 45, whereby the interrupter 45 detects the reflection light of the black cover 46 and the reflection light of the white protrusions 53.

Since the reflection light quantity from the white protrusions 53 is larger than the reflection light quantity from the black cover 46, the output voltage of the interrupter 45 varies periodically. When this periodical change can be detected at a fixed interval within the period of time in which the motor 32 is rotating, it means that the reel 41 is rotating.

Further, if, although the motor 32 is rotating, there is no change in the output voltage from the interrupter 45 within a fixed period of time, it means that the reel 41 is not rotating.

Thus, the control circuit can judge the rotation of the reel 41 based on the rotation of the motor 32 and a change in the output voltage of the interrupter 45.

Instead of making the reel 41 white, it is also possible to make the surfaces of the apexes 53T of the protrusions 53 white or to glue stickers or the like thereto. Further, it is also possible to make the cover 46 white, and the reel 41 black. Regarding the difference in color between the cover 46 and the reel 41, a difference which makes it possible to recognize a difference in reflection light quantity suffices, and the colors are not restricted to black and white.

While in the above embodiment the detection objects consists of the protrusions 53, and the color luminosity of the protrusions 53 is made different from that of the cover, it is also possible for the detection objects to consist of a plurality of small protrusions, small recesses, etc. consisting of cones, semi-spheres, etc. or step portions, grooves, etc. formed on the surfaces of the protrusions 53 or to be formed by surface roughening.

Alternatively, as shown in FIG. 3(2), as another example of the detection object, it is possible to form a through-hole 53H at a position on the bottom side of the reel 41; instead of forming such a through-hole 53H, it is also possible to form a plurality of small protrusions, small recesses, etc. consisting of cones, semi-spheres, etc. or step portions, grooves, etc. or to perform surface roughening treatment.

[Another Reel Construction]

Figure 9:
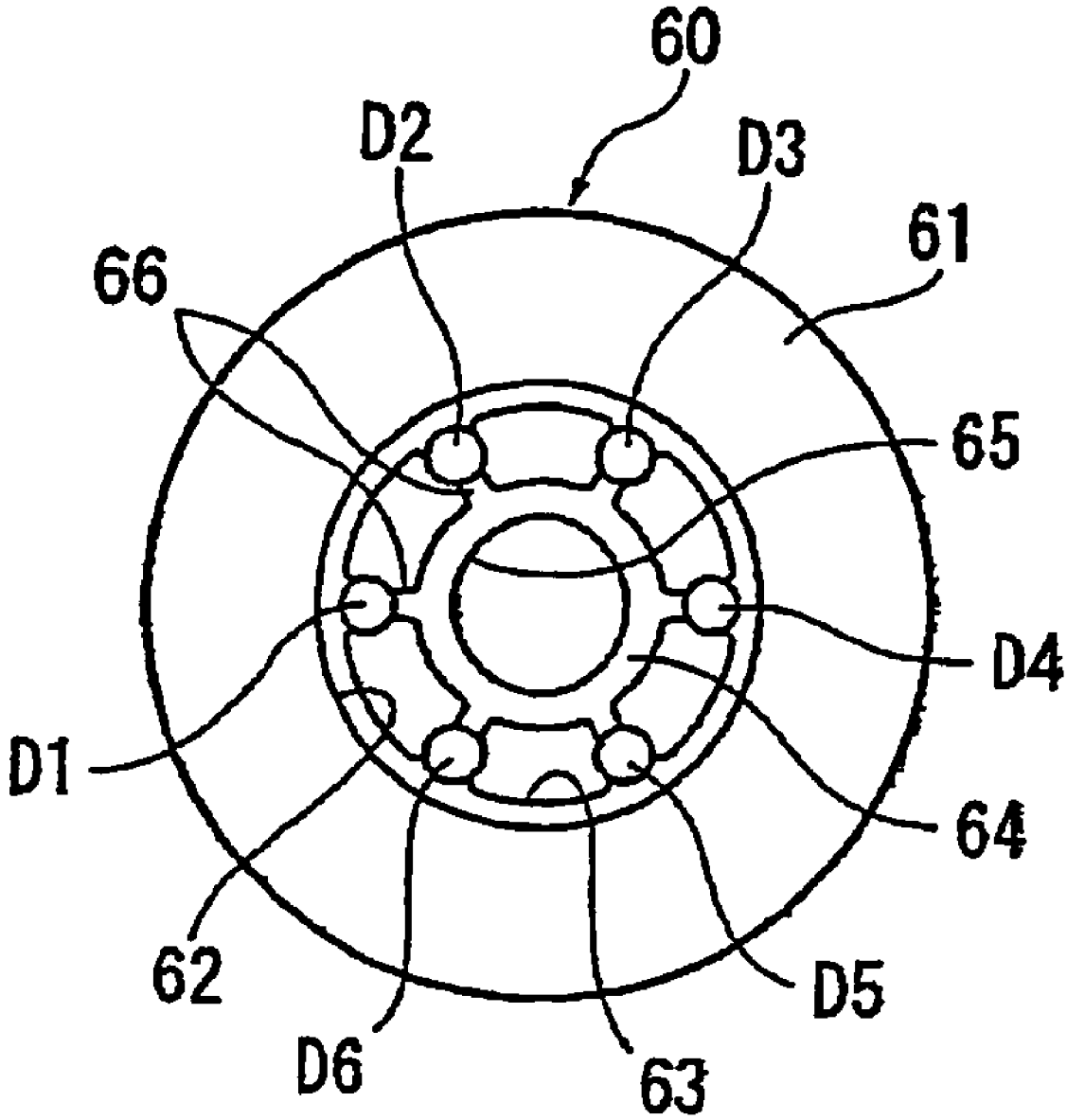
FIG. 9 is a side view of a reel according to an embodiment of the present invention provided with a plurality of protrusions having different heights.
Figure 10:
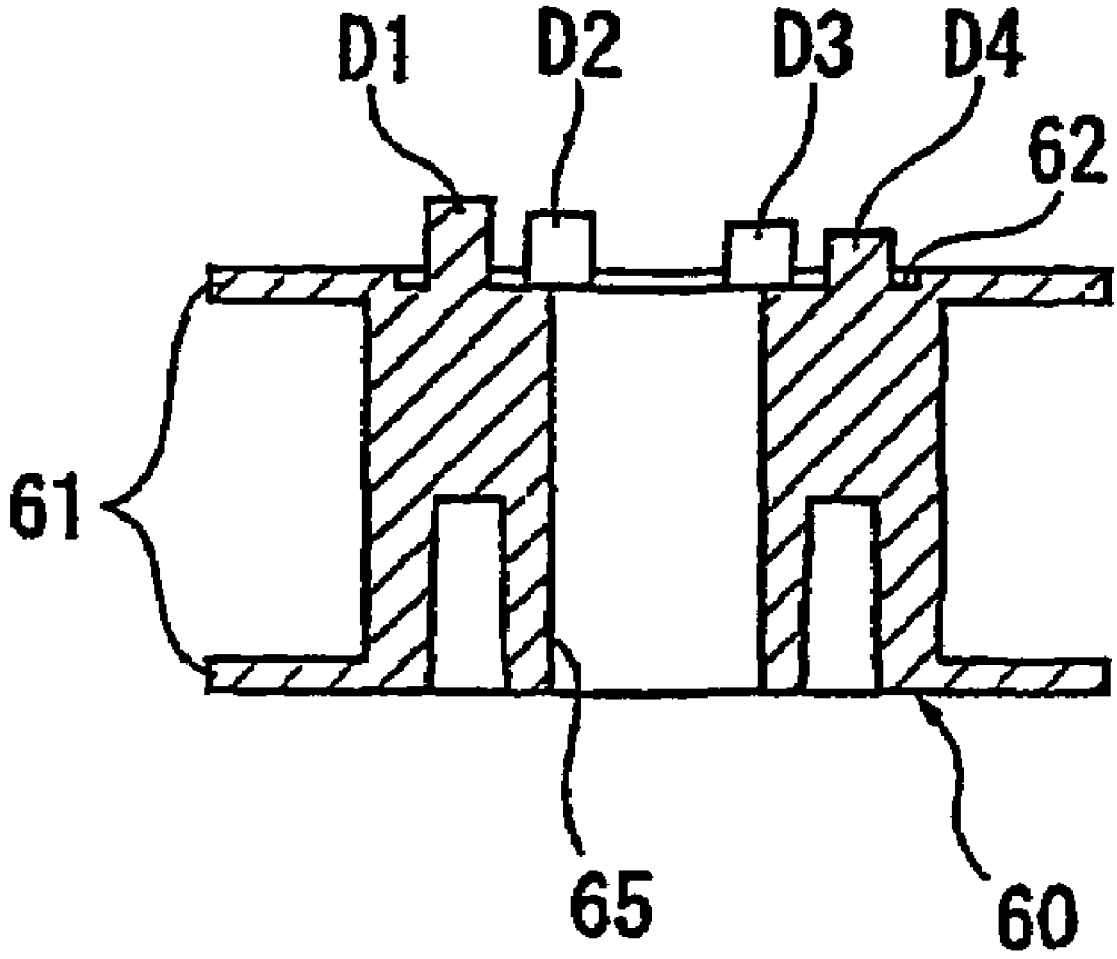
FIG. 10 is a central cross-sectional view of FIG. 9.

FIGS. 9 and 10 show a reel according to another embodiment, in which a step portion 62 is formed at the center of a flange 61 of a reel 60, with recesses 63 being formed in the flat portion of the step portion 62. There are formed six recesses 63 in total, and a bearing portion 64 is formed at the center of the six recesses 63. At the center of the bearing portion 64, there is formed a shaft hole 65. Around the bearing portion 64, there are formed ribs 66, by means of which the recesses 63 are divided from each other. Formed on the ribs 66 are protrusions D1 through D6 serving as the detection objects. The protrusions D1 through D6 differ alternately in protruding amount, making it possible for the reflection type interrupter 45 as an optical sensor to perform detection properly from the reflection light quantities of the six protrusions D1 through D6. It is also possible for all the protrusions D1 through D6 to exhibit different protruding amounts. It suffices to provide two or more different kinds of protruding amount, and the protruding amounts may be of various types.

As is known in the art, in the reflection type interrupter 45, the light emitting element and the light receiving element are normally installed on a base plate so as to be spaced apart from each other and directed in the same direction in order that the reflection light emitted from the light emitting element and reflected by the reflection member may be received by the light receiving element of the interrupter 45; it is to be noted that, when the distance between the interrupter 45 and the reflection member is too small, the reflection light from the reflection member does not reach the light receiving element to a sufficient degree; on the other hand, when the distance between the interrupter 45 and the reflection member is too large, the reflection light reflected by the reflection member does not reach the light receiving element to a sufficient degree, either. It is desirable for the distance between the interrupter 45 and the reflection member to be 1 mm to 6 mm, more preferably, 2 to 4.5 mm. In view of this, in this reel 60, the heights of the protrusions D1 through D6 constituting the reflection members are made different, so that if there is any play involved at the time of attachment to the reinforcement binding machine, it is possible for the light receiving element to receive the proper reflection quantity of light.

Figure 11:
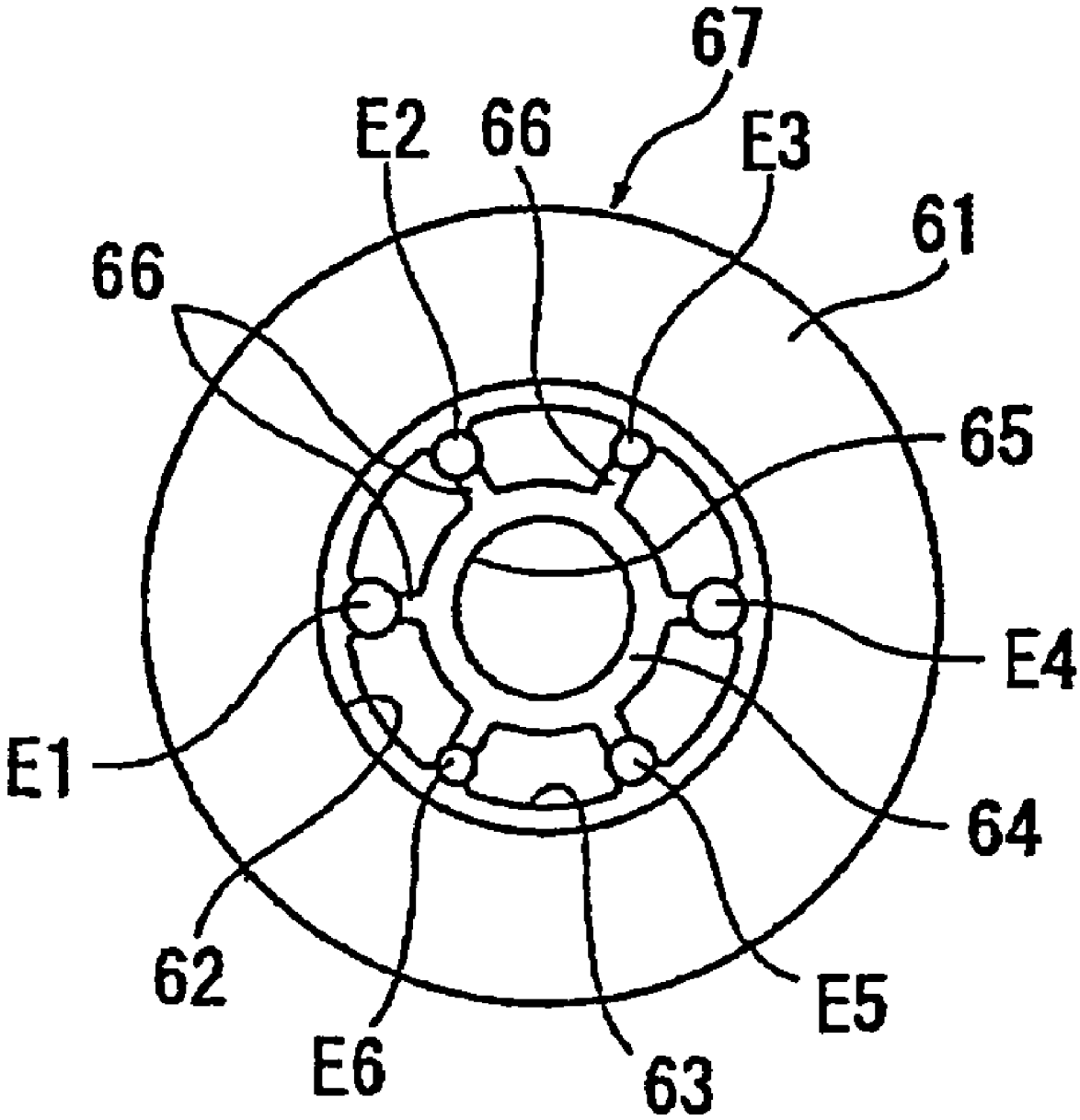
FIG. 11 is a side view of a reel according an embodiment of the present invention provided with a plurality of protrusions having different areas.
Figure 12:
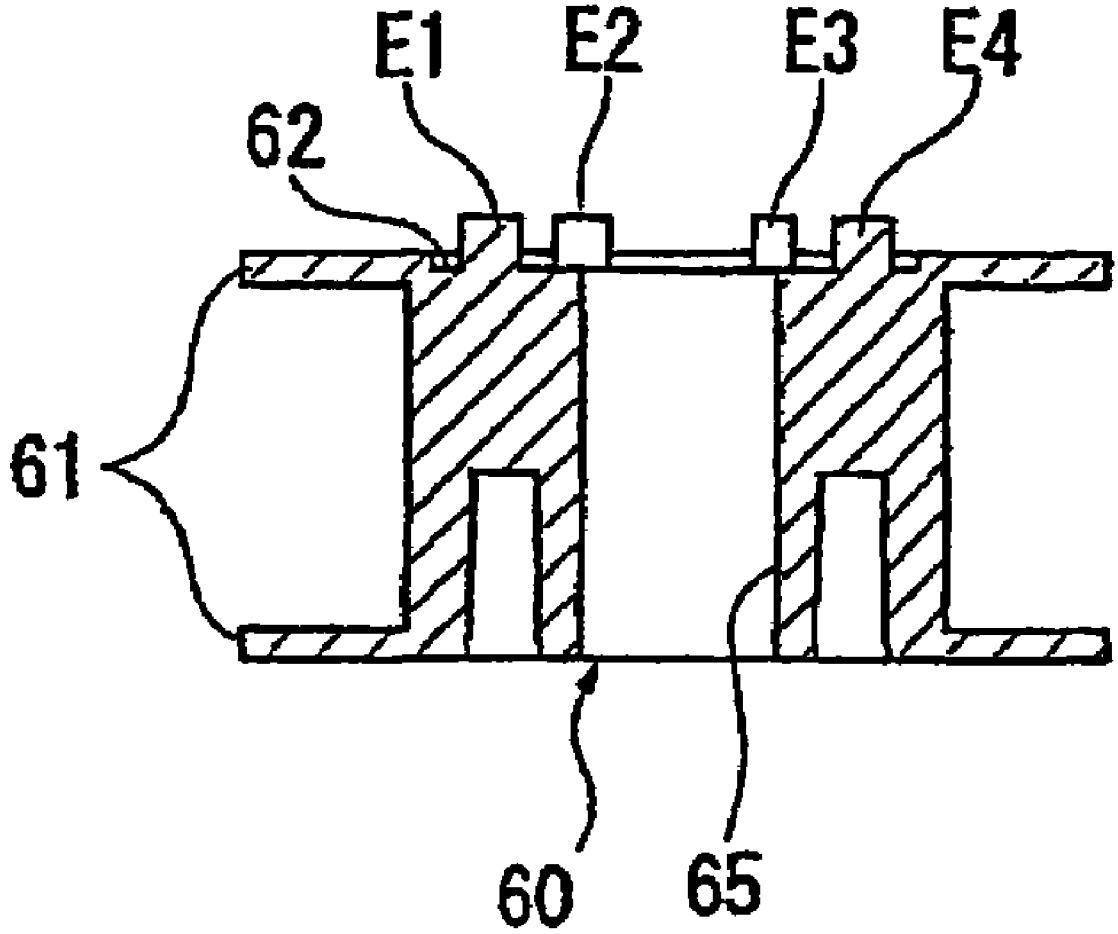
FIG. 12 is a central cross-sectional view of FIG. 11.

FIGS. 11 and 12 show a reel 67 according to still another embodiment. In the reel 67 of FIGS. 11 and 12, the apex portions of protrusions E1 through E6 constituting the reflection members for reflecting emitted light from the interrupter 45 differ from each other in respect of the area related to reflection light quantity. Of course, it is also possible to combine them with the protrusions D1 through D6 of the reel 60 shown in FIGS. 9 and 10, thus achieving differences not only in height but also in area. Otherwise, this reel is of the same construction as the reel 60 of FIGS. 9 and 10 and the description thereof is applicable here.

[Construction of the Reel without a Cassette Case]

Figure 13:
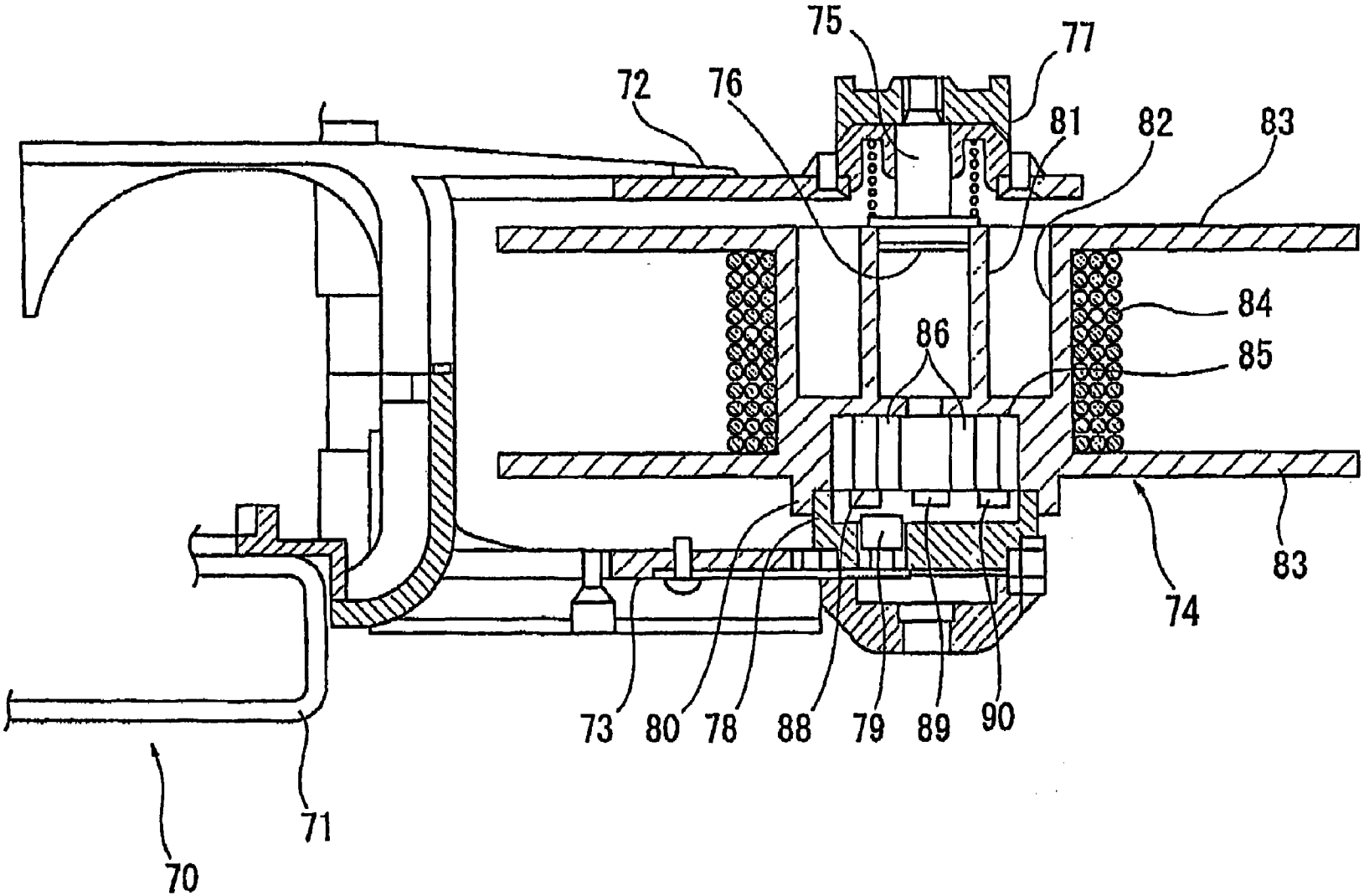
FIG. 13 is a side view of an embodiment of the present invention, showing a reel retaining mechanism for a reinforcement binding machine without any reel accommodating case and a reel provided with a plurality of protrusions differing in height.

FIGS. 13 and 7 show a reel retaining mechanism provided on a reinforcement binding machine 70 equipped with no case for accommodating the reel. In this reel retaining mechanism, a pair of arms 72 and 73 are formed on the casing 71 of the reinforcement binding machine so as to extend therefrom, and a support shaft 75 of a reel 74 is mounted to one arm 72. A fitting portion 76 is attached to the forward end of the support shaft 75 so as to be capable of displacement, and the fitting portion 76 is urged in the direction of the forward end of the axis of the support shaft 75 by a spring 77. Mounted to the forward end portion of the other arm 73 is a cylindrical member 78 having a bottom for retaining the reel 74. At the bottom of the cylindrical member 78, there is fixed a reflection type interrupter 79, which is an optical sensor. The cylindrical member 78 can be rotatably fitted into a cylindrical peripheral wall portion 80 of the reel 74. The fitting portion 76 is fitted into a small diameter cylindrical peripheral wall portion 81 of the reel 74.

At both ends of the cylindrical portion 82 of the reel 74, there are formed flange portions 83, and a wire 84 is wound around the cylindrical portion 82. The interior of the cylindrical portion 82 is shielded by a partition wall 85. Inside the cylindrical portion 82, there are formed ribs 86, to the upper portion of which there is fixed a shielding plate 87. Formed on the shielding plates 87 are a plurality of protrusions 88 through 90 serving as the detection objects. The protrusions 88 through 90 are all set to different heights, and the distances between the apex portions of the protrusions 88 through 90 and the interrupter 79 differ from each other. When the reel 74 is held by the pair of arms 72 and 73, light is interrupted in the space between the optical sensor 79 and the shielding plate 87, and when the reel 74 rotates, an appropriate quantity of light of the reflection light from the protrusions 88 through 90 is received by the interrupter 79.

[Other Examples of the Detecting Means and the Detection Object]

While in the above example reflection light quantity is used as the physical quantity to be detected by the interrupter 45, when "the light quantity" as the physical quantity of the detection object is to be varied, it would be possible, for example, to incline the apex portions of the protrusions D1 through D6 or E1 through E6, form them in a convex or concave mirror configuration, or form a large number of recesses and protrusions at the apex portions of the protrusions. Further, it would also be possible to attach, as the detection objects, stickers with metallic luster or printed stickers or labels to the apex portions of the protrusions of the reel 60, 67, the flange portions, or other side surface portions.

Further, while in the above example reflection light quantity is used as the physical quantity to be detected by the interrupter 45, when the reflection light is to be changed as the physical quantity of the detection object, it is also possible to provide a specific pattern, such as stripes, to detect specific pulses, so that the output waveform of the interrupter is that of specific pulses.

Further, the possible examples of the physical quantity of the detection object include induction current, induction voltage, and magnetism. For example, it is possible to provide, as the detection object, a coil, a magnet, or a Hall element at the protrusion, flange portion, etc. of the reel, or to attach a sticker equipped with a coil, a magnet, a magnetic tape, etc. thereto to thereby generate an electromagnetic signal such that the output waveform of the reinforcement binding machine side sensor is that of specific pulses, whereby it is possible to detect rotation of the reel and the residual amount of wire by counting the RPM of the reel.

A reinforcement binding machine according to another embodiment of the present invention and a reel to be used therein will be described with reference to the drawings.

Figure 14:
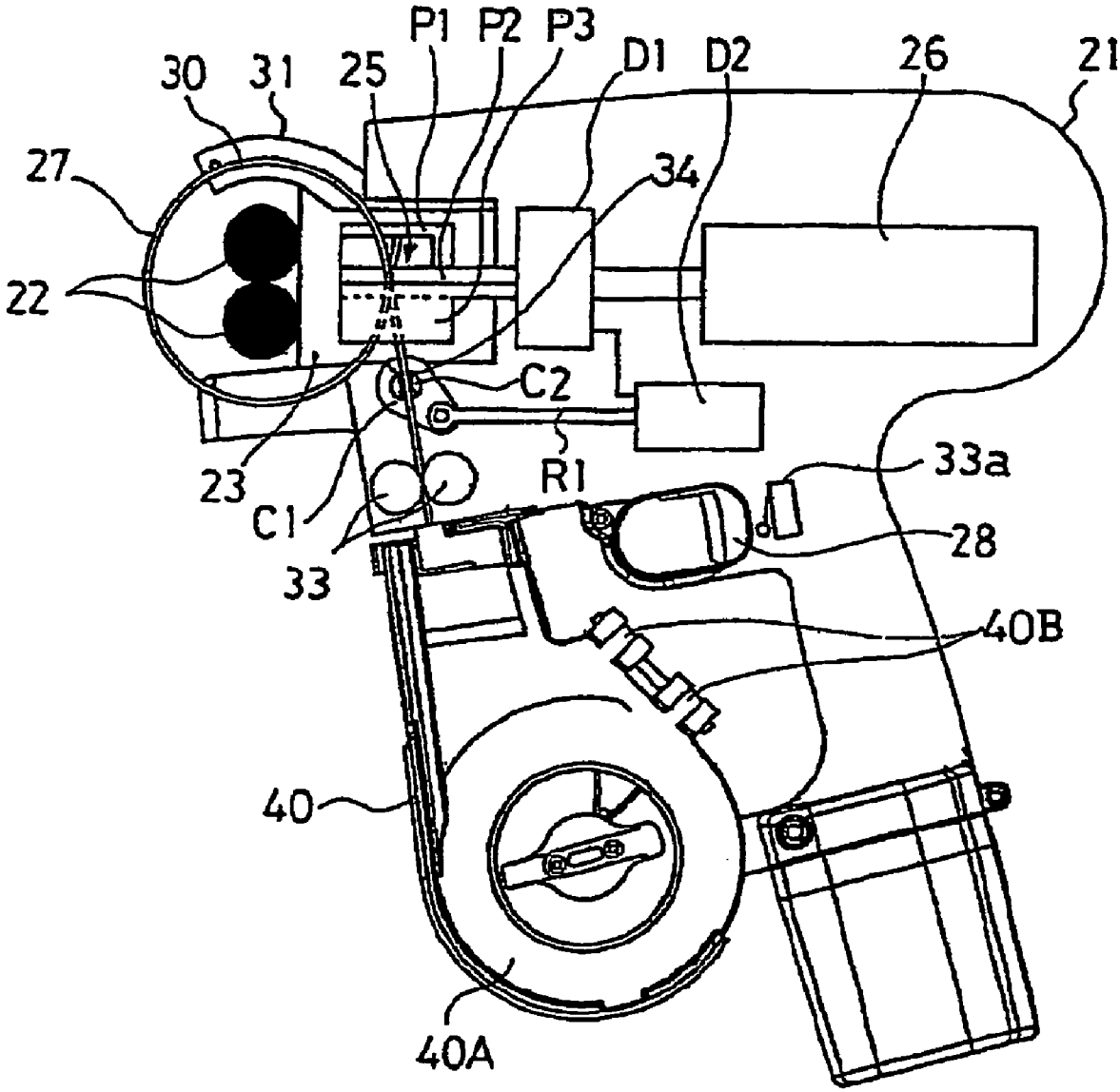
FIG. 14 is a side view of a reinforcement binding machine according to an embodiment of the present invention.
Figure 15:
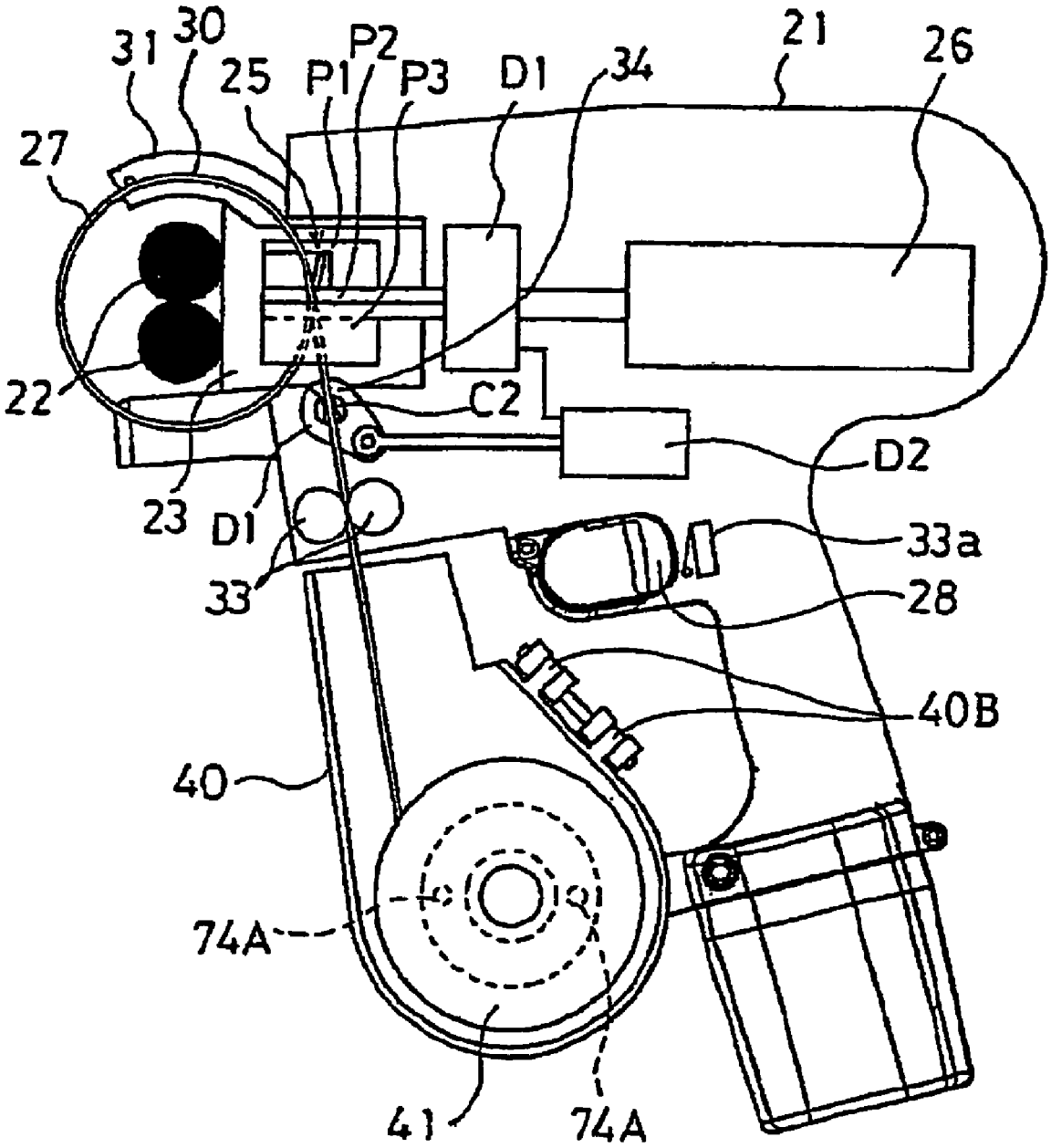
FIG. 15 is a side view of the reinforcement binding machine of FIG. 14 with the cover of the cassette case open.

FIGS. 14 and 15 schematically show the construction of a reinforcement binding machine according to this embodiment. FIG. 14 shows a state in which the cover 40A of the cassette case 40 is closed, and FIGS. 14 and 15 show a state in which the cover 40A of the cassette case 40 is open.

[Construction of the Reinforcement Binding Machine]

As shown in FIGS. 14 and 15, in the reinforcement binding machine 20, there are formed in the lower portion of the forward end portion of the binding machine main body 21 directed to the reinforcing bars 22 a pair of abutment plate portions 23 abutting the reinforcing bars 22 and there is arranged a twisting hook portion (wire grasping portion) 25 between the pair of abutment plate portions 23.

The twisting hook portion 25 is equipped with a plurality of plates P1, P2, and P3 between which the wire 27 can be passed. The plates P1, P2, and P3 are directed in the vertical direction (when on standby) so as to allow insertion of the wire 27 between them, and are arranged parallel to each other, with the plates P1 and P3 being capable of moving toward and away from the central plate P2. The wire 27 is passed between the plates P2 and P3, and after surrounding the periphery of the reinforcing bars 22, is passed between the plates P1 and P2. The twisting hook 25 is equipped with a transmission mechanism D1, which, by rotating the motor 26, first grasps the forward end portion of the wire 27 between the plates P1 and P2, and then grasps the rear end portion of the wire 27 between the plates P2 and P3, and after cutting the rear end portion of the wire 27 by a cutting mechanism 34, makes the twisting hook portion 25 rotatable.

In the binding machine main body 21, the wire passage 30, through which the wire 27 is passed, is provided in the guide portion 31 in which the wire passage 30 is formed as an arcuate groove open on the inner side.

The reinforcement binding operation will be described. When a micro switch 33*a* is turned on by a trigger 28, a wire feeding motor (not shown) is rotated to rotate a wire feeding gear 33. By the rotation of the wire feeding gear 33, the wire 27, wound around the wire reel 41 accommodated in the cassette case 40, is fed by a predetermined amount to the twisting hook 25 through the wire passage 30 in the guide portion 31. When one end of the wire 27 reaches the wire grasping portion 25, the wire 27 abuts the upper end portion of the plate P1 of the twisting hook portion 25 and is thereby stopped, and, at the same time, the forward end portion of the wire 27 is grasped between the plates P1 and P2 of the twisting hook portion 25.

Thereafter, the motor for driving the wire feeding gear 33 is reversely rotated to bring the wire 27 into close contact with the reinforcing bars 22, and then the wire 27 is cut by the cutting device 34. In this process, the rear end portion of the wire 27 is also grasped between the plates P2 and P3 of the wire grasping portion 25, with both end portions of the wire 27 being grasped between the plates P1, P2, and P3 of the wire grasping portion 25.

After the wire 27 is wound around the reinforcing bars 22, the motor 26 is rotated; when the wire grasping portion 25 is rotated by the rotation of the motor 26, the wire 27 is twisted to thereby complete the binding of the reinforcing bars 22. The completion of the binding results in the detection of an increase in the drive torque, and the motor 26 is stopped. The cover 40A of the cassette case 40 can be opened and closed through the intermediation of a hinge 40B.

Symbol R1 indicates a rod for rotating a movable cutter C1 of the cutting device 34, and the rod R1 is caused to move forwards and backwards with a predetermined timing by a transmission mechanism D2 driven by drive force received from a transmission mechanism D1, the movable cutter C1 rotating around a stationary cutter C2 to thereby cut the wire 27.

Figure 16:
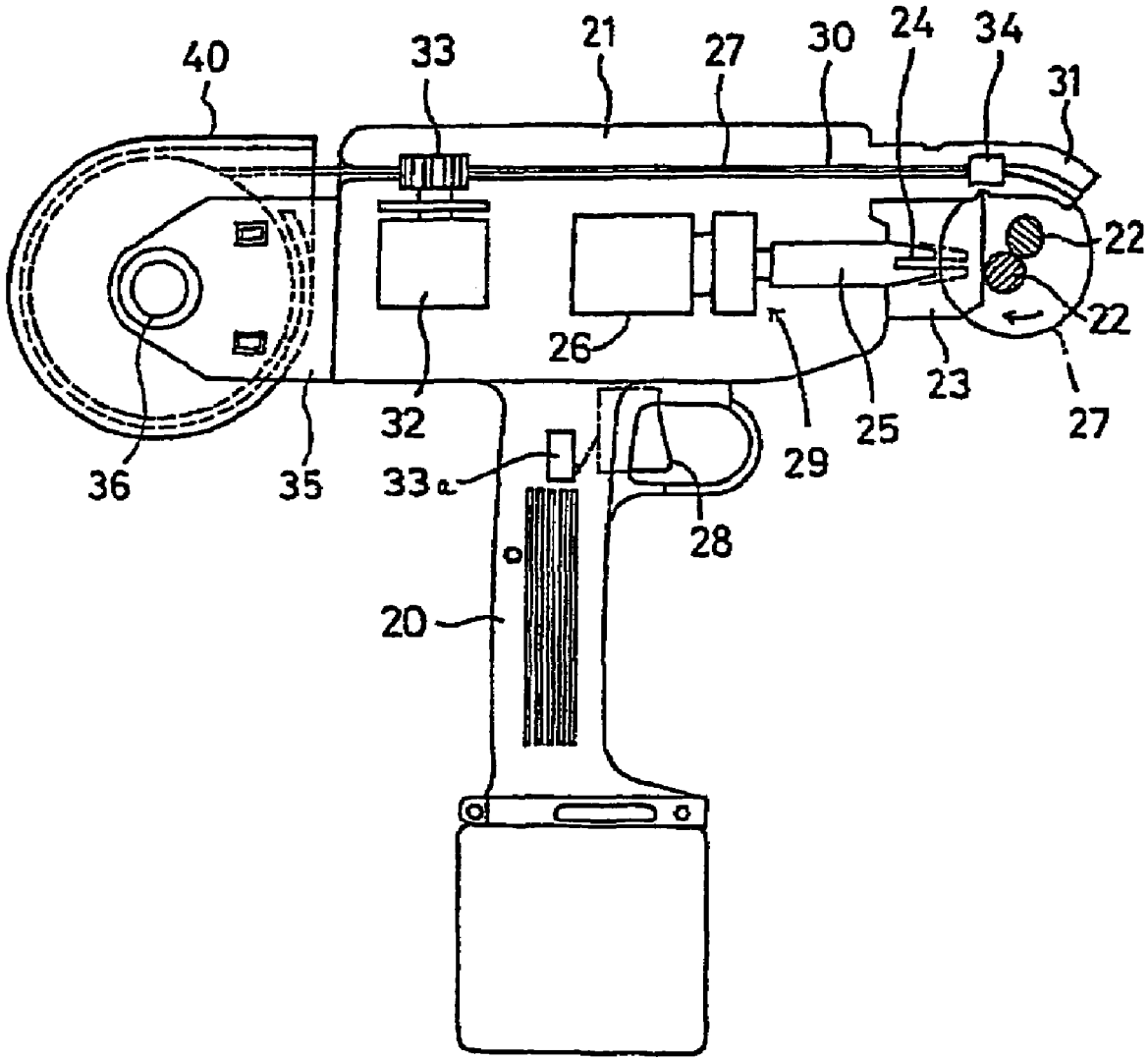
FIG. 16 is a side view of a reinforcement binding machine according to an another embodiment of the present invention.

FIG. 16 shows another embodiment, in which the wire 27 is wound a plurality of times, and cut by the cutting device 34; thereafter, the twisting hook portion 25 is caused to advance by an advancing/retreating mechanism 29 as the motor 26 rotates, and after grasping the wire 27, effects twisting.

In the rear end portion of the binding machine main body 21, there is formed a reel mounting bearing portion 35. A mounting shaft 36 is provided in the bearing portion 35 so as to protrude, and is mounted to the cassette case 40. The mounting shaft 36 may also be detachably mounted to the cassette case 40. Inside the cassette case 40, there is mounted the reel 41 (see FIGS. 1 and 2). Formed in the cassette case 40 is an opening (not shown) for drawing out the wire 27. The opening of the cassette case 40 is open so as to face the wire passage 30.

FIGS. 1 through 5 show an embodiment of the cassette case 40 and the reel 41 of the reinforcement binding machine. This cassette case 40 constitutes a part of the reinforcement binding machine 20. Instead of being detachable, the cassette case may also be of a stationary type.

[Cassette Case]

The cassette case 40 is formed of a plastic superior in resistance to wear and bending, such as polypropylene. Protruding from the bottom 42 of the cassette case 40 is a reel mounting shaft 43 into which the mounting shaft 36 of the bearing portion 35 is inserted for fixation.

The upper side of the cassette case 40 is open in order to allow insertion of the reel 41, and this opening is closed with a cover member 42A. The forward end portion of the reel mounting shaft 43 can be fitted into a cylindrical protrusion P at the center of the cover member 42A.

At the bottom 42B of the cassette case 40, a sensor arrangement hole 44 is open, and, inside the sensor arrangement hole 44, there is installed the reflection type interrupter 45 as the light receiving means. Symbol 45A indicates a terminal plate to which the interrupter 45 is mounted; the terminal plate 45A has a ring-like opening larger than the reel mounting shaft 43 so that the mounting shaft 36 may be inserted into the reel mounting shaft 43. One end portion of the terminal plate 45A is fixed to the bottom 42B of the cassette case 40 by means of a screw 45B. Connected to the terminal plate 45A is a cable 45C connected to the above-described control circuit, making it possible to supply power to the interrupter 45 and transmit the output signal of the interrupter 45 to the control circuit.

The control circuit detects the rotation of the reel 41 by the output signal from the interrupter 45. That is, when, although power for effecting rotation is being supplied to the motor 32, a change in the output voltage from the interrupter 45 is not detected within a predetermined period of time, the control circuit judges that the reel 41 is not rotating, and informs the operator of the termination of the wire 27 on the reel 41 by, for example, effecting light emission from an LED or the like provided on a side surface of the reinforcement binding machine 1.

[Cover]

An opaque cover 46 covering the interrupter 45 from above is rotatably mounted to the base portion of the reel mounting shaft 43. In order that it may be greatly different from the reel 41 in terms of luminosity, the cover 46 is formed of a black plastic. As shown in FIG. 6, a pair of openings 47 are formed at the portions of the cover 46 passing over the interrupter 45. The cover 46 has at its center an opening 48 through which the reel mounting shaft 43 is to be passed. The cover 46 is restricted in vertical movement by a retaining ring 49 mounted to the reel mounting shaft 43 (see FIG. 1).

[Reel]

FIGS. 2 through 5 show the configuration of the reel 41. The reel 41 is formed of a plastic superior in resistance to wear and bending, such as polypropylene, and is formed of a white plastic in order that the quantity of reflection light received may be large. The wire 27 is wound around the reel 41, and the wire 27 can move to the front or the rear side of the binding machine main body 21 as the gear 33 rotates. The reel 41 is capable of normal and reverse rotation according as the wire 27 is to be fed out or rewound.

The reel 41 has a hub 41A, around which the wire 27 is wound and into which the reel mounting shaft 43 is inserted, and a pair of flanges 50 for regulating horizontal positional deviation of the wire 27.

The hub 41A has an inner cylindrical portion 51A into which the reel mounting shaft 43 is inserted and an outer cylindrical portion 51B around which the wire 27 is wound. The inner cylindrical portion 51A and the outer cylindrical portion 51B are connected by intermediate plate portions 51C and ribs 51D, and protrusions 53 are formed on the ribs 51D as the detection objects. As shown in FIGS. 3 and 4, at the end portion of the inner cylindrical portion 51 facing the cover member 42B, there is formed a fitting recess 51E, and the cover member 42B is fitted into the fitting recess 51E. The reel mounting shaft 43 is inserted into the hub hole 51 inside the inner cylindrical portion 51A.

The flanges 50 are subjected to as much lightening as possible to thereby achieve a reduction in cost and weight. As shown in FIG. 5, formed in one flange 50 is a mounting groove 52 for fixing the winding start end portion of the wire 27.

As shown in FIGS. 1 and 2, a recess 53A is formed in the surface of the reel 41 facing the bottom 42 of the cassette case 40, and the retaining ring 49 of the reel mounting shaft 43 is situated in the recess 53A. At the bottom of the recess 53A, a pair of protrusions 53 are formed. The pair of protrusions 53 are formed in a cylindrical configuration so as to be fitted into the openings 47 of the cover 46 without involving any play. Between the recess 53A and the flange 50, there is formed a ring-like thick-walled portion 53B held in contact with the cover 46 to prevent intrusion of light into the recess 53A.

Further, at the bottom 42B of the cassette case 40, there is formed a thick-walled portion 42C for supporting the bottom side flange 50 of the reel 41, and a recess is formed between the reel mounting shaft 43 and the thick-walled portion 42C. The recess 42D forms a gap between the interrupter 45 and the protrusions 53; through rotation of the thick-walled portion 42C and the cover 46 while in slide contact with each other, shielding is effected to prevent intrusion of disturbance light into the interrupter 45.

[Detection of the Rotation of the Reel]

The pair of protrusions 53 pass over the interrupter 45 when the reel 41 rotates. Since the cover 46 is black and the pair of protrusions 53 are white, the reflection quantity of light emitted from the interrupter 45 is larger than the reflection quantity of light from the cover 46. The interrupter 45 receives the reflection light and outputs it to the control circuit, which detects the rotation of the reel 41 from a change in the output voltage from the interrupter 45.

When, in the state in which the wire 27 is wound around the reel 41, rotation power is applied to the motor 32, the reel 41 rotates due to the drawing-out of the wire 27, so that the pair of protrusions 53 pass over the interrupter 45 periodically, whereby the interrupter 45 detects the reflection light of the black cover 46 and the reflection light of the white protrusions 53.

Further, since the reflection light quantity from the white protrusions 53 is larger than the reflection light quantity from the black cover 46, the output voltage of the interrupter 45 varies periodically. When this periodical variation can be detected at a fixed interval during the period of time in which the motor 32 is rotating, it means that the reel 41 is rotating.

If, although the motor 32 is rotating, there is no change in the output voltage from the interrupter 45 within a fixed period of time, it means that the reel 41 is not rotating.

Thus, the control circuit can judge the rotation of the reel 41 based on the rotation of the motor 32 and the change in the output voltage of the interrupter 45.

Instead of making the reel 41 white, it is also possible to make the surfaces of the apexes 53T of the protrusions 53 white or to attach seals or the like thereto. Further, it is also possible to make the cover 46 white and the reel 41 black.

While in the above embodiment the detection objects are formed by the protrusions 53, and the color luminosity of the protrusions 53 is made different so as to make the reflection light quantity therefrom different from that from the cover, it is also possible to provide the detection objects by forming on the surfaces of the protrusions 53 a plurality of small protrusions and recesses consisting of cones or semi-spheres or step-portions, grooves or the like or to perform surface roughening treatment thereon.

Alternatively, as shown in FIG. 3(2), as another example of the detection object, a through-hole 53H may be formed at a position on the bottom side of the reel 41; instead of the through-hole 53H, it is also possible to form a plurality of small protrusions and small recesses consisting of cones, semi-spheres, etc. or step portions, grooves, etc. or to perform surface roughening treatment.

[Another Construction of the Cassette Case]

Figure 17:
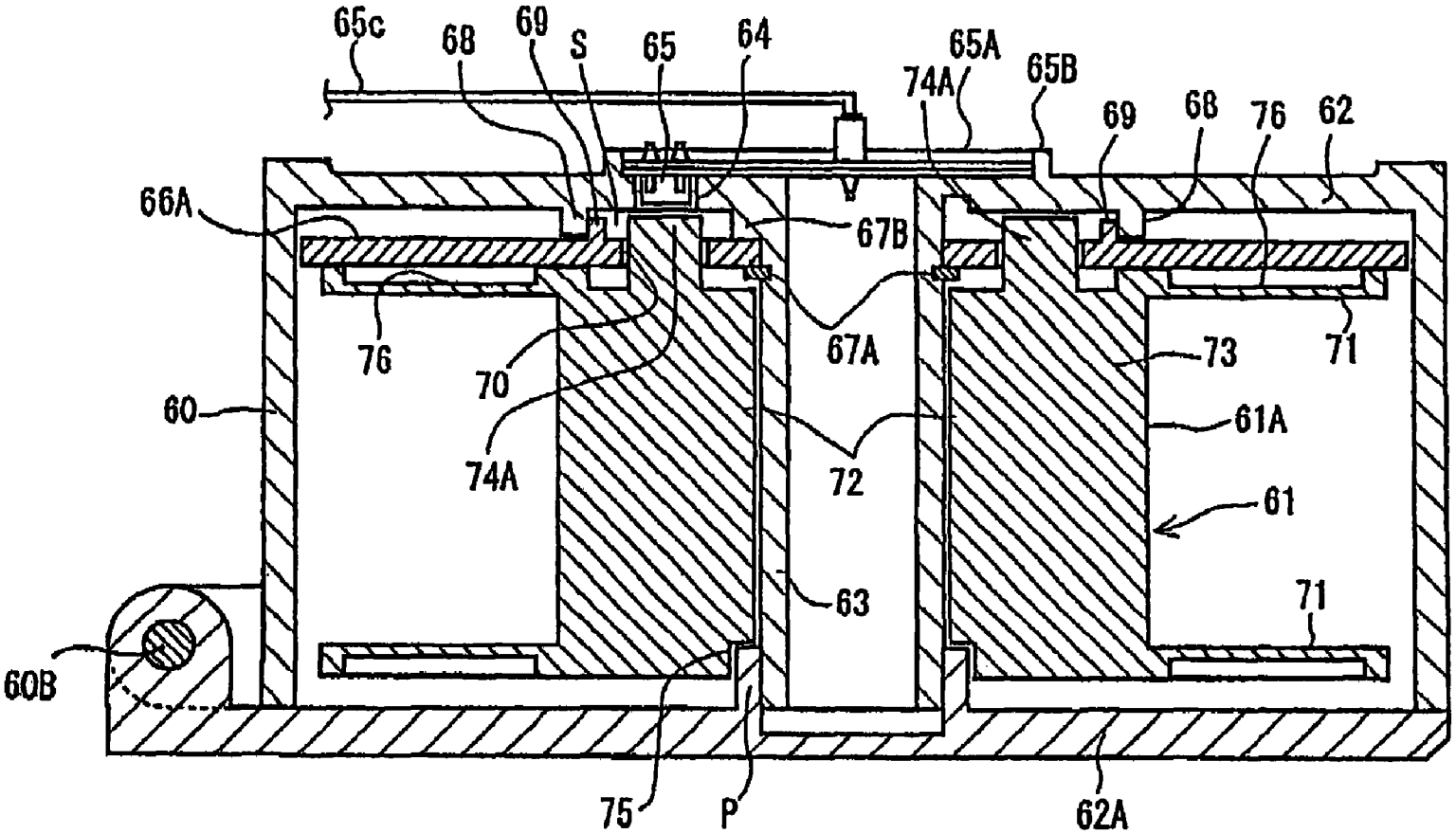
FIG. 17 is a sectional view of the cassette case of a reinforcement binding machine according to a third embodiment of the present invention.
Figure 18:
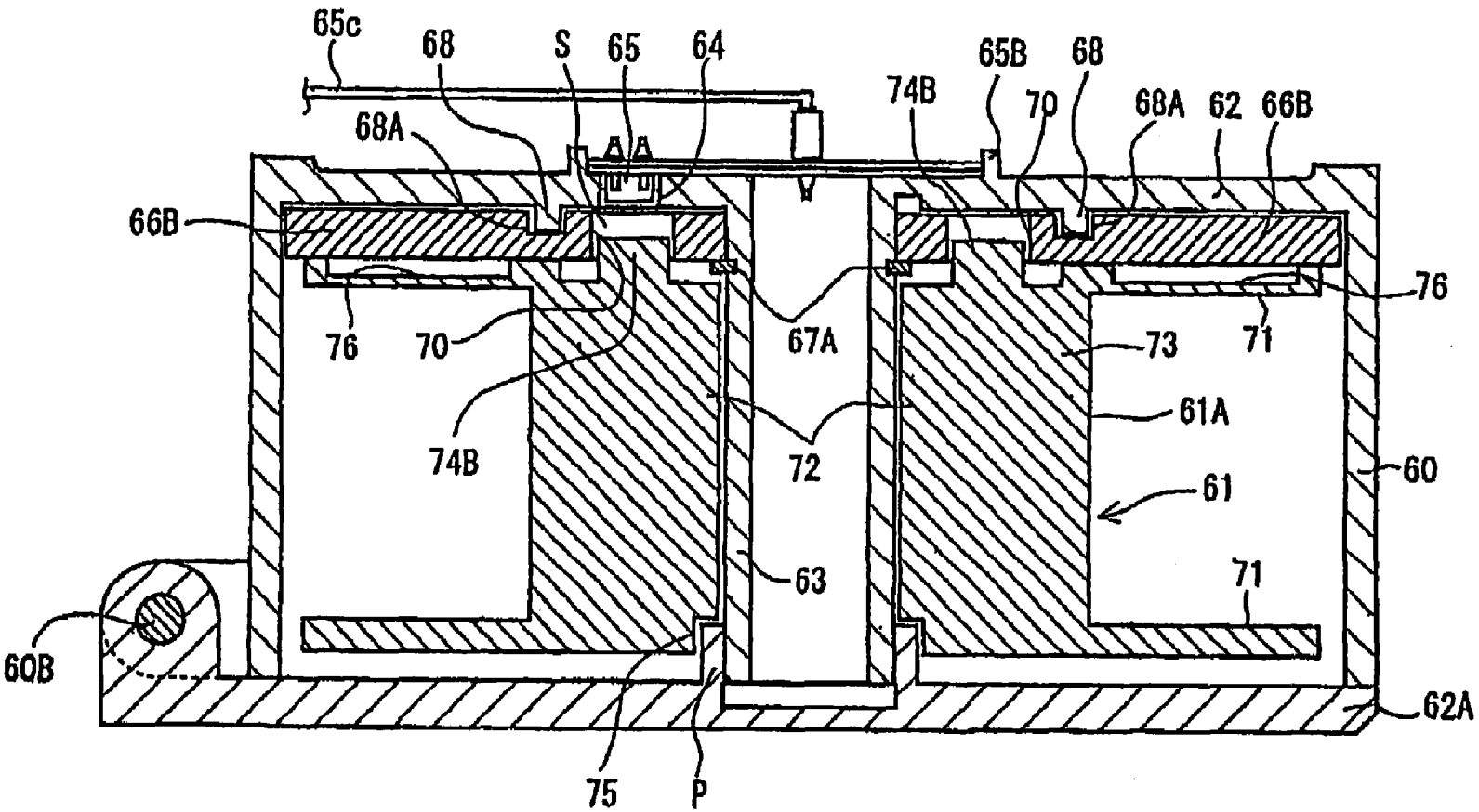
FIG. 18 is a sectional view of a cassette case of a reinforcement binding machine according to a fourth embodiment of the present invention with a reel attached thereto.

FIGS. 17 and 18 show the construction of a cassette case 60 and a reel 61 of a reinforcement binding machine according to another embodiment of the present invention. This cassette case 60 constitutes a part of the reinforcement binding machine 20.

[Cassette Case]

The cassette case 60 is a cylindrical one formed of a plastic superior in resistance to wear and bending, such as polypropylene; protruding from the bottom 62 of the cassette case 60 is a reel mounting shaft 63 into which the mounting shaft 36 of the bearing portion 36 is inserted for fixation.

One end of the cassette case 40 is open so as to allow insertion of the reel 61, and this opening is closed by a cover member 62A. The forward end portion of the reel mounting shaft 63 can be fitted into a cylindrical protrusion P at the center of the cover member 62A.

A sensor arrangement hole 64 is open in the bottom 62 of the cassette case 60, and inside the sensor arrangement hole 64, a reflection type interrupter 65 is installed as the light receiving means. Symbol 65A indicates a terminal plate to which the interrupter 65 is mounted; the terminal plate 65A has a ring-like opening larger than the reel mounting shaft 63 so that the mounting shaft 36 may be inserted into the reel mounting shaft 63. Positioning is effected on the terminal plate 65A by an annular protrusion 62B, and the terminal plate 65A is fixed to the bottom 62 of the cassette case 60 by means of screws (not shown). Connected to the terminal plate 65A is a cable 65C connected to the above-described control circuit, making it possible to effect power supply to the interrupter 65 and transmission of the output signal of the interrupter 65 to the control circuit.

The control circuit detects the rotation of the reel 61 from the output signal from the interrupter 65. That is, if, although rotating power is being supplied to the motor 32, a change in the output voltage from the interrupter 65 is not detected within a fixed period of time, the control circuit judges that the reel 61 is not rotating, and informs the operator of the termination of the wire 27 on the reel 61 by light emission from an LED or the like provided on a side surface of the reinforcement binding machine 1, through an alarm sound, etc.

[Cover]

Rotatably mounted to the base portion of the reel mounting shaft 63 is an opaque cover 66A covering the interrupter 45 from above. Mounted to the outer periphery of the base portion of the reel mounting shaft 63 are a ring 67A and a step portion 67B for regulating the height of the cover 66A. On the inner side of the bottom 62 of the case 60, there is formed an annular protrusion 68, and an annular protrusion 69 is formed on the bottom 62 side surface of the cover 66A. The protrusions 68 and 69 are in contact with each other so as to be capable of rotating while in slide contact with each other, thus preventing intrusion of disturbance light into the space S in which the interrupter 65 is arranged. Like the reel 61, the cover 66A is formed of a black plastic. As shown in FIGS. 17 and 18, at the portions of the cover 66A passing over the interrupter 65, there are formed a pair of circular openings 70 substantially of the same diameter as the interrupter 65.

[Reel]

The reel 61 is formed of a plastic superior in resistance to wear and bending, such as polypropylene, and the plastic is one black in color so that intrusion of disturbance light into the space S may be prevented as much as possible. The wire 27 is wound around the reel 61; as the gear 33 rotates, the wire 27 can move to the front or the rear portion of the winding machine main body 21. The reel 61 is capable of normal and reverse rotations as the wire 27 is to be fed out or rewound.

The reel 61 has a hub 61A around which the wire 27 is wound and into which the reel mounting shaft 43 is inserted, and a pair of flanges 71 for regulating horizontal positional deviation of the wire 27. As in the case of the reel 50 of FIGS. 2 and 3, the hub 61A is equipped with an inner cylindrical portion 72 into which the reel mounting shaft 43 is inserted and an outer cylindrical portion 61A around which the wire 27 is wound. The inner cylindrical portion 72 and the outer cylindrical portion 61A are connected by a rib 73, on which a cylindrical protrusion 74A is formed as a detection object. At the end of the inner cylindrical portion 72 facing the protrusion P, there is formed a fitting recess 75, into which the cover member 62B is fitted. The reel mounting shaft 63 is inserted into the inner cylindrical portion 72.

The flanges 71 are subjected to as much lightening as possible, thereby achieving a reduction in cost and weight. Formed in one flange 71 is a mounting groove (not shown) for fixing the winding start end portion of the wire 27.

Formed in the surface of the reel 61 facing the bottom 62 of the cassette case 60 is a recess 76 to thereby reduce the rotational resistance of the flanges 71. The inner edge portion and the outer edge portion of the recess 76 are in contact with the cover 66A so as to prevent, as much as possible, disturbance light from entering the space S through the gap of the opening 70. A part of the flanges 71 is in slide contact with the cover 66A so as to prevent intrusion of disturbance light into the space S; in order to reliably prevent formation of a gap during rotation of the reel 61, the protrusion 74A for reflecting light from the interrupter 65 is formed as a cylinder to be fitted into the opening 70.

In the example shown in FIG. 17, the protrusion 74A is formed so as to be close to the interrupter 65, while in the example shown in FIG. 18, it is formed so as to be spaced apart from the interrupter 65. The protrusion 74A of FIG. 17 is close to the interrupter 65, and the cover 66A is spaced apart from the interrupter 65, whereby the reception quantity of light reflected by the protrusion 74A is less than the reception quantity of light reflected from the portion of the cover 66A in the periphery of the protrusion 74A.

That is, in this embodiment, the cover 66A (cover member) covering the light receiving element of the interrupter 65 is detachable with respect to the flange 71 constituting a reel side surface, and the protrusion 74A constituting the detection object reflecting reflection light to the light receiving element (light receiving means) of the interrupter 65 is formed on the flange 71. The cover 66A has the opening 70 through which the protrusion 74A faces the interrupter 65. It is not always necessary for the cover 66A to be detachable.

Regarding the reception light quantity to be received by the light receiving element of the interrupter 65 after the reflection by the protrusion 74A of the emission light from the light emitting element of the interrupter 65 during rotation of the reel 61, one of the protrusion 74A (the detection object) and the cover 66A (cover member) is at a position making the light detection by the light receiving element effective, and the other of the protrusion 74A and the cover 66A is at a position making the light detection by the light receiving element ineffective or making the light reception quantity small.

In order that one of the protrusion 74A and the cover 66A may make the light detection by the light receiving element effective and that the other of the two may make the light detection ineffective or make the light reception quantity small to a degree such that the light detection by the light receiving element is impossible, the distance from the protrusion 74A (the detection object) to the light receiving element is made different from the distance from the cover 66A to the light receiving element.

Figure 19:
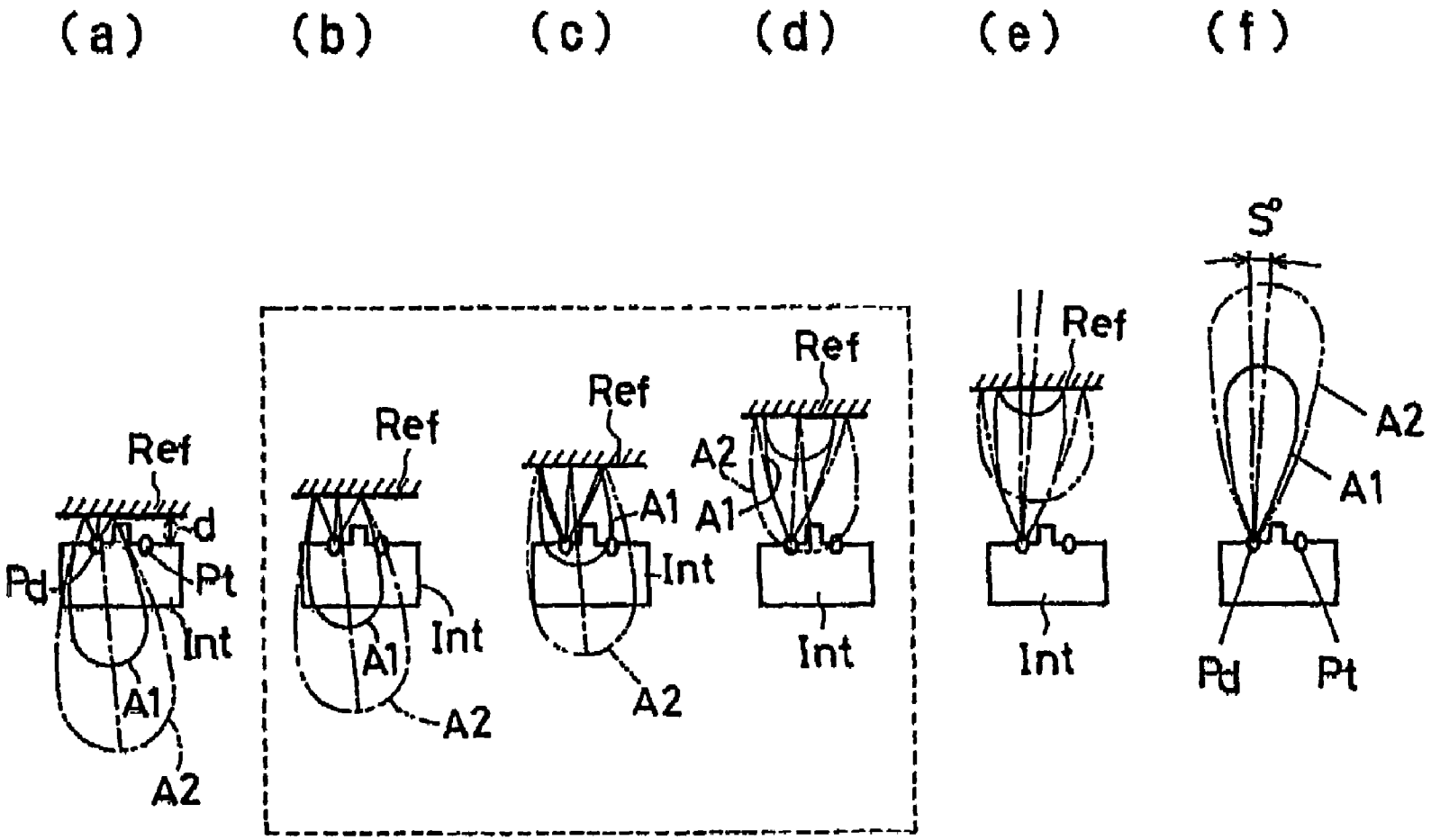
FIGS. 19(*a*) through 19(*f*) are explanatory views showing how light receiving amount fluctuates depending on the distance between a reflection type interrupter and a reflection material.

The general operation of a reflection type interrupter will be described with reference to FIGS. 19(*a*) through 19(*f*) and FIGS. 20(*a*) and 20(*b*). FIGS. 19(*a*) through 19(*f* show variation in the reception light quantity of reflection light reaching the light receiving element (photo transistor) Pt depending upon the distance d between a reflection type interrupter Int and a reflection material (aluminum) Ref. As shown in FIGS. 19(*a*) through 19(*f*, the reception quantity of light received by the light receiving element Pt of the interrupter Int fluctuates depending upon the direction of the optical axis of the light emitted from the light emitting element (photo diode) Pd of the interrupter Int, the direction of the reflection material, and the distance d between the interrupter Int and the reflection material Ref. Referring to FIG. 19(*f*), assuming that the light emission relative intensity in the area A1, in which the light emission intensity of the light emitted from the light emitting element Pd is not lower than a predetermined value, is 100%, the light emission relative intensity in the area A2, spread forwards along the optical axis, is 75% as opposed to the above-mentioned light emission relative intensity of 100%. In the drawing, symbol A1 indicates a curve corresponding to the light emission relative intensity of 100%, symbol A2 indicates a curve corresponding to the light emission relative intensity of 75%, and symbol $S^0$ indicates a deviation of the optical axis.

As shown in FIG. 19(*a*), when the distance between the interrupter Int and the reflection material Ref is short, the light reception quantity of the reflection light at the light receiving element Pt of the interrupter Int is reduced to an extreme degree such that, regarding the output of the interrupter Int, as shown in FIG. 19(*a*), the light receiving element is not situated inside the area A2, where the light emission relative intensity is 75%, resulting in an extremely small light reception quantity.

As shown in FIGS. 19(*b*) through 19(*d*), the light receiving element Pt is turned on in an area where the light emission relative intensity is 75%; when the light receiving element Pt of the interrupter Int is included in the area A2, where the light emission relative intensity is 75%, the light receiving element Pt of the interrupter Int is turned on.

When, as shown in FIG. 19(*e*), the reflection material Ref is spaced too much apart from the interrupter Int, the light receiving element Pt is situated outside the area A2, where the light emission relative intensity is 75%, so that there is a shortage in the light reception quantity, and the interrupter Int is not turned on.

Figure 20:
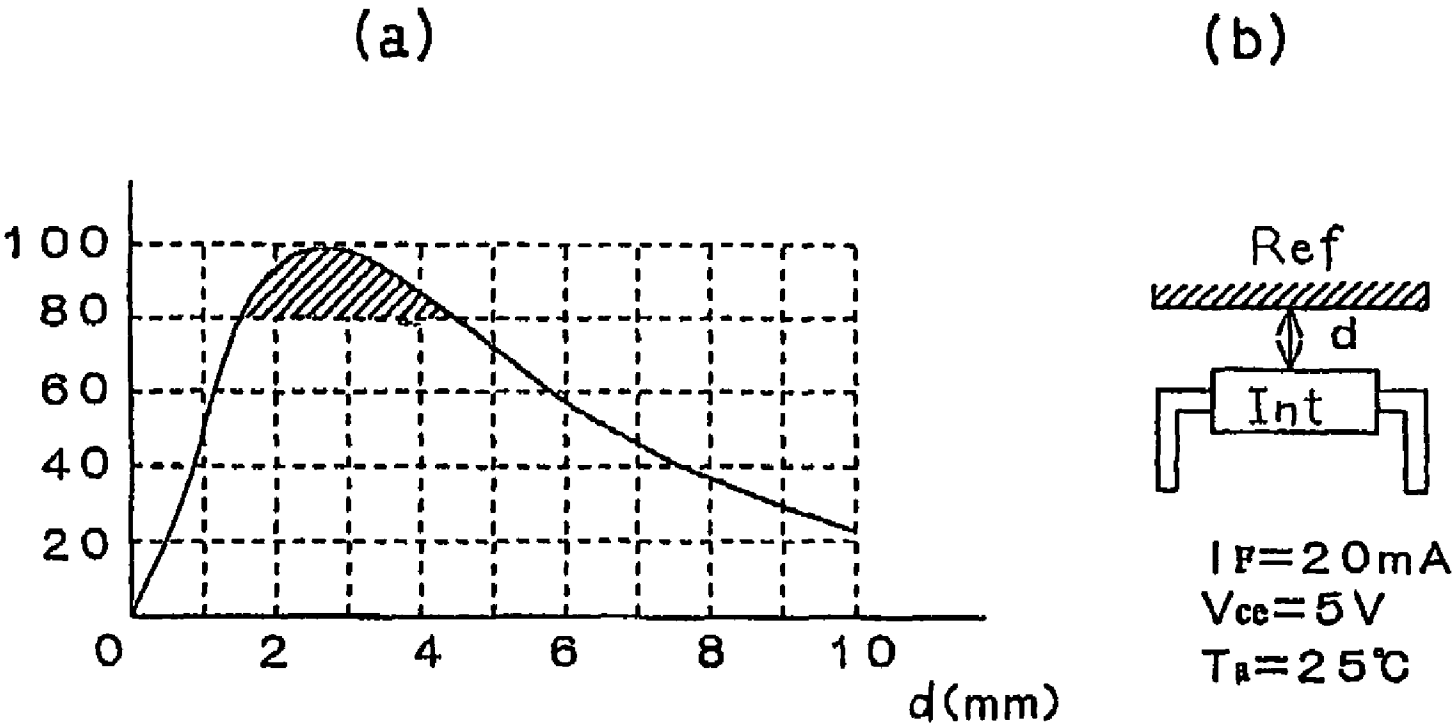
FIG. 20(*a*) is a graph showing the relationship between the distance between an interrupter and a reflection material and output current, and FIG. 20(*b*) is an explanatory view showing how an interrupter and a reflection material are arranged.

FIGS. 20(*a*) and 20(*b*) are diagrams showing the relationship between the distance d from the light receiving element Pt of the reflection type interrupter to the reflection material Ref and the relative ratio of the output current output when the light receiving element Pt receives light. As shown in the graph, when the distance d from the interrupter Int to the reflection material Ref is in the range of 1.5 mm to 4.5 mm, the collector current generated by the light receiving element Pt is not less than 80% of the collector current corresponding to the maximum light reception quantity. FIG. 20(*a*) is a graph showing how the distance and the relative collector current are related, wherein the vertical axis indicates the collector current, and the horizontal axis indicates the distanced (mm). FIG. 20(*b*) shows a condition in which $I_F$=20 mA, Vce=5V, and Ta=25° C.

This will be described with regard to this embodiment. When the protrusion 74A is situated below the interrupter 65, the distance between the protrusion 74A and the interrupter 65 is too small, so that the output voltage of the interrupter 65 is off or at low level. When the protrusion 74A passes under the interrupter 65 and the cover 66A receives the light from the interrupter 65, the distance between the cover 66A and the interrupter 65 is appropriate, so that the light reception quantity of the reflection light from the cover 66B detected by the interrupter 65 is appropriate, and the output of the interrupter 65 is on or at high level.

On the other hand, the apex portion of the protrusion 74B of FIG. 18 is placed away from the interrupter 65 so that the interrupter 65 can output an appropriate output voltage, and the cover 66B is situated close to the interrupter 65 to ensure that the reflection light of the emission light from the interrupter 65 may not reach the light receiving element of the interrupter 65, whereby the light reception quantity of the emission light from the interrupter 65 reflected by the apex portion of the protrusion 74B is larger than the light reception quantity of the light reflected by the cover 66B around the protrusion 74B.

Thus, when the protrusion 74B is situated so as to be opposed to the interrupter 65, the light reception quantity of the interrupter 65 is large, so that the output obtained through the optical detection by the interrupter 65 is on or at high level. When the cover 66B is situated under the light emitting element of the interrupter 65, the cover 66B is too close to the interrupter 65, so that the light reception quantity of the interrupter 65 of the reflection light from the cover 66B is equal to zero or lower than the threshold value, so that the output of the interrupter 65 is off or at low level.

In the case 60 and the reel 61 of FIG. 18, the thickness of the cover 66B is large, so that the cover 66B has a groove 68A into which the protrusion 68 is inserted, and the bottom 62 of the case 60 has no step portion 67B as shown in FIG. 17. Further, in FIGS. 17 and 18, the case 60 is equipped with the cover portion 62A which can be opened and closed on a shaft 60B.

As stated above, in the case 60 and the reel 61 of FIGS. 17 and 18, the protrusion 74A, 74B and the cover 66A, 66B differ in the light reflection quantity of the reflection light, so that, there is a variation in the output signal of the interrupter 65 between the state in which light is impinging upon the cover 66A, 66B and the state in which light is impinging upon the protrusion 74A, 74B, making it possible to obtain a pulse with a substantially periodical rising edge or falling edge. Thus, it is possible to detect the rotation and the rpm of the reel 61, and to detect the presence or absence of the wire. Due to this construction, there is no need for the reel and the cover 66A, 66B to differ in color.

Here, the reel rpm and the wire feeding amount are related to each other according to the thickness of the wire and can be expressed in the form of a table or a formula. Thus, the flange, etc. of the reel may be provided with a barcode or the like recording the thickness of the reel, the thickness of the wire, and the winding amount thereof, and the reinforcement binding machine may be equipped with a microcomputer and a barcode reader for reading the barcode of the reel, the memory of the microcomputer storing the diameter of the cylindrical member of the reel around which the wire is wound, and the barcode of the reel is read by the barcode reader when the reel is mounted to the reinforcement binding machine, the used amount of wire of the previous reel is reset, the residual amount of the wire is calculated by the microcomputer according to the use of the wire from the wire thickness, the reel diameter, and the reel rpm, and the residual amount and condition of the wire is displayed on an LCD or the like of the reinforcement binding machine or output by voice.

While in the above-described embodiments the cover 66A, 66B is provided, the cover 66A, 66B is not always necessary as long as the space S between the interrupter 65 and the protrusion 64A, 64B is shielded so as to prevent intrusion of disturbance light. In this case, to prevent intrusion of disturbance light into the space S, it would be expedient to increase the protruding amount of the protrusion 68 at the bottom 62 of the case 60, to form a cylindrical wall portion concentric with the flange 71 on the outer side of the rotation locus of the protrusion 64A, 64B and on the inner side or the outer side of the protrusion 68, and to make it possible for the concentric wall portion and the protrusion 68 to rotate while in slide contact with each other. This construction helps to secure the requisite shielding property for the space S.

Figure 21:
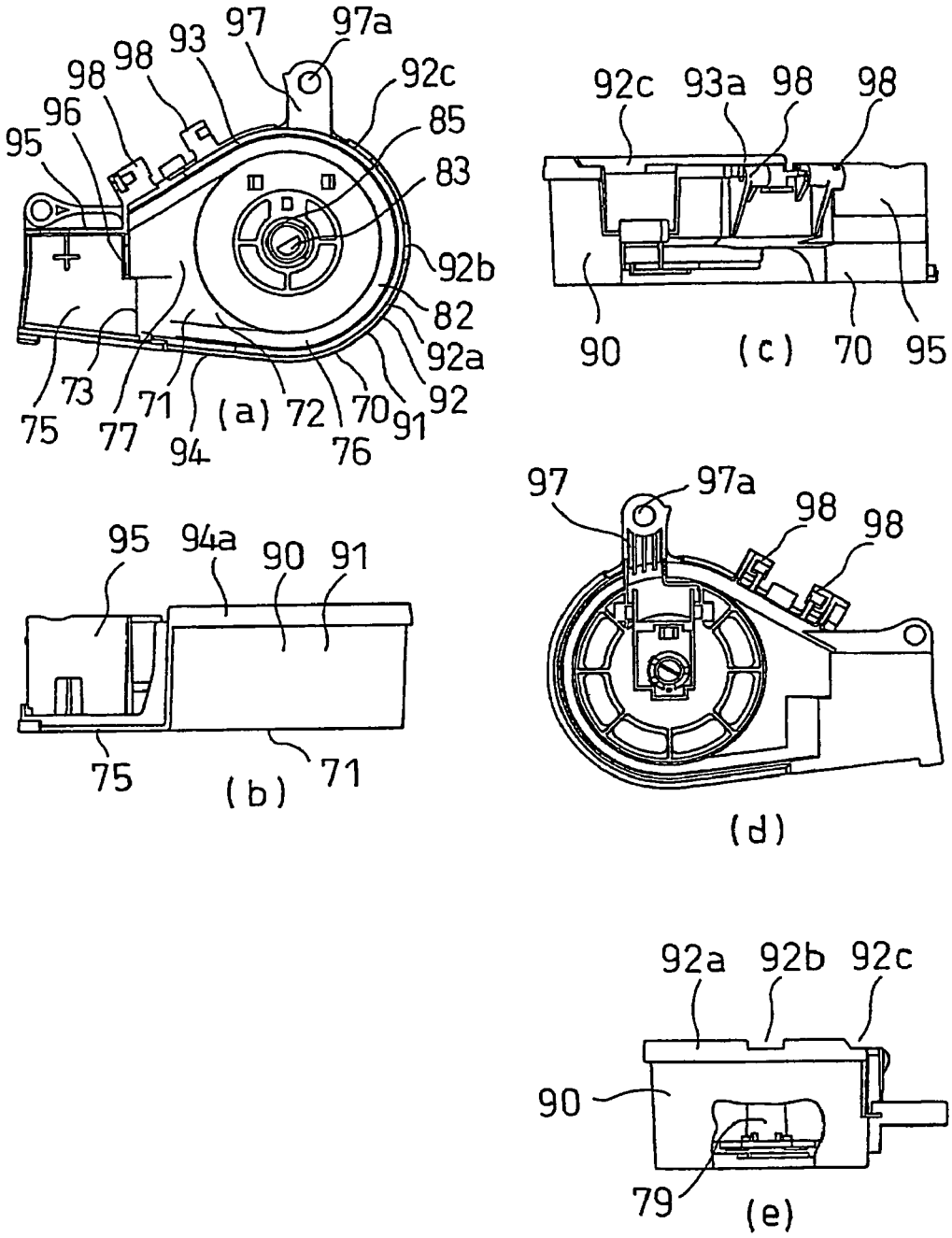
FIG. 21 is an explanatory view of a cassette case according to another embodiment of the present invention.
Figure 22:
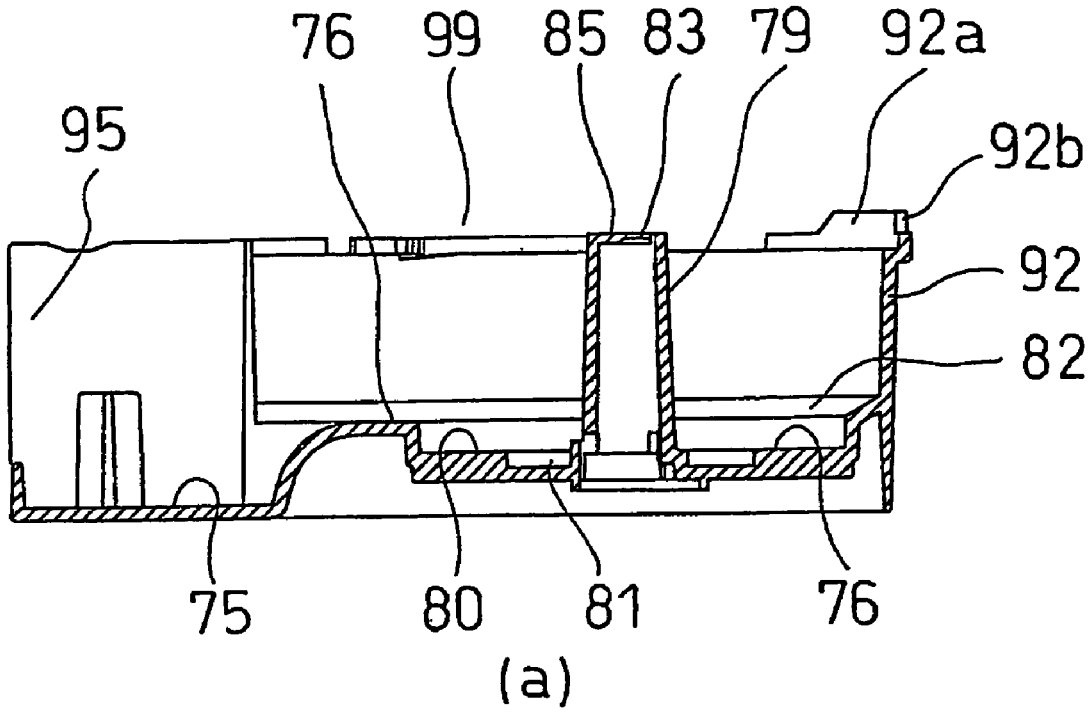
FIG. 22 is a main-portion sectional view of FIG. 21.
Figure 22:
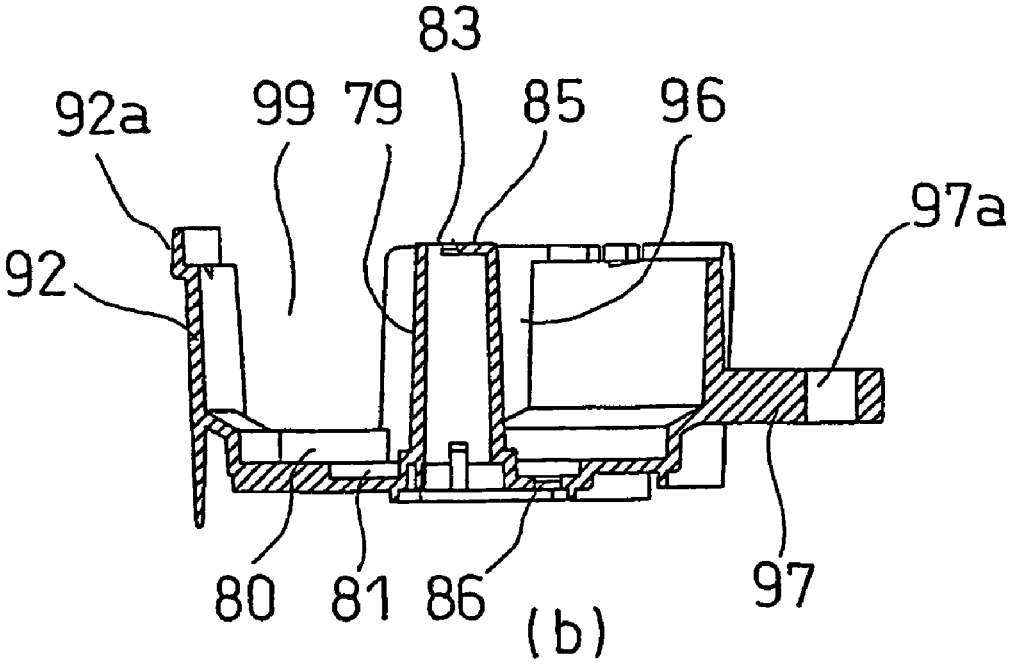

Referring to FIGS. 21 through 35, a cassette case and a reel according to another embodiment of the present invention will be described. A cassette case 70 is formed of a plastic material superior in resistance to wear and bending, such as polypropylene, and, as shown in FIGS. 21 and 22, it is composed of a bottom portion 71 and a peripheral wall 90 formed in the periphery of the bottom portion 71.

The bottom portion 71 is composed of a first bottom portion 72 and a second bottom portion 75 connected to a linear connecting portion 73 of the first bottom portion 72. The first bottom portion 72 is composed of a substantially circular base portion 76 and a trapezoidal portion 77 surrounded by linear edges extending from the peripheral edge of the base portion 76 toward the connecting portion 73. The second bottom portion 75 is formed in a substantially rectangular configuration.

Protruding from substantially the center of the base portion 76 of the first bottom portion 72 is a cylindrical reel mounting shaft 79 into which the mounting shaft 36 of the bearing portion 35 is inserted for fixation. Further, formed in the base portion 76 of the first bottom portion 72 are a first accommodating recess 80 for accommodating a small flange 152 which is described below and whose center is the reel mounting shaft 79 and a second accommodating recess 81 for accommodating a cover plate 132 described below. Formed around the first bottom portion 72 is a tapered portion 82, by means of which the small flange 152 of a wire reel 150 described below is guided into the first accommodating recess 80.

Formed at the upper end of the reel mounting shaft 79 is an engagement wall 85 having a semi-circular insertion hole 83. Further, in the first bottom portion 72 and in the second accommodating recess 81, there is formed a through-hole 86, in which an optical sensor 87 is provided.

A peripheral wall 90 is composed of a first peripheral wall 91 provided in the first bottom portion 72 and a second peripheral wall 95 provided in the second bottom portion 75. The first peripheral wall 91 is composed of an annular circumferential wall 92 formed at the peripheral edge of the base portion 76, and a first side wall 93 and a second side wall 94 formed at both linear edges of the trapezoidal portion 77; the second peripheral wall 95 is provided linearly at one end edge of the second bottom portion 75. Further, the connecting portion 73 is provided with a partition wall 96 partitioning the first bottom portion 72 and the second bottom portion 75 substantially halfway. At the upper ends of the circumferential wall 92 and the first and second side walls 93 and 94, there are formed guide protrusions (step portions) 92*a*, 93*a*, and 94*a*. The guide protrusion (step portion) 92*a* of the circumferential wall 92 has engagement recesses 92*b* and 92*c*.

In the cassette case 70, an arm 97 is provided on the circumferential wall 92, and a detent hole 97*a* is formed in the arm 97. The cassette case 70 is fixedly mounted to the binding machine main body 21 by mounting it to the mounting shaft 36 and passing a bolt through the detent hole 97*a* to threadedly engage it with one side of the binding machine main body 21. Further, in the cassette case 70, the first side wall 93 has a pair of bearing protrusions 98.

Figure 23:
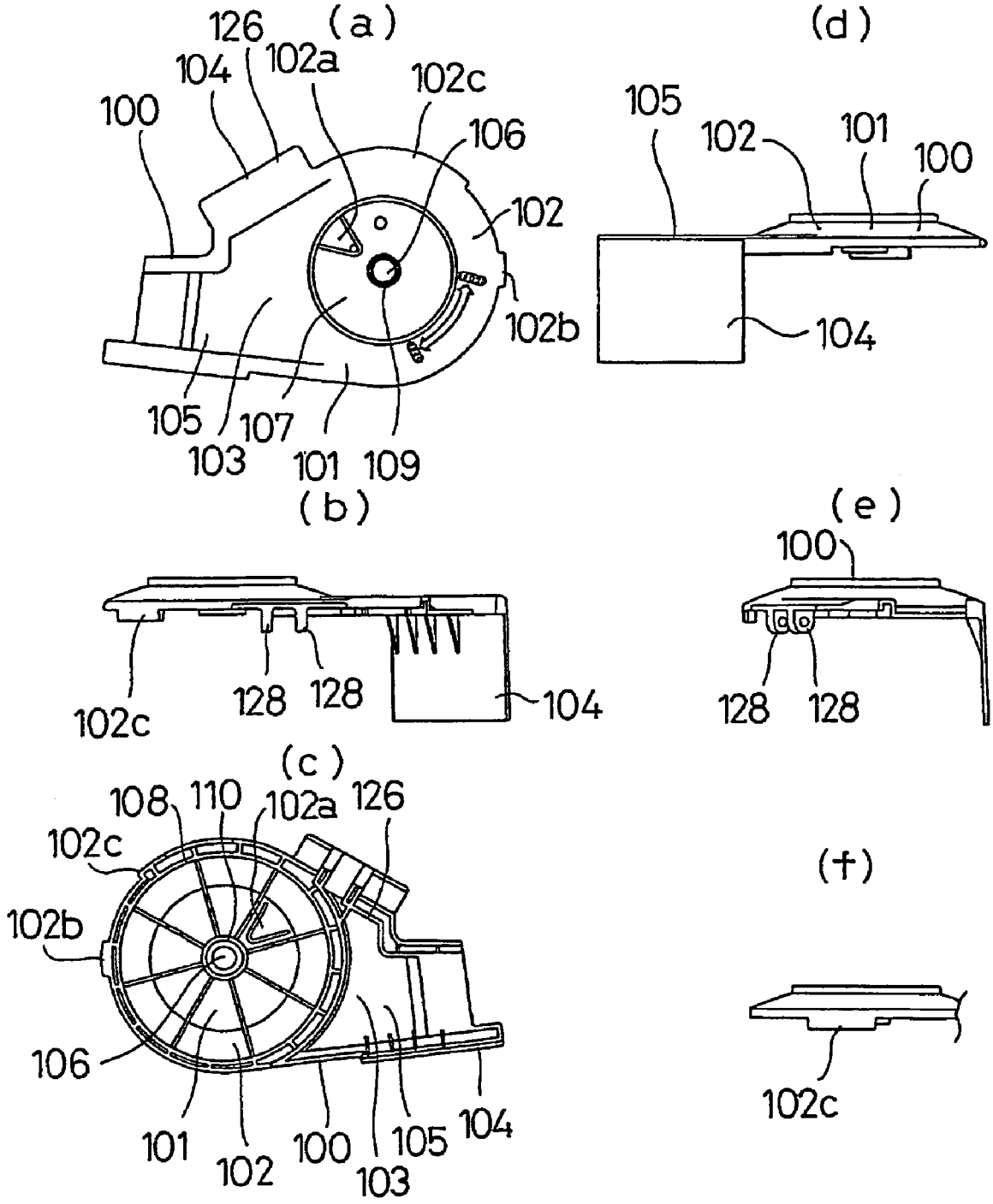
FIG. 23 is an explanatory view of a cover member of a cassette case according to another embodiment of the present invention.
Figure 24:
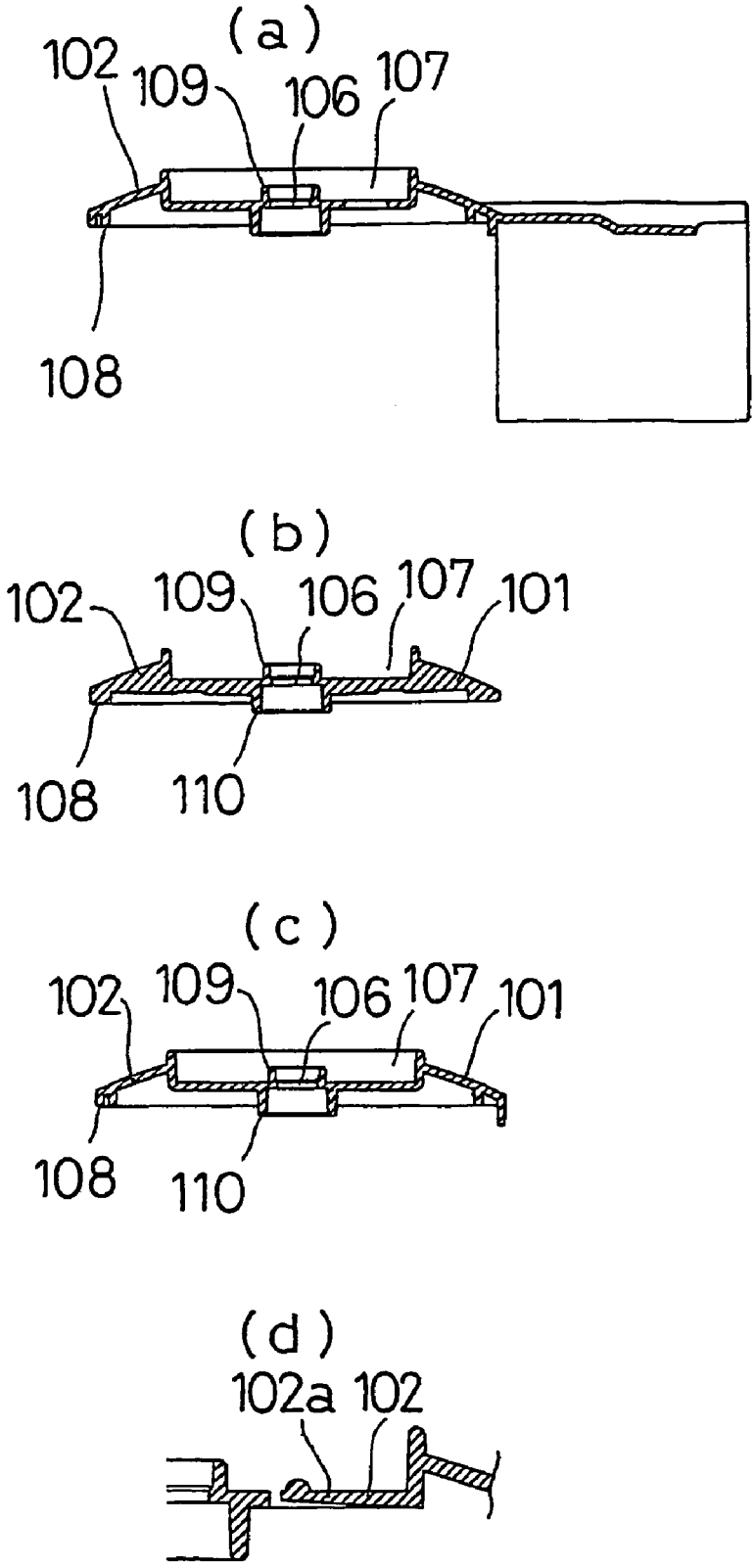
FIG. 24 is a main-portion sectional view of FIG. 23.
Figure 25:
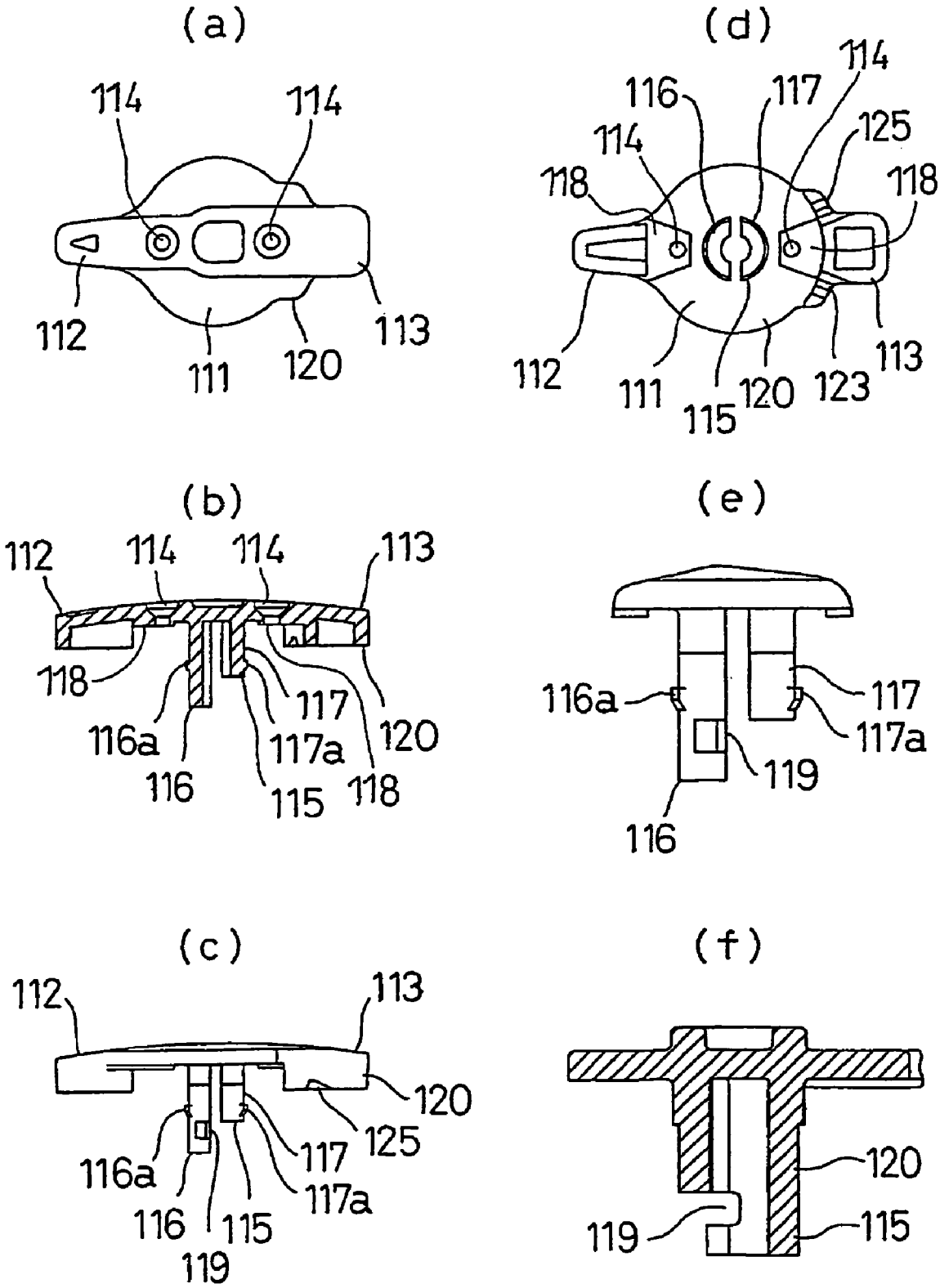
FIG. 25 is an explanatory view of a lock means mounted to the cover member of FIG. 23.

Formed in the cassette case 70 is an opening 99 allowing insertion of the wire reel 150, and, further, a cover member 100 for closing the opening 99 is hinged thereto. The cover member 100 is formed of the same material as the cassette case 70, and, as shown in FIGS. 23 and 24, is composed of a first cover portion 101 and a second cover portion 105. The first cover portion 101 is composed of a substantially circular base portion 102 and a trapezoidal portion 103. The second cover portion 105 is formed in a substantially rectangular configuration. At the peripheral edge of the base portion 102, there are formed engagement protrusions 102*b* and 102*c* to be engaged with the engagement recesses 92*b* and 92*c* of the circumferential wall 92. Further, a side wall 104 is formed at the end edge of the second cover portion 105 on the opposite side of the hinge connection portion described below.

A guide hole 106 is formed substantially at the center of the base portion 102 of the first cover portion 101. In the surface of the base portion 102, there is formed a circular recess 107 whose center is substantially the center of the guide hole 106. Further, in the surface of the base portion 102, there is formed an annular guide protrusion 109 whose center is substantially the center of the guide hole 106. On the inner surface of the base portion 102, there is provided a cylindrical protrusion 110 whose center is substantially the center of the guide hole 106. On the inner surface of the base portion 102, there is formed an annular guide protrusion 108 for guiding the wire reel 150 while being in slide contact with the portion in the vicinity of the outer peripheral edge of the large flange 153 of the wire reel 150 described below. Further, formed on the base portion 102 is a stopper member 102*a* formed by cutting it substantially in a U-shape and protruding from the surface thereof. A ring-like adjustment annular member 121 as shown in FIG. 13 is rotatably mounted to the annular guide protrusion 109.

A lock means 120 is provided in the recess 107 of the cover member 100. As shown in FIG. 12, the lock means 120 is composed of a circular rotary portion 111, finger-operated arms 112 and 113 provided at both ends of the rotary portion 111, and a cylindrical engagement shaft 115 formed substantially at the center of the rotary portion 111. The engagement shaft 115 is split into two, with one half 116 being longer than the other half 117. In the lower portions of the halves 116 and 117, there are formed lock protrusions 116*a* and 117*a*. In a still lower portion of the one half 116, there is formed an engagement groove 119. On the back side of the finger-operated arm 113, there are formed a first engagement recess 123 and a second engagement recess 125.

Figure 35:
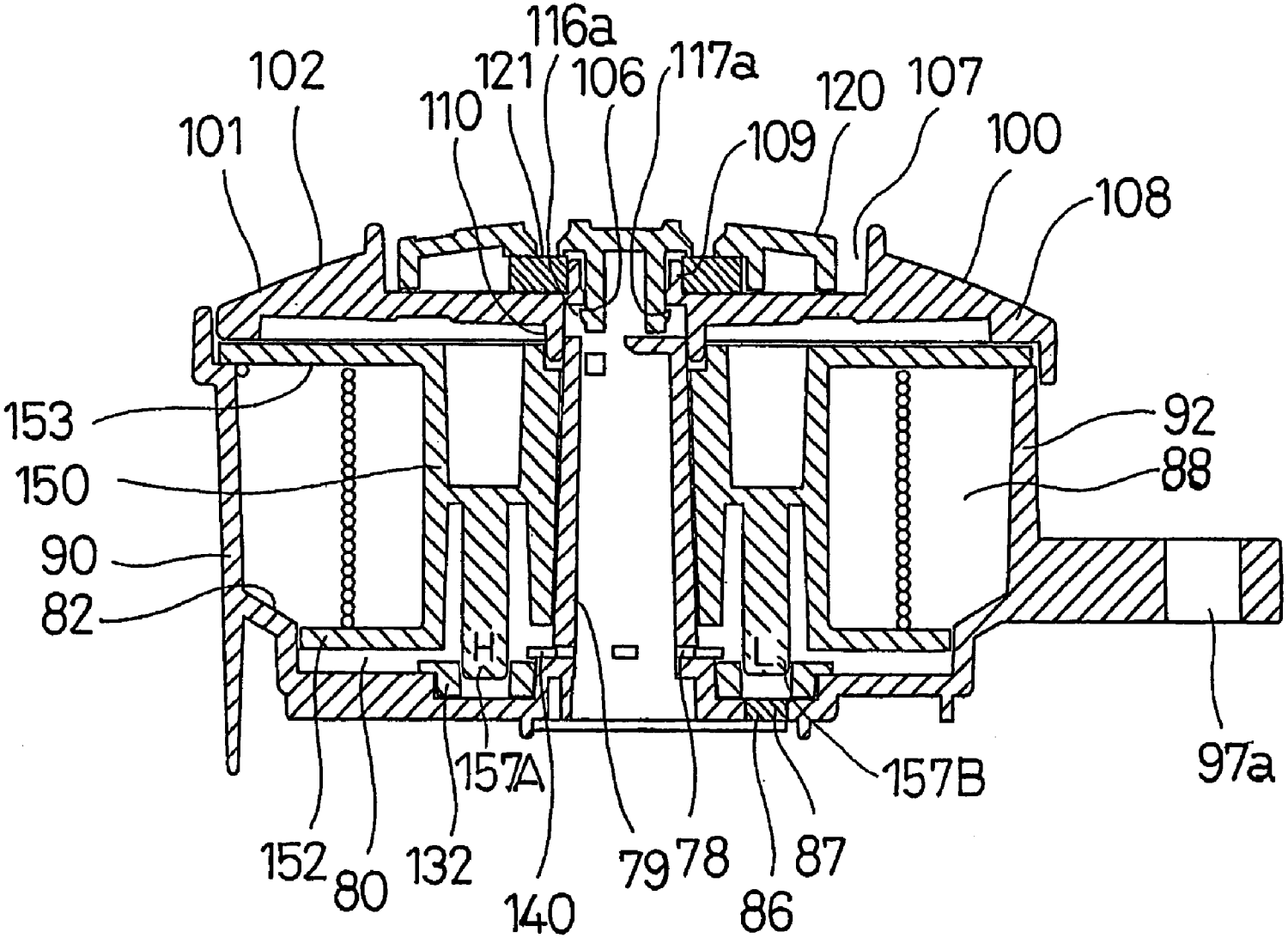
FIG. 35 is a sectional view showing a wire reel as attached to a cassette case.

As shown in FIG. 35, in the lock means 120, the engagement shaft 115 is inserted into the guide hole 106 of the cover member 100, and the lock protrusions 116*a* and 117*a* formed on the engagement shaft 115 are engaged with the inner surface of the base portion 102 to be rotatably mounted in the recess 107 of the cover member 100. The lock member 120 abuts the adjustment annular member 121, and is integrally connected to the adjustment annular member 121 by means of a screw or the like. Positioning is effected on the lock means 120 by engaging the stopper member 102*a* of the cover member 100 with the first engagement recess 123 or the second engagement recess 125 of one finger-operated arm 113.

Figure 26:
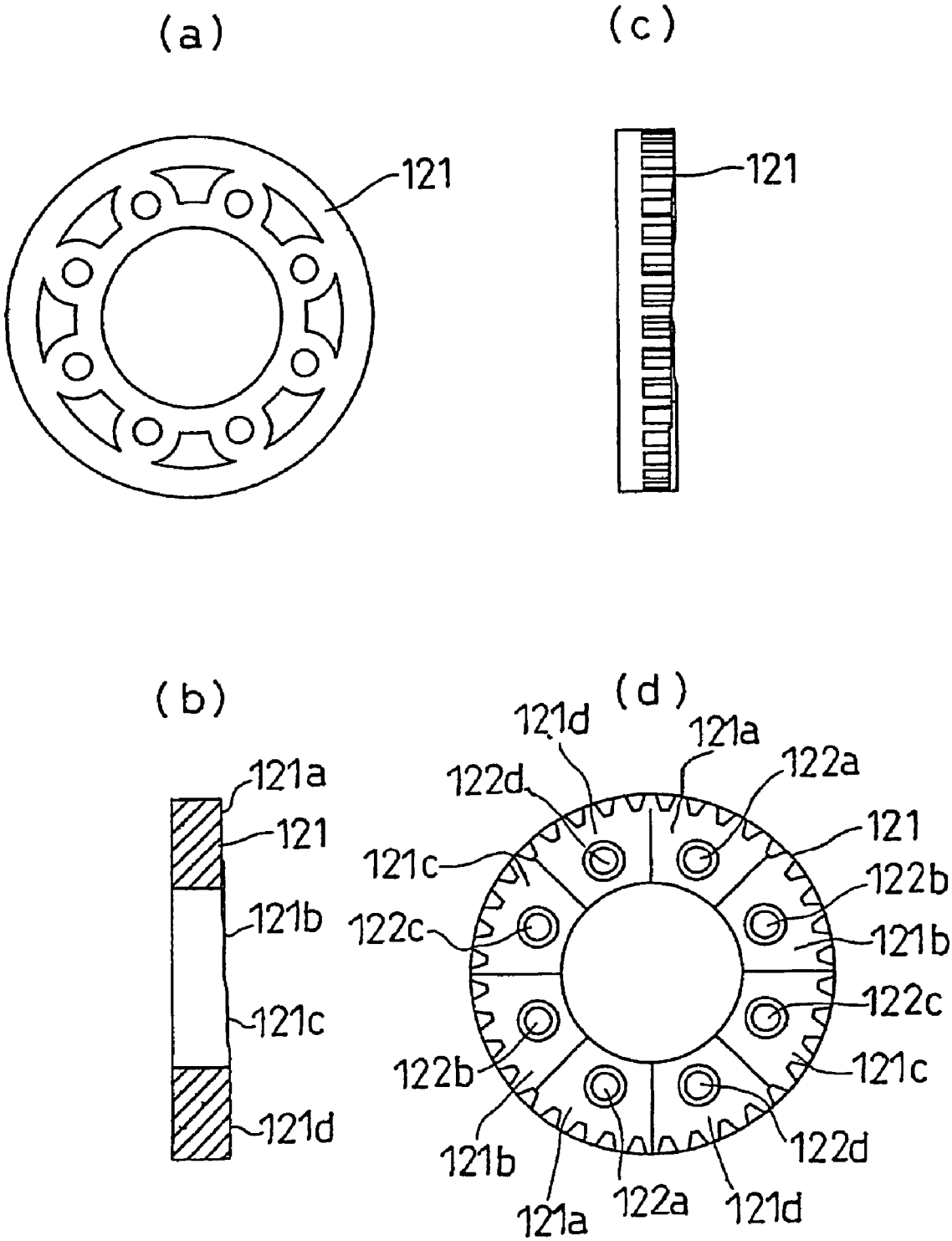
FIG. 26 is an explanatory view of an adjustment annular member mounted to the cover member of FIG. 23.

As shown in FIG. 26, the adjustment annular member 121 has first through fourth mounting portions 121*a* through 121*d* differing in wall thickness. Their wall thickness gradually increases in the descending order starting from the first mounting portion 121*a*, the fourth mounting portion 121*d* being the thickest. The first through fourth mounting portions 121*a* through 121*d* are provided in pairs opposed to each other. Further, the first through fourth mounting portions 121*a* through 121*d* have first through fourth screw holes 122*a* through 122*d*. The lock means 120, to which the adjustment annular member 121 is connected, has trapezoidal abutment portions 118 protruding on both sides of the back surface of the rotary portion 111, and screw-passing holes 114 are provided in the abutment portions 118. In the lock means 120, the abutment portions 118 are joined to the first mounting portions 121*a*, which are of the minimum wall thickness, of the adjustment annular member 121, and screws are passed through the first screw holes 122*a* through the screw-passing holes 114, whereby the engagement shaft 115 protrudes by the maximum distance from the adjustment annular member 121. Similarly, in the lock means 120, the abutment portions 118 are joined to the fourth mounting portions 121*d*, which are of the maximum wall thickness, of the adjustment annular member 121, and screws are passed through the fourth screw holes 122*d* through the screw-passing holes 114, whereby the engagement shaft 115 protrudes by the minimum distance from the adjustment annular member 121. In this way, in the lock means 120, the protruding length of the engagement shaft 115 can be adjusted by the adjustment annular member 121.

The cover member 100 has, at one side edge 126 of the trapezoidal portion 103, a pair of bearing protruding members 128, which are inserted between the bearing protrusions 98 of the cassette case 70, and a support shaft 130 is inserted into the pair of bearing protruding members 128 and the pair of bearing protrusions 98, the cover member 100 being mounted to the cassette case 70 so as to be capable of being opened and closed around the support shaft 130. Further, a coil-spring-like elastic member (not shown) is wound around the support shaft 130, and the cover member 100 is urged in the opening direction by this elastic member.

Figure 27:
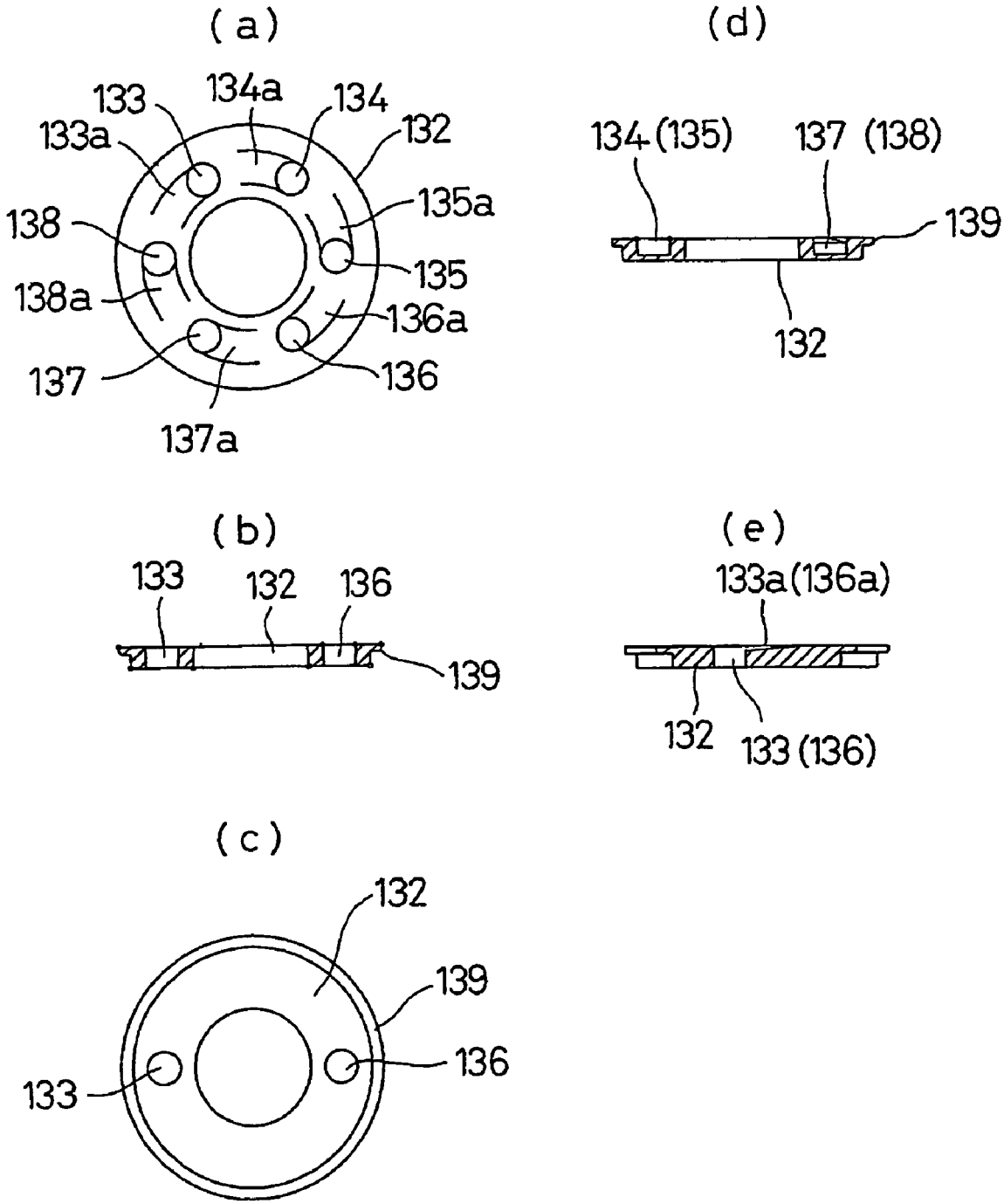
FIG. 27 is an explanatory view of a cover plate mounted to the cassette case.

A cover plate 132 is rotatably accommodated in the second accommodating recess 81 of the cassette case 70. As shown in FIG. 27, the cover plate 132 is formed in a ring-like shape, and has six engagement recesses 133 through 138 arranged at equal intervals; of the six engagement recesses 133 through 138, arbitrary opposing engagement recesses 133 and 136 are formed as through-holes. The engagement recesses 133 through 138 pass over the optical sensor 87. Further, there are formed slopes 133*a* through 138*a* inclined toward the engagement recesses 133 through 138.

Provided at the outer peripheral edge of one end of the cover plate 132 is a flange 139 engaged with the peripheral edge of the second accommodating recess 81. The cover plate 132 is accommodated in the second accommodating recess 81 such that the engagement recesses 133 through 138 face the cover member 100 side, and movement in the axial direction of the reel mounting shaft 79 is prohibited by an elastic ring 140, such as a snap ring, fitted into an annular groove 78 formed in the reel mounting shaft 79.

Next, referring to FIGS. 28 through 34, the wire reel 150 will be described.

Figure 28:
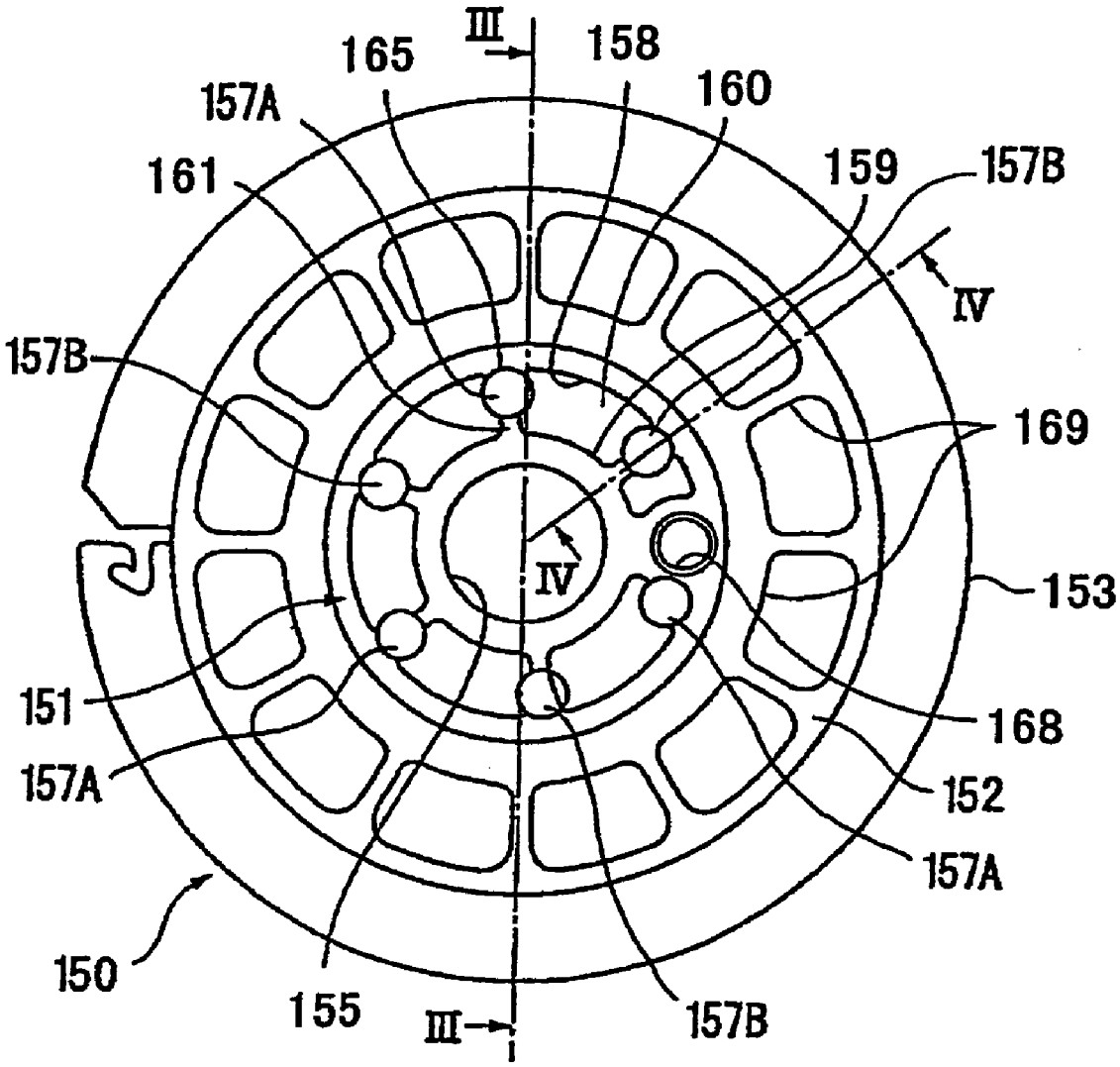
FIG. 28 is a diagram showing the construction on the small diameter flange side portion of a wire reel according to another embodiment of the present invention.

FIG. 28 is a front view of the wire reel 150. The wire reel 150 is formed of a plastic material, such as ABS resin or polyethylene, and has a pair of flanges 152 and 153 on either side of a hub portion 151 around which the wire 27 is wound. The hub portion 151 is formed in a cylindrical configuration, and is integrally molded with the pair of flanges 152 and 153. While the hub portion 151 is formed in a cylindrical configuration, it is also possible for the hub portion to assume some other polygonal configuration.

The pair of flanges 152 and 153 are formed as discs of different diameters, and the height of the small diameter flange 152 as measured from the peripheral surface of the hub portion 151 to the outer peripheral edge portion is set larger than the height of an unused wire 27 wound around the hub portion. The height of the large diameter flange 153 is large enough to enable the winding end portion 27E of the unused wire 27 to be retained without being excessively bent from the state in which the unused wire 27 is wound. Due to the difference in diameter between the pair of flanges 152 and 153 of the wire reel 150, the manner in which the wire 27 is attached can be easily ascertained when attaching the reel to the reinforcement binding machine 20.

Formed at the center of the hub portion 151 is an attachment hole 155 into which the reel mounting shaft 79 of the reinforcement binding machine 20 is inserted. The edge portion of the attachment hole 155, having a large diameter due to the draft, forms a flat surface 156 which is one step lower than the flange 152, and six protrusions 157 are formed on the flat surface 156. Between the adjacent protrusions 157, there are formed recesses 160 equipped with inner wall surfaces 158 and 159 concentric with the flange 152. Further, the protrusions 157 are formed on the wall portions 161 between the adjacent recesses 160. On the other side of the hub portion 151, there are formed six recesses 162 into which the protrusions 157 are inserted.

The six protrusions 157 and the six recesses 162 are arranged such that the entire layout configuration is substantially hexagonal. The outer peripheral edge side inner wall surfaces 163 of the recesses 162 are of an arcuate configuration concentric with the attachment hole 155, and the six protrusions 157 are fitted such that their peripheral surface portions 165 in the vicinity of the outer peripheral edge of the flange 153 exhibit frictional resistance to the inner wall surfaces 163, whereby the six protrusions 157 and the six recesses 162 are joined to each other.

That is, in this embodiment, the pair of flanges 152 and 153 regulating movement in the thickness direction of the wire 27 wound around the hub portion 151 for winding the wire 27, are raised from the hub portion 151, and one side surface portion 156 of the hub portion 151 or the other side surface portion 166 of the hub portion 151 has protrusions 157 and recesses 160 as joint means, whereby mutual joining is possible.

While in this example the joint means is formed by the six protrusions 157 and the six recesses 160, the number of protrusions 157 and recesses 160 may be at least two or three. Further, instead of the protrusions 157, it is also possible to form an arcuate protrusion extending concentrically with the hub portion 151, the recess 160 being of a configuration which allows fitting of this arcuate protrusion. Further, the joint means may be formed by a plurality of arcuate protrusions that can be joined together, one being of a small diameter and the other of a large diameter.

Figure 30:
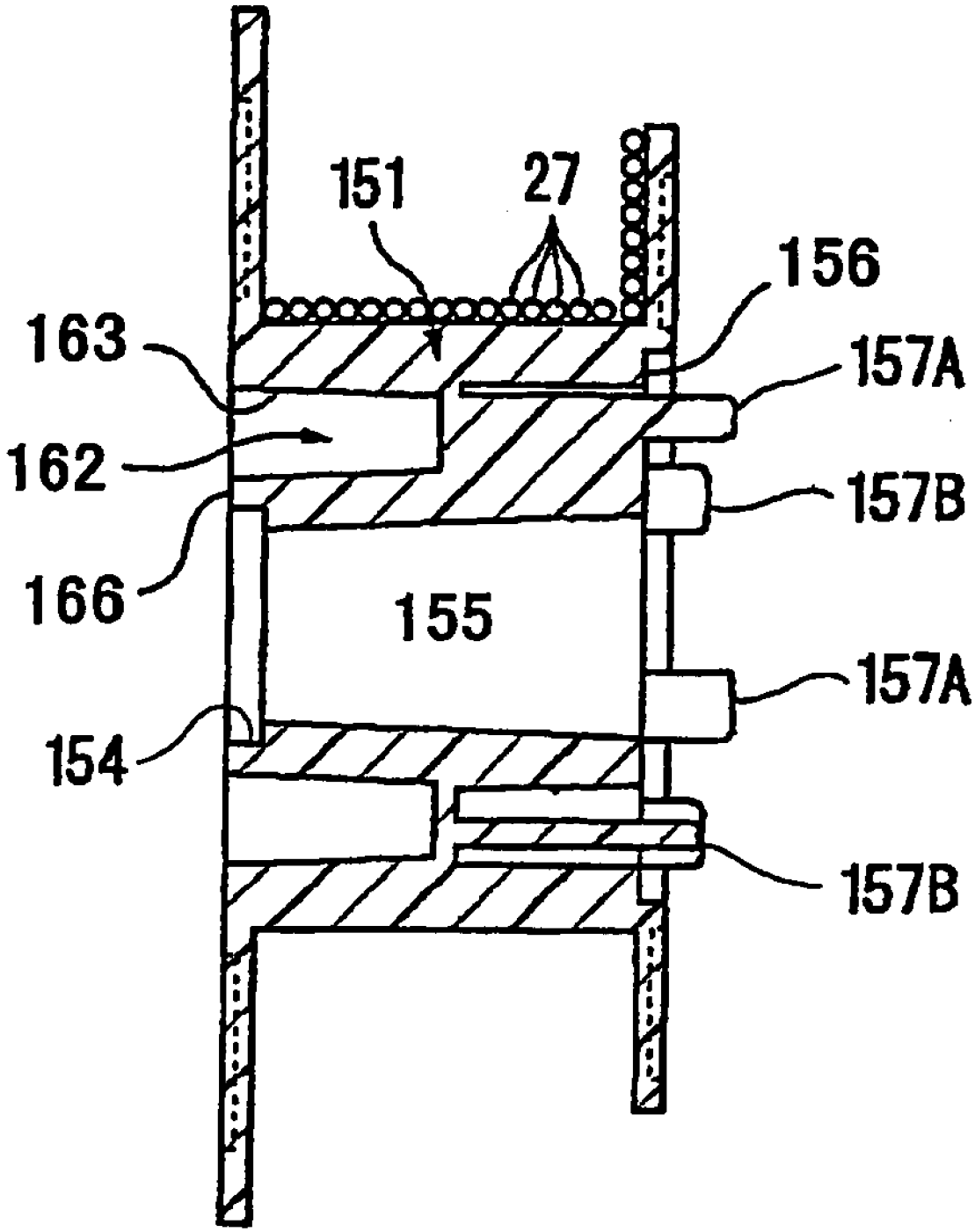
FIG. 30 is a sectional view of the wire reel of FIG. 28 taken along the line III-III.
Figure 31:
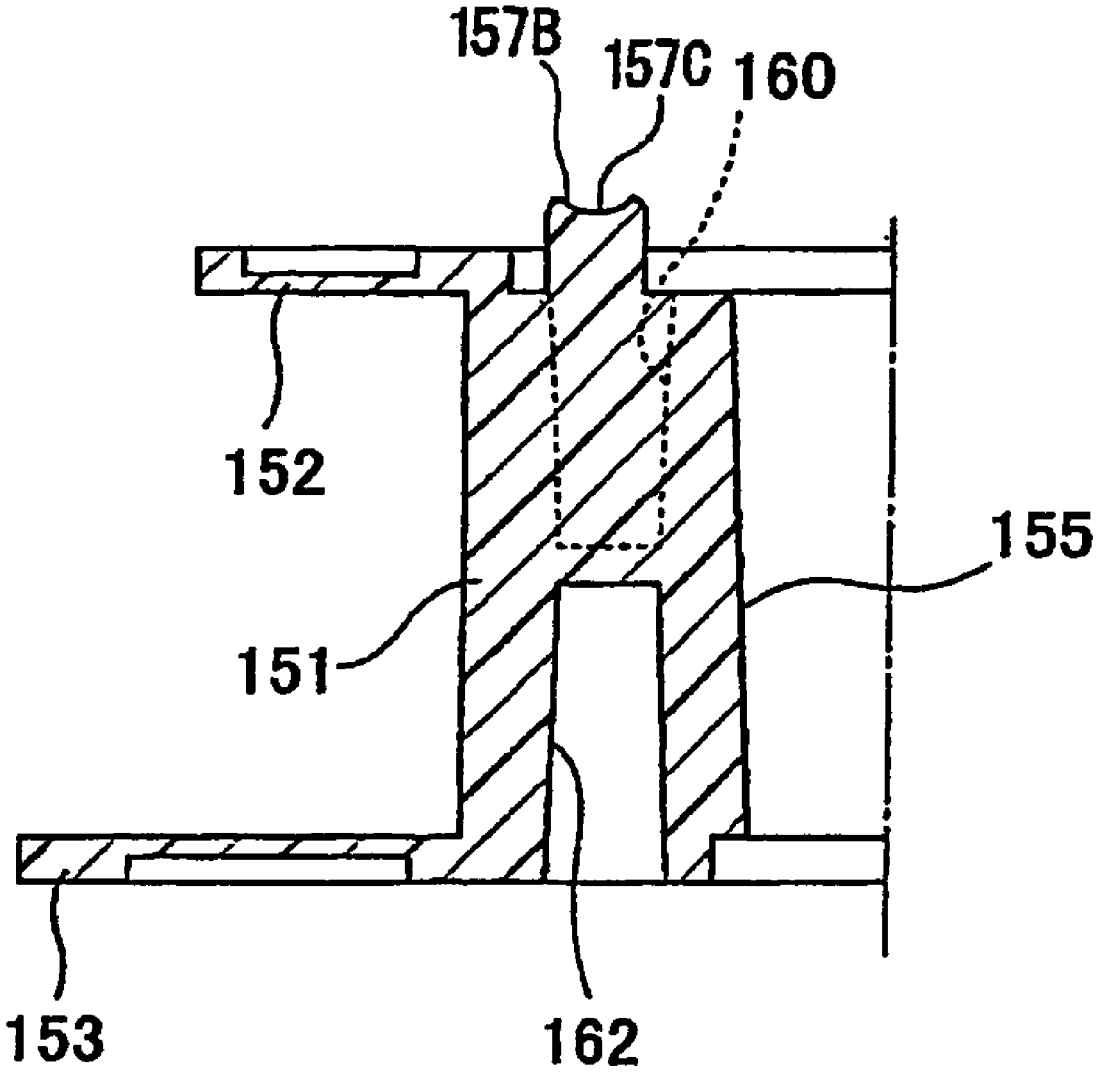
FIG. 31 is a sectional view taken along the line IV-IV of FIG. 28.

Further, in FIG. 30 the protrusions 157 are depicted as thin. This is because the drawing is a sectional view taken along the line III-III of the wire reel 150 of FIG. 28, and, as shown in FIG. 31, the recesses 160 and 162 exhibit wide openings due to the draft. At the flange 153 side edge portion of the attachment hole 155, there is formed a step portion, allowing insertion of nuts, fixation rings, etc. for attaching the wire reel 150 so as to prevent it from being detached.

Figure 29:
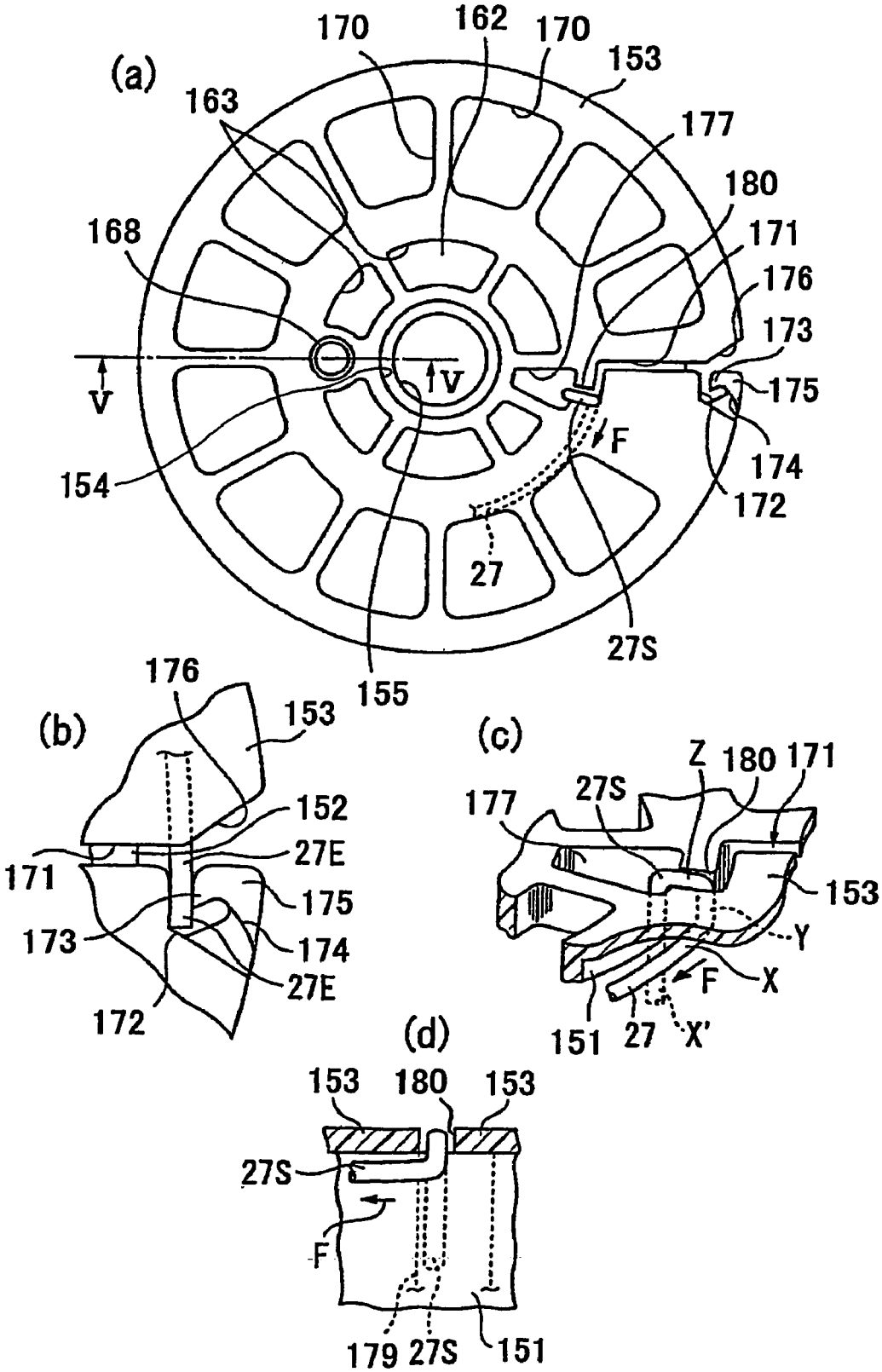
FIG. 29(*a*) is a diagram showing the construction of the large diameter flange side portion of the wire reel of FIG. 28.
Figure 32:
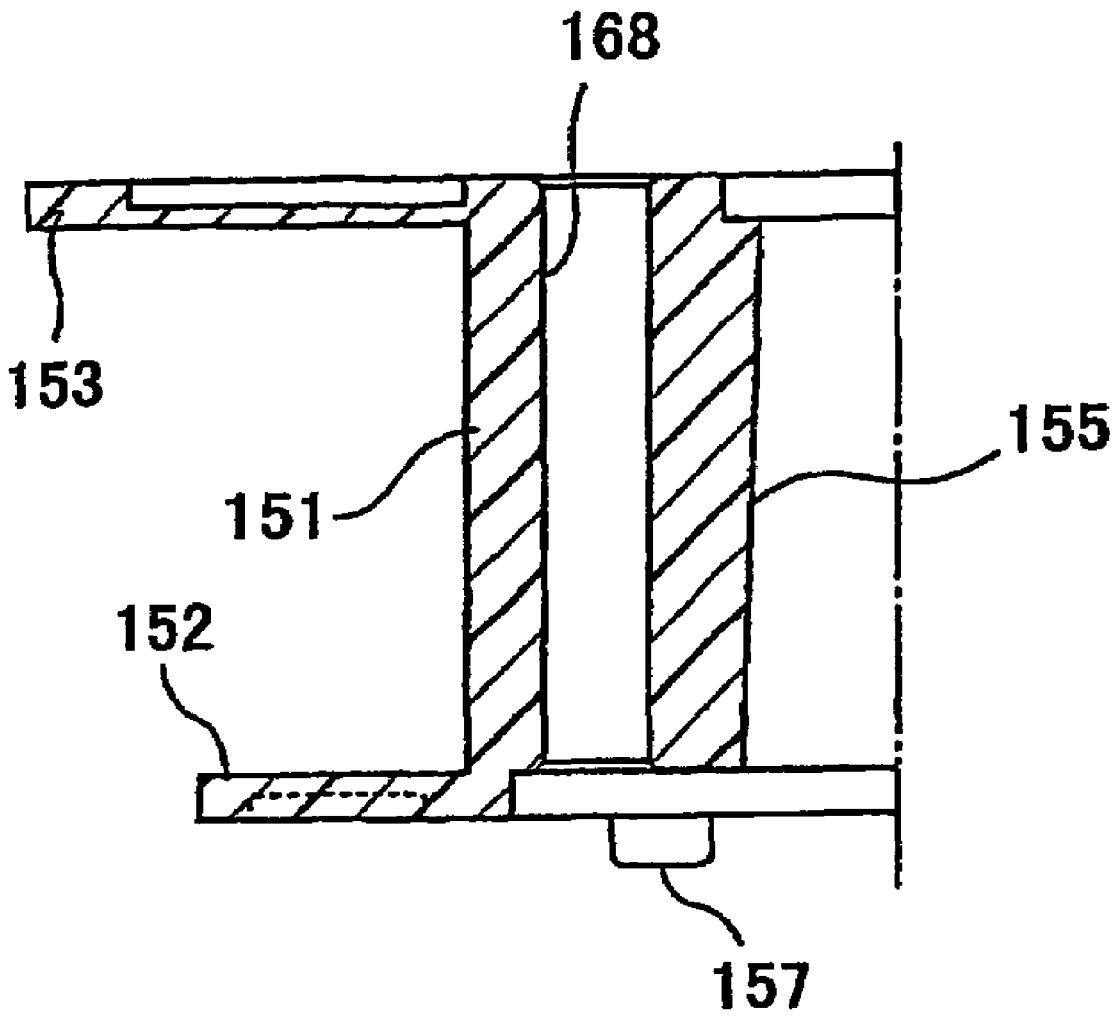
FIG. 32 is a sectional view taken along the line V-V of FIG. 29.
Figure 33:
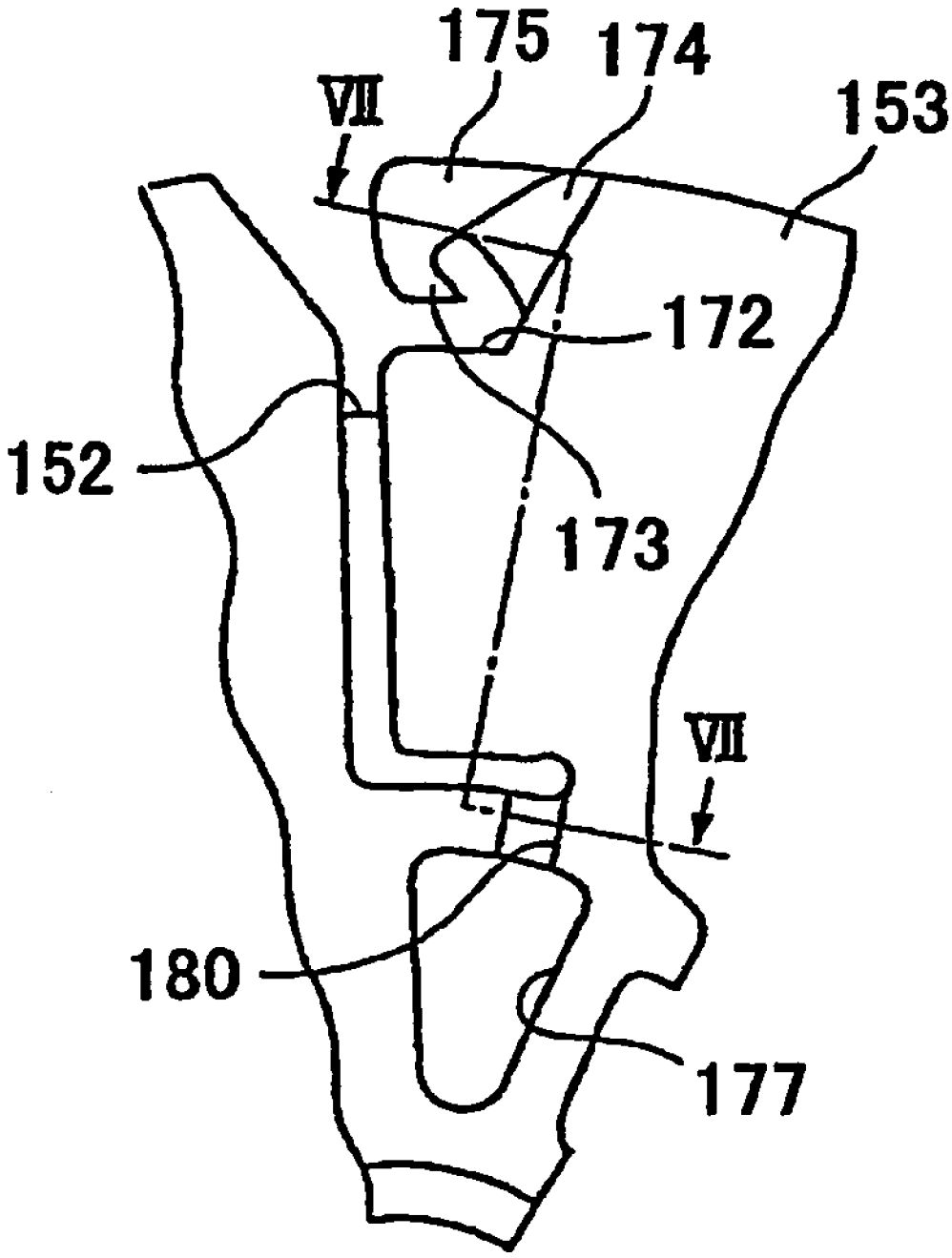
FIG. 33 is an explanatory view showing the construction of a portion in the vicinity of a wire insertion opening and a regulating recess of a flange.
Figure 34:
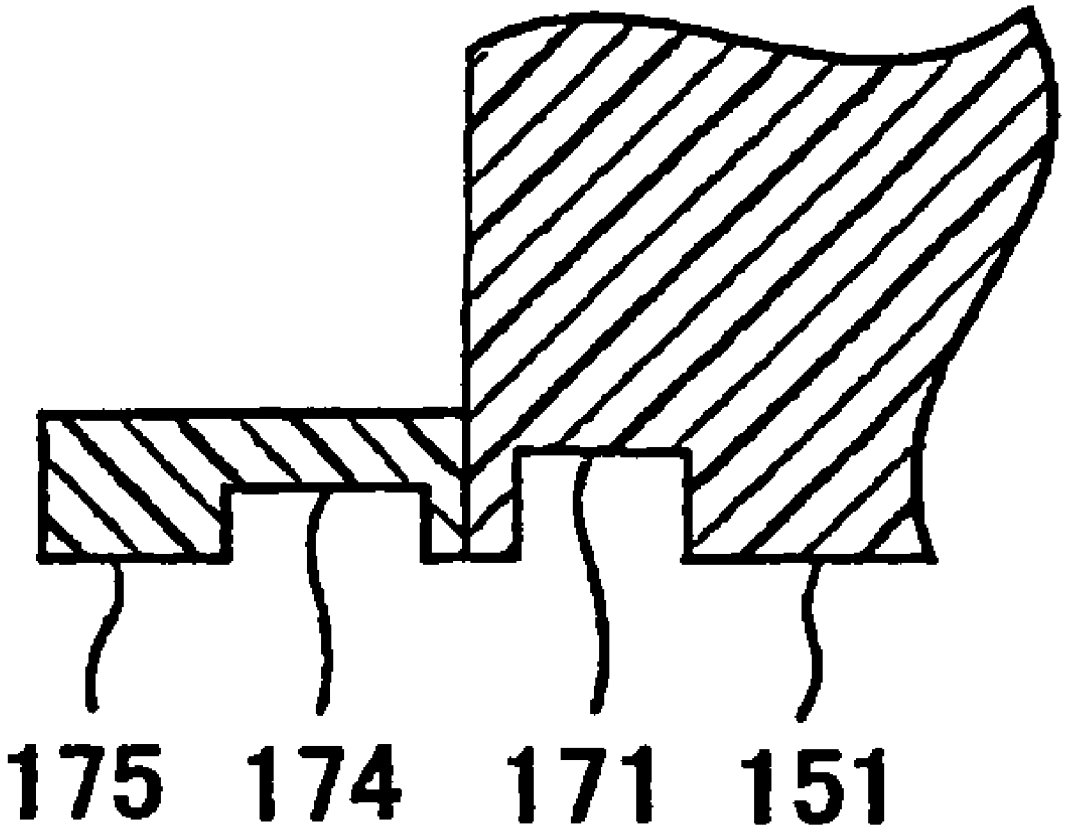
FIG. 34 is a sectional view taken along the line VII-VII of FIG. 33.

Further, as shown in FIGS. 29 and 32, in the vicinity of the attachment hole 155 of the hub portion 151, there is formed a cylindrical hole 168 for detecting the rotating position of the wire reel 150. In the portion of the reinforcement binding machine 20 which constitutes the rotation range for the hole 168, there may be arranged a light emitting element and a light receiving element, the rotation state of the wire reel 150 being judged by allowing the hole 168 to pass between the two elements. The substantially fan-shaped patterns formed on the outer peripheral edges of the flanges 152 and 153 indicate shallow recesses 169 and 170, which contribute to a reduction in the wall thickness of the flanges 152 and 153.

FIG. 29 shows the configuration of the large diameter flange 153. In the outer peripheral edge portion of the flange 153, there is formed a wire insertion opening 171 extending toward the hub portion 151. The wire insertion opening 171 has, at a height corresponding to the winding end portion 27E of the wire 27 (see FIG. 29(*b*)), a guide opening 172 extending in conformity with the direction in which the wire 27 wound around the hub portion 151 extends. Protruding from the guide opening 172 is a holding portion 173 for holding the wire 27 and the protruding portion of the holding portion 173 grasps and retains the winding end portion 27E of the wire 27.

Further, there is formed a groove 174 extending from the guide opening 172 toward the outer peripheral edge portion. The portion extending from the groove 174 to the outer peripheral portion 175 exhibits flexibility, and, at the other edge of the wire insertion opening 171, there is formed a cutout portion 176. Since the wire 27 is guided to the outside of the flange 153, there is applied to the outer peripheral portion 175 of the groove 174 a force to inwardly bend it from the wire 27 to the inner side of the flange 153; however, due to the elastic force provided by the flexibility of the outer peripheral portion 175, the winding end portion 27E of the wire 27 can be situated at and secured to the groove 174.

Further, due to the provision of the cutout portion 176, the winding end portion 27E of the wire 27 undergoes no or very little bending. Further, since it is retained inside the groove 174, the winding end portion 27E of the wire 27 can be retained at the edge portion of the holding portion 173 without being bent in the radial direction of the reel at the height at which the wire 27 is wound.

In this way, the winding end portion 27E of the wire 27 is not bent, so that, when the wire 27 is to be passed into the wire guiding mechanism of the wire binding machine, the winding end portion 27E of the wire 27 is detached from the holding portion 173 and the wire insertion opening 171, and the winding end portion 27E of the wire 27 can be passed as it is into the wire guiding mechanism of the wire binding machine, so that there is no need to take the trouble of rectifying bending.

The wire insertion opening 171 is also used when, after inserting the winding start end portion 27S of the wire 27 into the recess 177 (see FIGS. 29(*c*) and 29(*d*)) as the forward end insertion portion of the hub portion 151, the winding end portion is guided to the circumferential surface of the hub portion 151 between the flanges 152 and 153 astride the hub portion 151. The recess 177 into which the winding start end portion 27S is inserted is formed in the flange 153 side surface of the hub portion 151, and there is provided a support wall surface 179 for supporting the winding start end portion 27S. Further, in the side portion of the hub portion 151, there is formed a regulating recess 180 into which the winding start end portion 27S is inserted to regulate its movement.

When winding the wire 27, the winding start end portion 27S of the wire 27 is inserted into the forward end insertion portion 177, and the winding start end portion 27S is bent between the flanges 152 and 153 through the regulating recess 180 provided in the side wall portion of the hub portion 151, and the winding of the wire 27 around the peripheral surface of the hub portion 151 is started in this state, whereby if a large force F in the winding direction is applied to the wire 27, the tensile force F can be received by the edge portion of the wire insertion opening 171.

Further, in the vicinity of the regulating recess 180, the winding start end portion 27S of the wire 27 is repeatedly bent by 90 degrees corresponding to the wall thickness of the flange 153 and the wall thickness of the hub portion 151, from the state in which it extends in the direction parallel to the flange 152 (the X-direction) to states in which it extends in a direction perpendicular to the flange 153 (the Y-direction), in a direction in which the regulating recess 180 extends (the Z-direction), and, further, in the X-direction, so that a large force is required to extend this portion in a linear form. Further, since the recess 177 supports the inserted portion by the support wall surface 179, there are many portions which support the tensile force F, and the wire 27 is not easily pulled out by the force with which the wire binding machine pulls the wire 27.

Thus, if, in the reinforcement binding machine 20, the reel repeatedly rotates in the normal and reverse directions, movement of the winding start end 27S of the wire 27 in the circumferential direction of the reel is regulated by the regulating recess 180, so that the winding start end portion 27S of the wire 27 gradually loosens from the insertion portion, whereby its detachment is prevented.

Due to this arrangement, if the amount of wire 27 remaining on the reel has been reduced during reinforcement binding operation by the reinforcement binding machine 20, it is possible to prevent the bent portion of the winding start end portion 27S from being detached from the reel to cause clogging in the wire guide mechanism of the wire binding machine. Thus, during reinforcement binding operation, it is possible to avoid a situation in which the operation stagnates due to clogging of the wire 27.

In this embodiment, the opposing protrusions 157A and 157B of the wire reel 150 have different heights. That is, the protrusions 157 consist of the high protrusions 157A and the low protrusions 157B that are alternately arranged. At the upper end of each of the protrusions 157A and 157B, there is formed a gently curved recess 157C.

As shown in FIG. 35, the wire reel 150 is accommodated from the small flange 152 into the cassette case 70 by inserting the reel mounting shaft 79 of the cassette case 70 into the attachment hole 155. The protrusions 157 are engaged with the engagement recesses 133 through 138 of the cover plate 132.

Of the protrusions 157 engaged with the engagement recesses 133 and 136, the high protrusion 157A and the low protrusion 157B are opposed to each other, and the engagement recesses 133 and 136 are formed as through-holes, so that the optical sensor 87 can detect the high protrusion 157A and the low protrusion 157B. The optical sensor 87 is composed of a light emitting element and a light receiving element, and, as stated above, the upper ends of the protrusions 157 are formed as curved recesses 157C, so that the light emitted from the light emitting element is collected on the light receiving element, making it possible to reliably detect the protrusions 157.

The small flange 152 is accommodated in the first accommodating recess 80 by fitting. The gap between the outer periphery of the small flange 152 and the inner periphery of the first accommodating recess 80 is smaller than the diameter of the wire 27, so that there is no fear of the wire 27 coming out of this gap. The large flange 153, the outer diameter of which is formed so as to be larger than the inner diameter of the circumferential wall 92 of the cassette case 70, is brought into slide contact with the upper end of the circumferential wall 92 without being accommodated in the cassette case 70.

When the cover member 100 is closed around the support shaft 130 against the resilience of the elastic member 131, the forward end of the reel mounting shaft 79 of the cassette case 70 is fitted into a cylindrical protrusion 110, and is fitted into a fitting recess 154 formed in the hub portion 151 of the wire reel 150. Further, the one half 116 of the engagement shaft 115 of the lock member 120 is inserted into the insertion hole 83 of the reel mounting shaft 79, and the rotary portion 111 is rotated by hooking the finger on the finger-operated arms 112, 113; when the stopper member 102*a* of the cover member 100 is engaged with the second engagement recess 125, the engagement groove 119 of the one half 116 is engaged with the engagement wall 85 of the reel mounting shaft 79, and the cover member 100 is locked to the cassette case 70.

When the rotary portion 111 is rotated to engage the stopper 102*a* of the cover member 100 with the first engagement recess 123, the engagement groove 119 of the one half 116 is detached from the engagement wall 85 of the reel mounting shaft 79, and the cover 100 is automatically opened by the elasticity of the elastic member 131. As stated above, when the cover member 100 is locked to the cassette case 70, the guide protrusion 108 of the first cover portion 101 is brought into slide contact with the side surface in the vicinity of the outer peripheral edge of the large flange 153 of the wire reel 150, thereby regulating axial movement of the hub portion 151 of the wire reel 150.

As stated above, the lock means 120 can adjust the protruding length of the engagement shaft 115 by the adjustment annular member 121, so that, as shown in FIG. 27, it is possible to change the distance a between the guide protrusion 108 of the cover member 100 and the upper end of the circumferential wall 92 of the cassette case 70. When the protruding length of the engagement shaft 115 of the lock means 120 is increased, the above distance a is increased; when the protruding length of the engagement shaft 115 is reduced, the above distance a is reduced. Thus, in this embodiment, the wall thickness of the adjustment annular member 121 is of four kinds, ranging from the first mounting portion 121*a* to the fourth mounting portion 121*d*, so that it is possible to adjust the above distance a in four stages; the number of stages, however, is not limited to this; it may also be more than or less than four.

As shown in FIGS. 22 and 27, the large flange 153 of the wire reel 150 is arranged between the guide protrusion 108 of the cover member 100 and the upper end of the circumferential wall 92 of the cassette case 70, and is held between the guide protrusion 108 and the upper end of the circumferential wall 92. For the wire reel 150 to properly rotate, it is necessary for the large flange 153 to be pressurized by the pressurizing force due to the cover member 100, which is within a predetermined range.

The pressurizing force the large flange 153 receives differs according to the distance a; when the distance a is small, the pressurizing force is large, and, when the distance a is large, the pressurizing force is small. When the pressurizing force is large, the resistance the large flange 153 receives is large, making it difficult for the wire reel 150 to rotate. When the pressurizing force is small, the large flange 153 rattles within the range of the distance a, and a gap is generated between the large flange 153 and the upper end of the circumferential wall 92; when the wire 27 is caught in this gap or detached from this gap, it becomes impossible for the wire reel 150 to rotate properly.

In this way, depending on the distance a, the pressurizing force fluctuates, and, when this pressurizing force is not appropriate, there occurs a malfunction, such as defective feed/return of the wire 27. The distance a is defined by the gap formed when the cover member 100 is closed on the cassette case 70 and locked by the lock means 120; while it is desirable for the distance to be fixed, due to the production tolerance of each component, the distance may not be fixed at the time of assembly.

In this embodiment, the lock means 120 is equipped with an adjustment annular member 121 having the first through fourth mounting portions 121*a* through 121*d* differing in wall thickness, and the adjustment annular member 121 is rotated to fix by screws the lock means 120 to appropriate mounting portions in the first through fourth mounting portions 121*a* through 121*d* of the adjustment annular member 121, thereby making it possible to adjust the protruding length of the engagement shaft 115 and to set the distance a, so that even when the distance a is improper due to the production tolerance of each component, it is possible to adjust the distance a to an appropriate one. Thus, it is possible, for example, to properly adjust the pressurizing force with which the cover member 100 is pressed against the wire reel 150, thus making it possible to secure a pressurizing force within the above-mentioned predetermined range.

While the distance a fluctuates by rotating the adjustment annular member 121, the cover member 100 is prevented from being fastened to the cassette case 70 with a degree of tightness in excess of a fixed level through engagement between the engagement recesses 92*c* and 92*b* of the cassette case 70 and the engagement protrusions 102*c* and 102*b* of the cover member 100. Further, while in the above-described case the distance a cannot be adjusted to a proper one due to the production tolerance of the cassette case 70, the cover member 100, and the lock means 120, variation in the width of the wire reel 150 can also be absorbed by adjusting the distance a, thus making it possible to secure a proper pressurizing force within a predetermined range to thereby prevent defective feed/return of the wire reel 150.

As described above, the lock device is mounted to the opening/closing member (the cover member 100) provided on the main body (the cassette case 70) so as to be capable of opening and closing, and is composed of the lock means 120 and the adjustment annular member 121, the lock means 120 having the rotary portion 111 and the engagement shaft 115 formed on the rotary portion 111, the adjustment annular member 121 having a plurality of mounting portions 121*a* through 121*d* differing in wall thickness rotatably mounted on the engagement shaft 115. The lock means 120 is capable of being mounted to the mounting portions 121*a* through 121*d*. When the lock device is mounted to the opening/closing member (the cover member 100), the engagement shaft 115 engaged with the main body (the cassette case 70) protrudes from the opening/closing member (the cover member 100), and the mounting portion to which the lock means 120 of the adjustment annular member 121 is mounted is selected, whereby it is possible to adjust the protruding length of the engagement shaft 115.

The cover member 100 is fit-engaged with the inner side of the guide protrusions (step portions) 92*a* through 94*a* of the cassette case 70, and the engagement protrusions 102*b* and 102*c* are engaged with the engagement recesses 92*b* and 92*c* formed in the guide protrusion 92*a* of the circumferential wall 92 for positioning, the side wall 104 of the second cover portion 105 being joined to the other end edge of the second bottom portion 75 of the cassette case 70 to make it possible to completely cover the cassette case 70.

Figure 36:
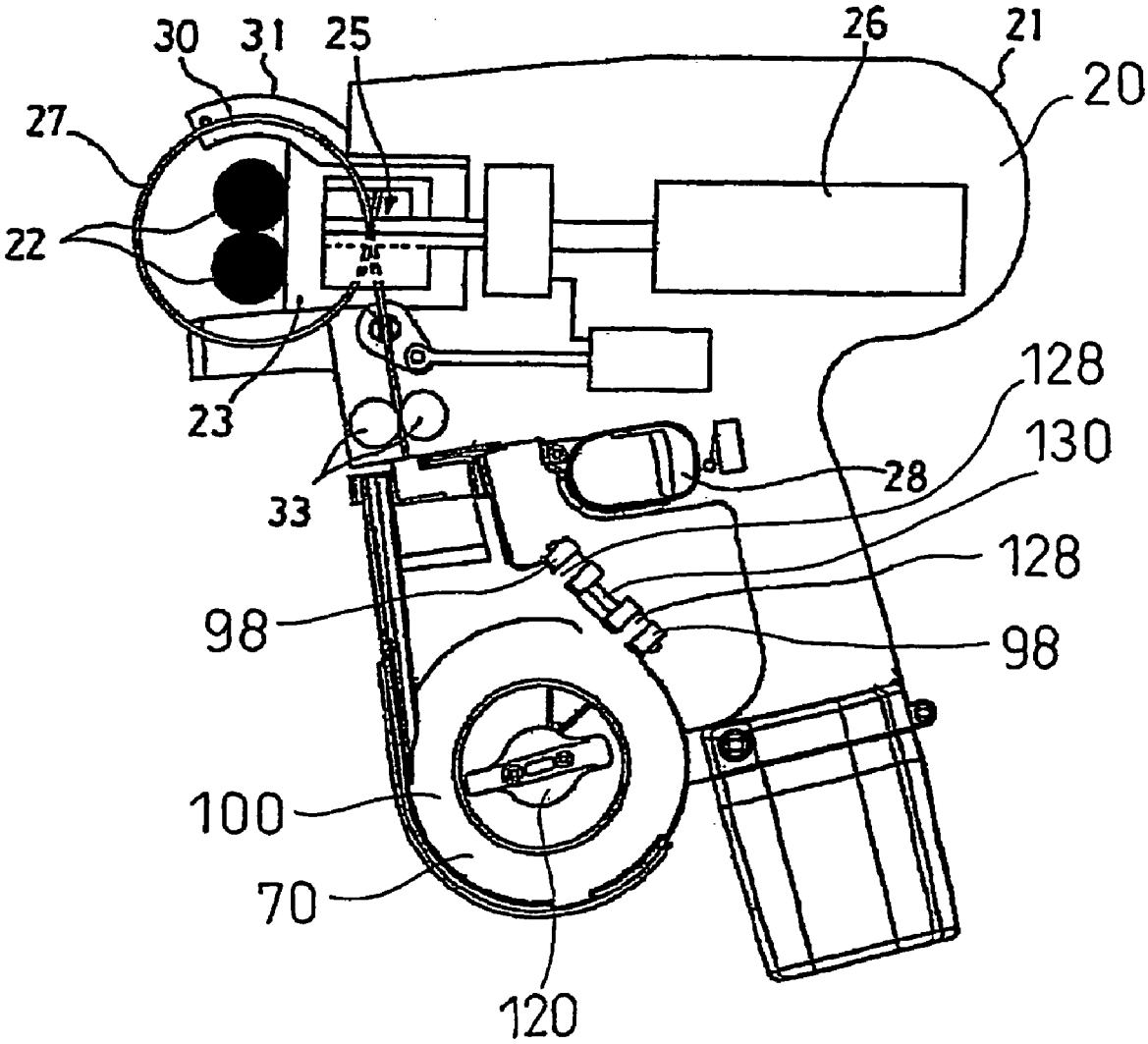
FIG. 36 is a side view showing how a cassette case with a wire reel attached thereto is mounted to the main body of a binding machine.
Figure 37:
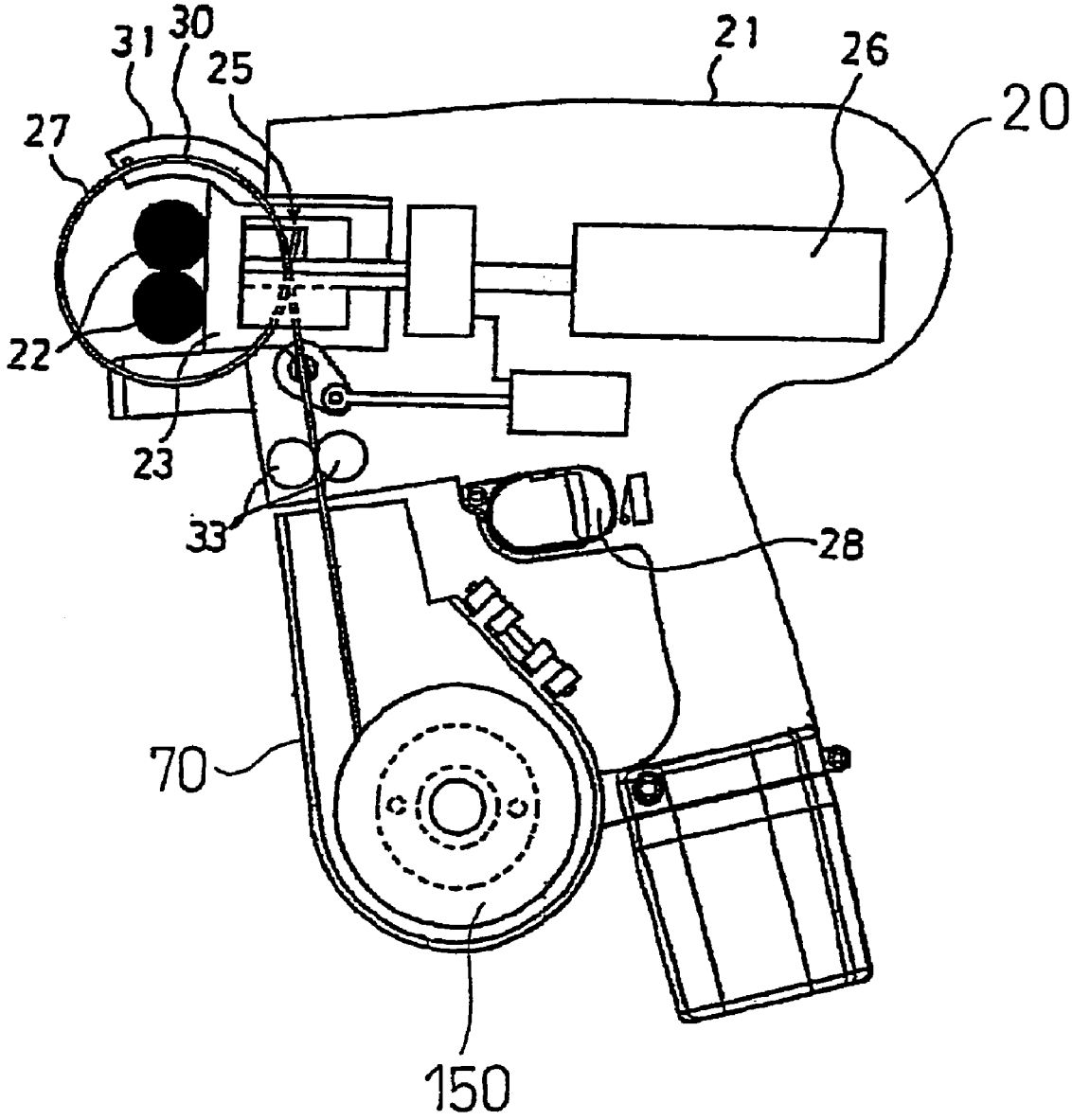
FIG. 37 is a side view of FIG. 36 with the cover member removed.
Figure 38:
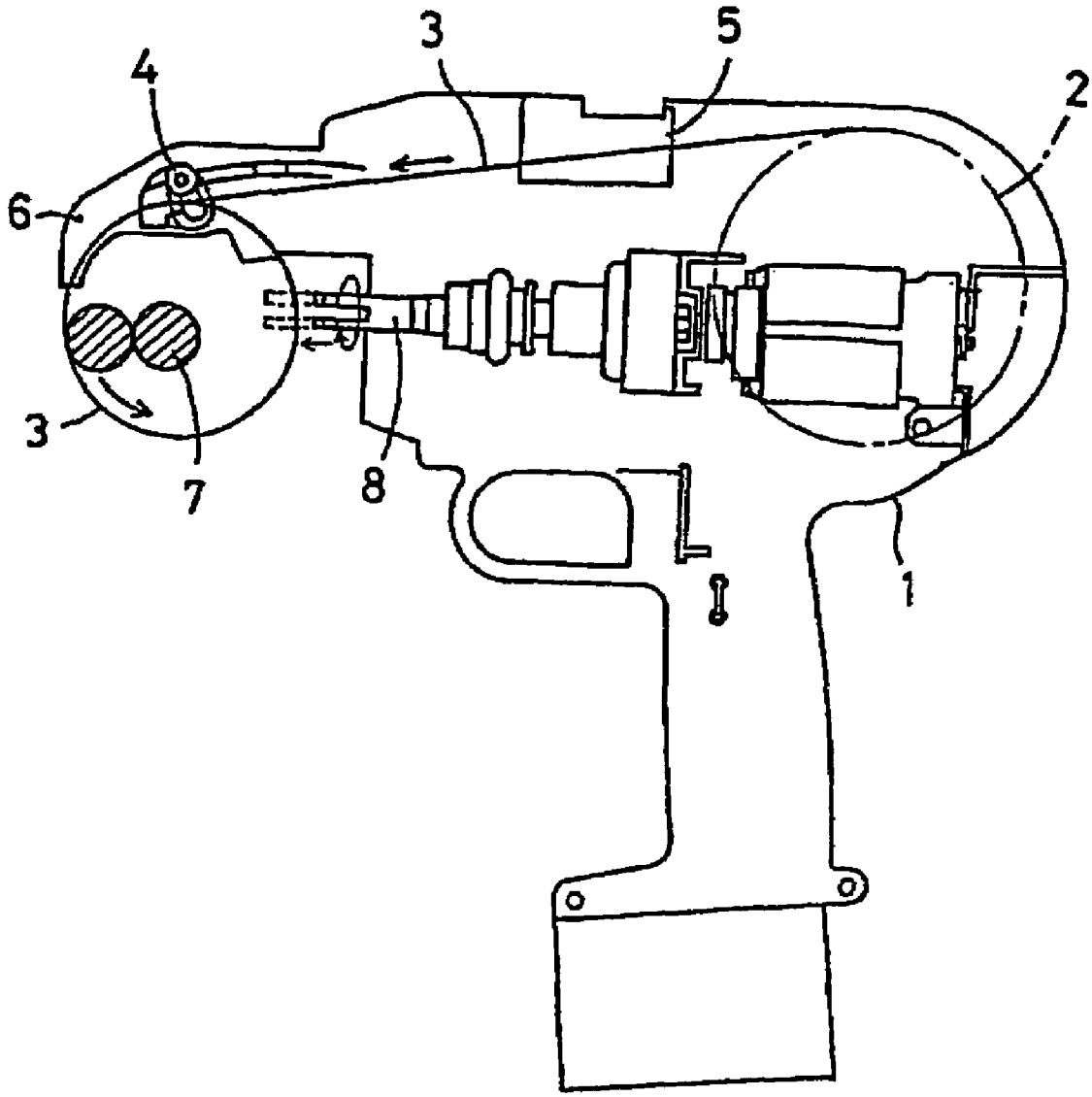
FIG. 38 is a side view of a conventional reinforcement binding machine.
Figure 39:
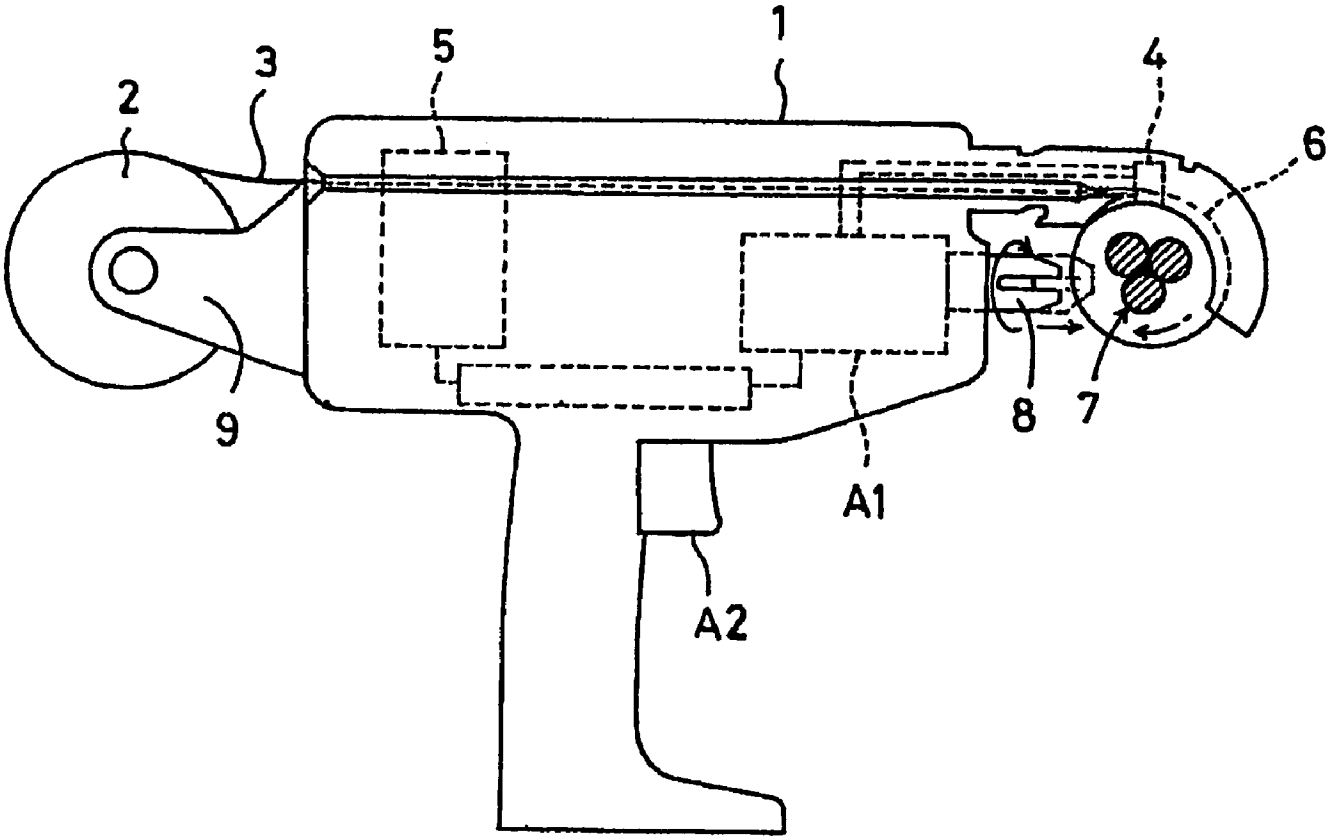
FIG. 39 is a side view of a conventional reinforcement binding machine.
Figure 40:
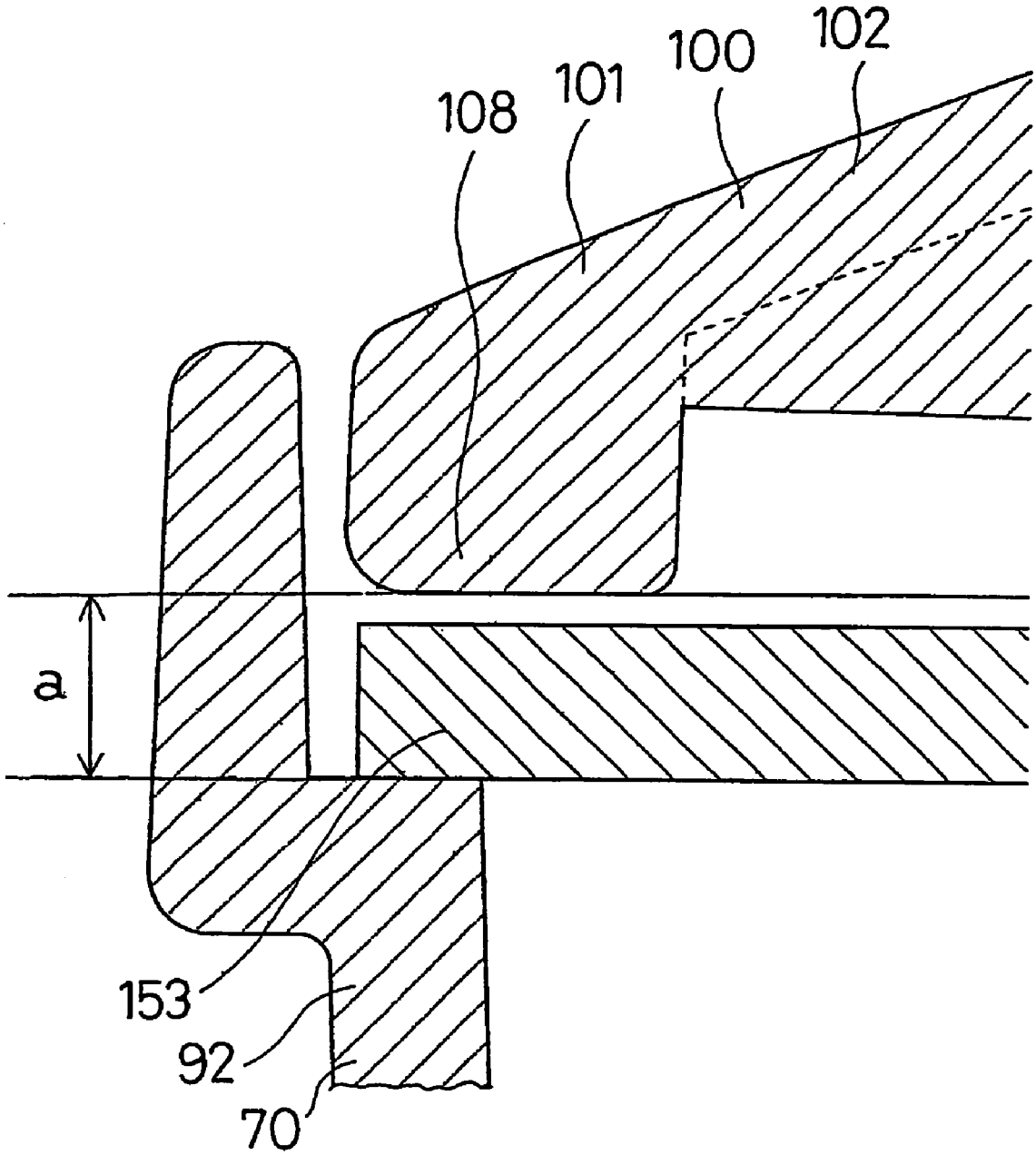
FIG. 40 is an enlarged main-portion explanatory view of FIG. 35.

As described above, the cassette case 70 accommodating the wire reel 150 is mounted, by means of bolts or the like, to the reinforcement binding machine 20 of the configuration as shown in FIGS. 36 and 37. As stated above, of the wire reel 150, the small flange 152 is fitted into the first accommodating recess 80, and the large flange 153 is brought into slide contact with the upper end of the circumferential wall 92 of the cassette case 70, so that if the wire 27 is drawn out or drawn back by the gear 33, there is no fear of the wire 27 being detached from the small flange 152 and the large flange 153. Further, due to the difference in outer diameter between the large flange 153 and the small flange 152, the accommodating space 88 is secured, and the accommodating space 88 accommodates the deflection of the wire 27 generated when the wire 27 is drawn back. The rotating condition of the wire reel 150 is judged by detecting the higher protrusion 157A and the lower protrusion 157B by the optical sensor 87.

While in the above-described embodiment the large flange 153 of the wire reel 150 is not accommodated in the cassette case 70 but is in slide contact with the upper end of the circumferential wall 92, it is also possible for the outer diameter of the large flange 153 to be such that it can be accommodated in the cassette case 70 and that the gap between it and the circumferential wall 92 of the cassette case 70 is smaller than the diameter of the wire 27. Also when the outer diameter of the large flange 153 is determined in this way, the above accommodating space 88 is secured due to the difference in outer diameter between the large flange 153 and the small flange 152, and there is no fear of the wire 27 being detached from the small flange 152 and the large flange 153.

EFFECTS OF THE INVENTION

In the disclosed reinforcement binding machine, the optical sensor provided on the case is covered with an opaque cover, so that even when the reel is removed, it is possible to prevent generation of dust or dirt on the optical sensor. Even when the reel has been attached, the detection object differing from the cover in reflection light quantity is provided on the reel at the position where it faces the optical sensor, so that the detection objects can be discerned by the optical sensor, making it possible to detect the rotation of the reel by the optical sensor. Thus, it is possible to reliably detect the presence or absence of wire on the reel.

In the disclosed reinforcement binding machine and the reel, there are provided the plurality of detection objects differing in the detection physical amount detected by the sensor, whereby the detection range for the sensor is enlarged, making it possible to reliably detect the presence or absence of wire on the reel.

In the disclosed reinforcement binding machine, the detection object differing from the cover in reflection light reception quantity is provided to the reel at the position where it faces the light receiving means, so that, when the reel is attached, the rotation of the reel can be detected by the light receiving means. Thus, it is possible to reliably detect the presence or absence of wire on the reel.

The invention claimed is:

1. A reel for use in a reinforcement binding machine having a case mounted to the binding machine and a reel mounting shaft formed on the case, a wire for reinforcement binding is wound around the reel, and when the wire is fed out the reel is rotated, the reel comprising:

an optical sensor facing a side surface of the reel is provided at a bottom portion of the case, a cover for covering the optical sensor is rotatably retained by the reel mounting shaft such that the cover is rotatable relative to the reel mounting shaft, an opening is formed in a region of the cover passing over the optical sensor, and a detection object with an optical characteristic different from an optical characteristic of the cover is provided at a position facing the bottom portion of the case.

2. The reel according to claim 1, wherein a plurality of detection objects are provided on the reel, wherein each of the plurality of detection objects has a different optical characteristic.

3. The reel according to claim 2, wherein a difference in the optical characteristic is determined based on a difference in a distance between the sensor and each of the detection objects.

4. The reel according to claim 2, wherein the optical characteristic of the detection objects is determined by the light quantity, angle, and pattern of a light received by the optical sensor.

5. The reel according to claim 1, wherein the case and the cover cooperate to prevent intrusion of a disturbance light into the optical sensor.

6. The reel according to claim 1, wherein the cover is opaque.

7. The reel according to claim 1, wherein the cover is provided on the side surface of the reel.

8. The reel according to claim 7, wherein one of the optical characteristic of the detection object and the optical characteristic of the cover enables the optical sensor and the other does not enable the optical sensor so that a position of the reel can be determined by a signal from the sensor.

9. The reel according to claim 7, wherein a distance between the sensor and the detection object is different than a distance between the sensor and the cover.

10. A reel for use in a reinforcement binding machine of claim 5;

wherein a plurality of detection objects are provided on the reel, and wherein each of the plurality of detection objects has a different optical characteristic.

11. The reel according to claim 10, wherein a difference in the optical characteristic of each of the plurality of detection objects is determined based on a difference in a distance between the sensor and each of the detection objects.

12. The reel according to claim 10, wherein the optical characteristic of the detection objects is determined by the light quantity, angle, and pattern of a light received by the optical sensor.

* * * * *